US008734046B2

(12) United States Patent
Miracle

(10) Patent No.: US 8,734,046 B2
(45) **Date of Patent: *May 27, 2014**

(54) VERTICALLY ACTUATED VEHICLE BARRIER SYSTEM

(71) Applicant: Gary D. Miracle, Springboro, OH (US)

(72) Inventor: Gary D. Miracle, Springboro, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/927,644

(22) Filed: Jun. 26, 2013

(65) Prior Publication Data

US 2013/0287492 A1 Oct. 31, 2013

Related U.S. Application Data

(60) Division of application No. 12/643,000, filed on Dec. 21, 2009, now Pat. No. 8,496,395, and a continuation-in-part of application No. 11/742,648, filed on May 1, 2007, now Pat. No. 7,641,416.

(60) Provisional application No. 61/143,466, filed on Jan. 9, 2009, provisional application No. 60/799,439, filed on May 10, 2006.

(51) Int. Cl.
*E01F 13/00* (2006.01)

(52) U.S. Cl.
USPC ..... 404/6; 49/49; 49/131

(58) Field of Classification Search
USPC ..... 404/6, 9, 10; 256/13.1; 49/49, 131, 133
See application file for complete search history.

(56) References Cited

U.S. PATENT DOCUMENTS

| | | | | |
|---|---|---|---|---|
| 1,403,750 | A | 1/1922 | Donovan | |
| 1,633,659 | A * | 6/1927 | Cerny | 256/72 |
| 2,189,974 | A | 2/1940 | Buford | |
| 2,207,148 | A | 7/1940 | Hall | |
| 2,219,127 | A | 10/1940 | Buford | |
| 2,397,330 | A | 3/1946 | Sawyer | |
| 3,079,711 | A | 3/1963 | Turner | |
| 3,128,972 | A | 4/1964 | Fonden et al. | |
| 3,468,500 | A | 9/1969 | Carlsson | |
| 3,738,599 | A | 6/1973 | Borehag | |
| 3,798,855 | A | 3/1974 | Walker | |
| 3,810,595 | A | 5/1974 | Doolittle | |
| 4,004,857 | A | 1/1977 | Eschen, Jr. | |
| 4,138,095 | A | 2/1979 | Humphrey | |
| 4,152,871 | A | 5/1979 | Kardash, Jr. | |

(Continued)

OTHER PUBLICATIONS

Screenshots from www.roboticsecuritysystems.com, printed Apr. 17, 2007.

*Primary Examiner* — Matthew D Troutman
(74) *Attorney, Agent, or Firm* — Frost Brown Todd LLC

(57) ABSTRACT

A barrier system comprises a housing, substantially vertical members, and vertical guide tubes. The housing extends into the ground. The guide tubes are positioned in the housing and also extend into the ground below the housing. The substantially vertical members are translatable vertically within the guide tubes. At least one barrier member is secured to the substantially vertical members. The at least one barrier member may comprise at least one guardrail, a plurality of chains or cables, and/or a plurality of gate beams. A series of cables and pulleys form an actuation system that raises and lowers the substantially vertical members relative to the guide tubes to selectively extend and retract the at least one barrier member relative to the ground. A cover plate may selectively cover the top opening of the housing when the barrier member and substantially vertical members are retracted within the housing.

19 Claims, 38 Drawing Sheets

(56) References Cited

U.S. PATENT DOCUMENTS

| | | | | |
|---|---|---|---|---|
| 4,312,600 | A | 1/1982 | Schaaf et al. | |
| 4,438,596 | A | 3/1984 | Jones et al. | |
| 4,465,262 | A | 8/1984 | Itri et al. | |
| 4,490,068 | A | 12/1984 | Dickinson | |
| 4,502,812 | A | 3/1985 | Zucker | |
| 4,554,695 | A | 11/1985 | Rowland | |
| 4,574,523 | A | 3/1986 | Nasatka | |
| 4,576,507 | A | 3/1986 | Terio | |
| 4,576,508 | A | 3/1986 | Dickinson | |
| 4,577,991 | A | 3/1986 | Rolow | |
| 4,630,395 | A | 12/1986 | Nasatka | |
| 4,666,331 | A | 5/1987 | Riley | |
| 4,705,426 | A | 11/1987 | Perea | |
| 4,711,608 | A | 12/1987 | Ghusn | |
| 4,715,742 | A | 12/1987 | Dickinson | |
| 4,818,136 | A | 4/1989 | Nasatka et al. | |
| 4,826,349 | A | 5/1989 | Nasatka | |
| 4,850,737 | A | 7/1989 | Nasatka et al. | |
| 4,852,511 | A | 8/1989 | Look et al. | |
| 4,861,185 | A | 8/1989 | Eikelenboon | |
| 4,922,655 | A | 5/1990 | Seal | |
| 4,964,750 | A | 10/1990 | House | |
| 5,009,542 | A * | 4/1991 | Hardin et al. | 404/6 |
| 5,030,029 | A | 7/1991 | Johnsen | |
| 5,050,846 | A | 9/1991 | Goodman et al. | |
| 5,118,056 | A | 6/1992 | Jeanise | |
| 5,123,773 | A | 6/1992 | Yodock | |
| 5,131,786 | A | 7/1992 | House et al. | |
| 5,215,399 | A | 6/1993 | Berger | |
| 5,228,237 | A | 7/1993 | Nasatka | |
| 5,245,787 | A | 9/1993 | Swenson et al. | |
| 5,248,215 | A | 9/1993 | Fladung | |
| 5,288,164 | A | 2/1994 | Nasatka | |
| 5,297,921 | A | 3/1994 | Springer et al. | |
| 5,336,033 | A | 8/1994 | Alexander | |
| 5,346,353 | A | 9/1994 | Alexander | |
| 5,466,088 | A | 11/1995 | Nasatka | |
| 5,544,614 | A | 8/1996 | Cushman | |
| 5,551,796 | A * | 9/1996 | Anderson et al. | 404/6 |
| 5,605,413 | A | 2/1997 | Brown | |
| 5,626,330 | A | 5/1997 | Young | |
| 5,640,806 | A | 6/1997 | Hall | |
| 5,711,110 | A | 1/1998 | Williams | |
| 5,775,833 | A | 7/1998 | Little | |
| 5,809,733 | A | 9/1998 | Venegas, Jr. | |
| 5,871,038 | A | 2/1999 | Gompertz et al. | |
| 5,895,169 | A | 4/1999 | Holm et al. | |
| 5,975,791 | A | 11/1999 | McCulloch | |
| 5,987,616 | A | 11/1999 | Suzuki | |
| 6,071,037 | A | 6/2000 | Holt | |
| 6,099,200 | A | 8/2000 | Pepe et al. | |
| 6,108,977 | A | 8/2000 | Payne et al. | |
| 6,116,805 | A | 9/2000 | Gertz | |
| 6,135,190 | A | 10/2000 | Gompertz et al. | |
| 6,145,571 | A | 11/2000 | Snyder | |
| 6,149,338 | A | 11/2000 | Anderson | |
| 6,158,696 | A | 12/2000 | Brodskiy | |
| 6,312,188 | B1 | 11/2001 | Ousterhout et al. | |
| 6,322,285 | B1 | 11/2001 | Ben | |
| 6,349,503 | B1 | 2/2002 | Gompertz et al. | |
| 6,367,781 | B1 | 4/2002 | Flynn et al. | |
| 6,382,870 | B1 | 5/2002 | Gertz | |
| 6,578,342 | B2 | 6/2003 | Faynor | |
| 6,662,520 | B1 | 12/2003 | Nelson | |
| 6,709,190 | B1 | 3/2004 | Partin | |
| 6,769,833 | B2 | 8/2004 | Dicke et al. | |
| 6,817,805 | B2 | 11/2004 | Mettler | |
| 6,836,222 | B1 | 12/2004 | Carini | |
| 6,866,252 | B2 | 3/2005 | Pulliam | |
| 6,926,462 | B1 * | 8/2005 | Fuganti et al. | 404/6 |
| 6,951,434 | B2 | 10/2005 | Yodock, Jr. et al. | |
| 7,037,028 | B1 * | 5/2006 | Donohoe et al. | 404/6 |
| 7,195,422 | B2 | 3/2007 | Hannah | |
| 7,329,067 | B1 | 2/2008 | Rodriguez | |
| 7,581,351 | B2 | 9/2009 | Lewis | |
| 7,641,416 | B2 | 1/2010 | Miracle | |
| 7,862,252 | B2 | 1/2011 | Gelfand et al. | |
| 8,282,082 | B2 * | 10/2012 | An | 256/13.1 |
| 8,496,395 | B2 * | 7/2013 | Miracle | 404/6 |
| 2005/0175408 | A1 * | 8/2005 | Fuganti et al. | 404/6 |
| 2005/0220536 | A1 | 10/2005 | Blair et al. | |
| 2005/0232740 | A1 | 10/2005 | Cummings | |
| 2010/0098486 | A1 | 4/2010 | Miracle | |

* cited by examiner

VERTICALLY ACTUATED VEHICLE BARRIER SYSTEM

PRIORITY

This application is a divisional of U.S. patent application Ser. No. 12/643,000, filed Dec. 21, 2009, entitled "Vertically Actuated Vehicle Barrier System," the disclosure of which is incorporated by reference herein; which claims priority to U.S. Provisional Patent Application No. 61/143,466, filed Jan. 9, 2009, entitled "Vertically Actuated Vehicle Barrier System," the disclosure of which is incorporated by reference herein. U.S. patent application Ser. No. 12/643,000 is also a continuation-in-part of U.S. patent application Ser. No. 11/742,648, filed May 1, 2007, entitled "Vehicle Barrier Deployment System," the disclosure of which is incorporated by reference herein; which in turn claims priority to U.S. Provisional Patent Application No. 60/799,439, filed May 10, 2006, entitled "Vehicle Barrier Deployment System," the disclosure of which incorporated by reference herein.

BACKGROUND

Versions of the present invention relate to systems and devices that may be used to provide a barrier to prevent the passage of vehicles and the like. Some barriers may be installed in a fixed configuration, such that the barrier system constantly prevents the passage of vehicles and the like. Other barriers may be selectively deployable, such that vehicles may pass during selected times (e.g., when the barrier is present but not deployed); while vehicles may be prevented from passing during other selected times (e.g., when the barrier is deployed). Some vehicle barriers are shown and described in U.S. Pub. No. 2007/0264080, entitled "Vehicle Barrier Deployment System," published Nov. 15, 2007, the disclosure of which is incorporated by reference herein. While a variety of systems and methods have been made and used to provide a barrier, it is believed that no one prior to the inventor has made or used the invention described herein.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1:
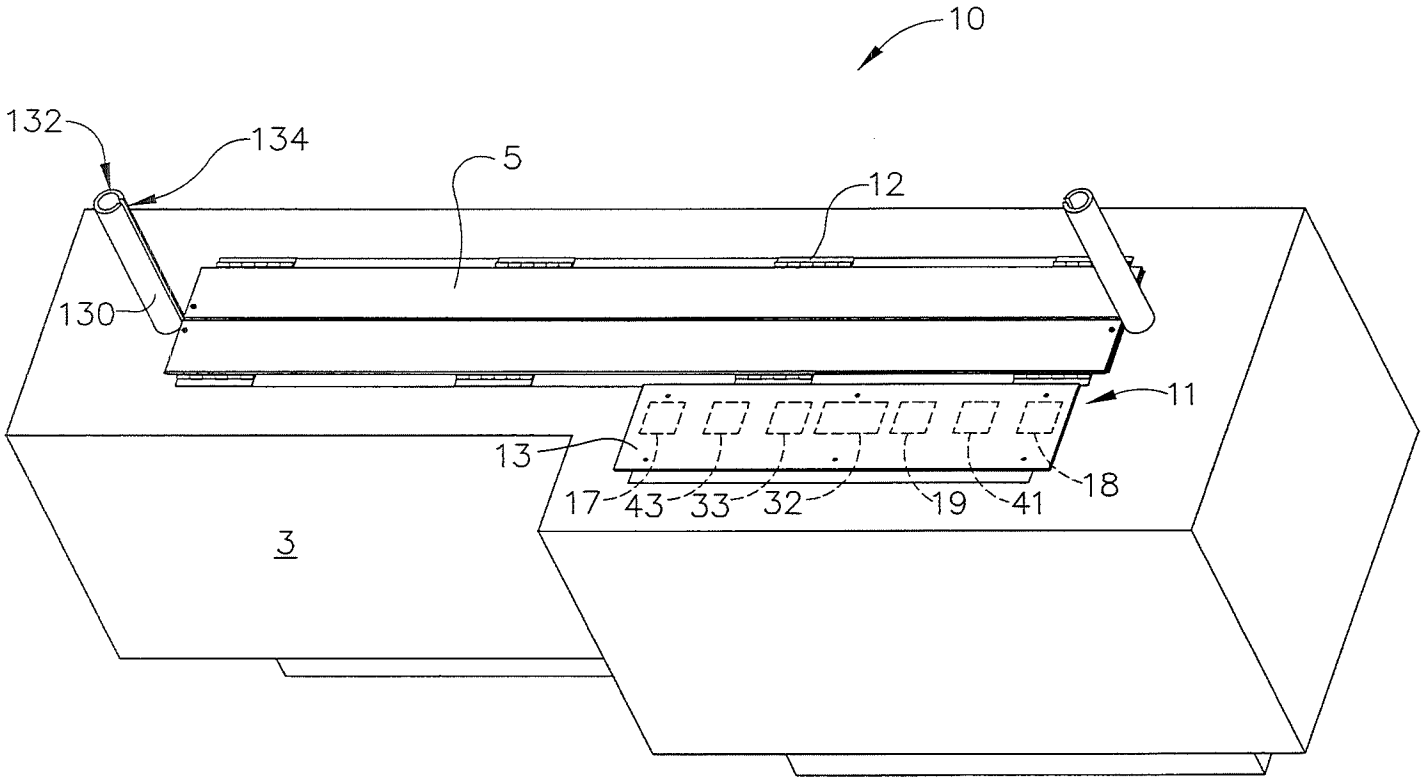
FIG. 1 is a perspective view of an exemplary vehicle barrier system in an undeployed position.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

I. Exemplary Vehicle Barrier with Guardrail

A. Overview

FIGS. 1-10 show an exemplary vehicle barrier system (10) that includes guardrails (202) and that is selectively retractable into the ground. As shown in FIGS. 1-4, barrier system (10) comprises a housing (4) embedded within reinforced concrete (3). A pair of hinged cover plates (5) are coupled with housing (4), and a plurality of vertical posts (100, 101) are operable to reciprocate relative to housing (4). Posts (100, 101) include passive posts (100) and lifting posts (101), as will be described in greater detail below. It will be appreciated, however, that any suitable number of passive posts (100) and/or lifting posts (101) may be used in any suitable arrangement. In the present example, lifting posts (101) comprise steel I-beams, while passive posts (100) comprise steel square tubes. That is, lifting posts (101) of the present example comprise steel extrusions having an "I"-shaped cross section, while passive posts (100) of the present example comprise steel tubes having a square cross section. Alternatively, posts (100, 101) may be formed of any other suitable material(s) and may have any other suitable cross sectional form(s). Optionally, posts (100) may include "I-beams" or other suitable structures secured within their interior for reinforcement. By way of example only, posts (100) may alternatively have a cross sectional form that is similar to the cross sectional form of posts (101) in some versions, or vice versa. Furthermore, in some versions posts (100) are omitted entirely, such that only posts (101) are included. In some such versions, posts (101) are coupled together via one or more horizontal members (200) and/or an integral cover plate (not shown) that is substituted for cover plates (5).

Posts (100, 101) are connected by a plurality of horizontal members (200) (e.g., I-beams, etc.) in the present example, such that posts (100, 101) move vertically substantially simultaneously. In some versions, a single horizontal member (200) spans across all posts (100, 101) (e.g., along the tops of posts (100, 101)), in addition to or in lieu of separate horizontal members (200) spanning between adjacent posts (100, 101). In addition, guardrails (202) are connected to and span across opposing sides of posts (100, 101) in the present example. While barrier system (10) of the present example comprises a pair of guardrails (202), it should be understood that only a single guardrail (202) may be used, if desired (e.g., on just one side of posts (100, 101), etc.). It should also be understood that various structures other than guardrails (202) may be used. Several structures that may be used as an alternative to guardrails (202) will be described in greater detail below, while others will be apparent to those of ordinary skill in the art in view of the teachings herein. It should be understood that one or more additional guardrails (202) may be provided vertically above guardrails (202) that are shown in the depicted version of barrier system (10), such as to increase the height of barrier system (10). It should also be understood that two or more guardrails (202) may be "nested" with each other (e.g., guardrails (202) doubled, with one guardrail (202) placed on the inside of another guardrail (202), etc.), such as to increase the effective thickness and/or strength of guardrails (202).

As will also be described in greater detail below, barrier system (10) is operable to selectively raise and lower posts (100, 101) relative to housing (4). For instance, guardrails (202) may be raised such that their lower edges are at a height of anywhere between approximately 27 inches and approximately 36 inches (e.g., relative to the ground and/or relative to concrete (3), etc.), or at any other suitable height. Furthermore, cover plates (5) are configured to substantially close posts (100, 101), horizontal members (200), and guardrails (202) within housing (4) when posts (100, 101) and guardrails (202) are retracted downward.

Figure 2:
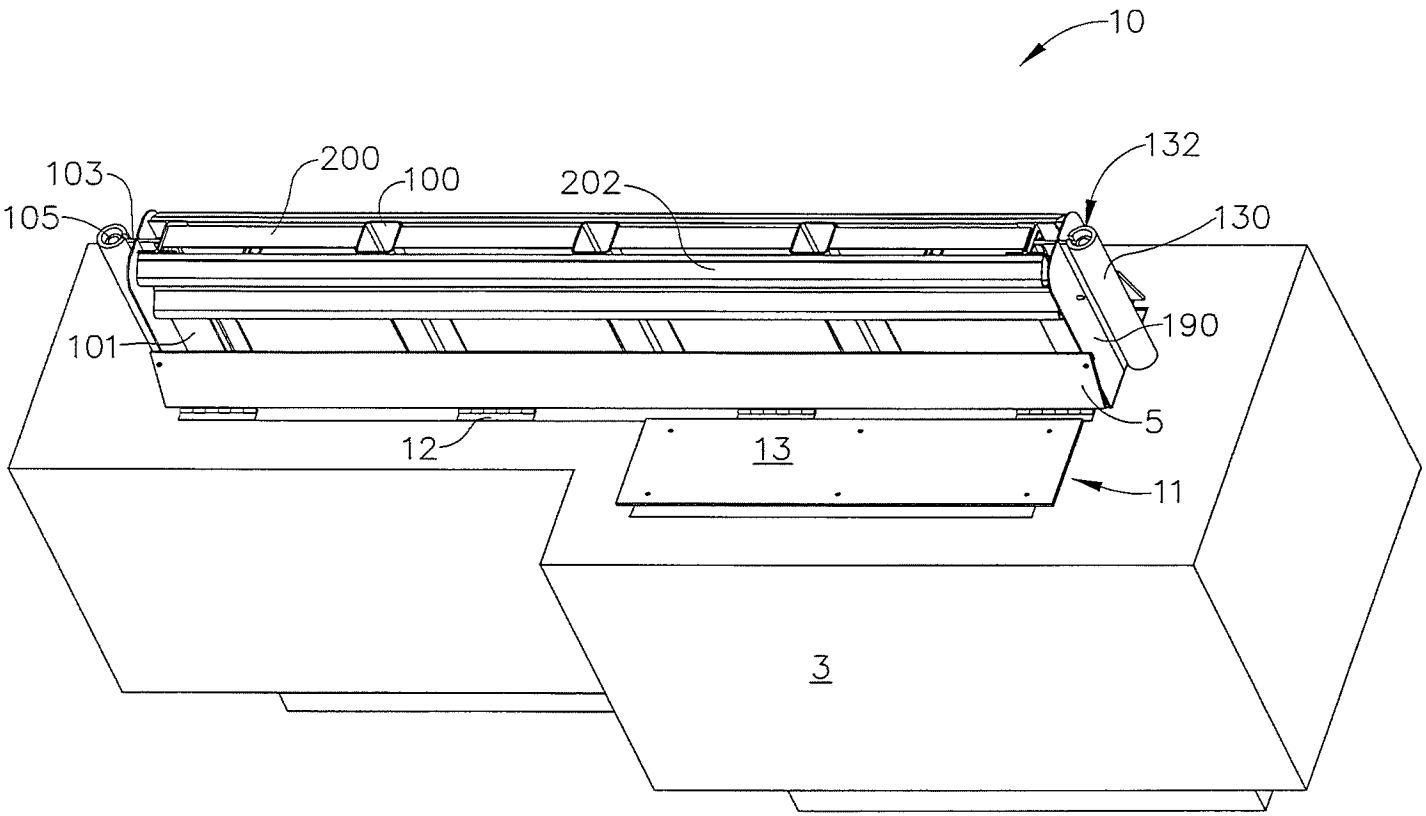
FIG. 2 is a perspective view of the system of FIG. 1 in a deployed position.
Figure 3:
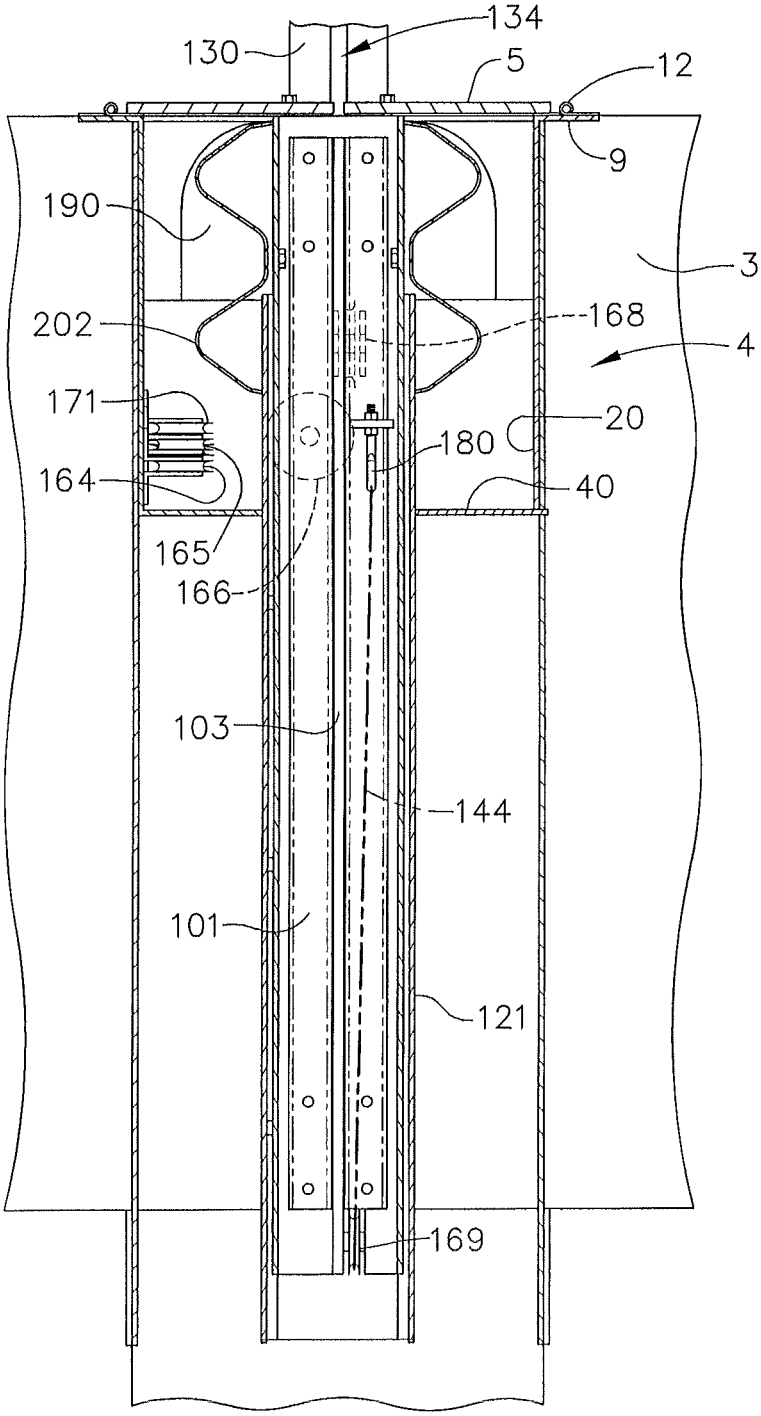
FIG. 3 is a cross-sectional view of the system of FIG. 1 in an undeployed position, viewed from an end of the system toward the middle of the system.
Figure 4:
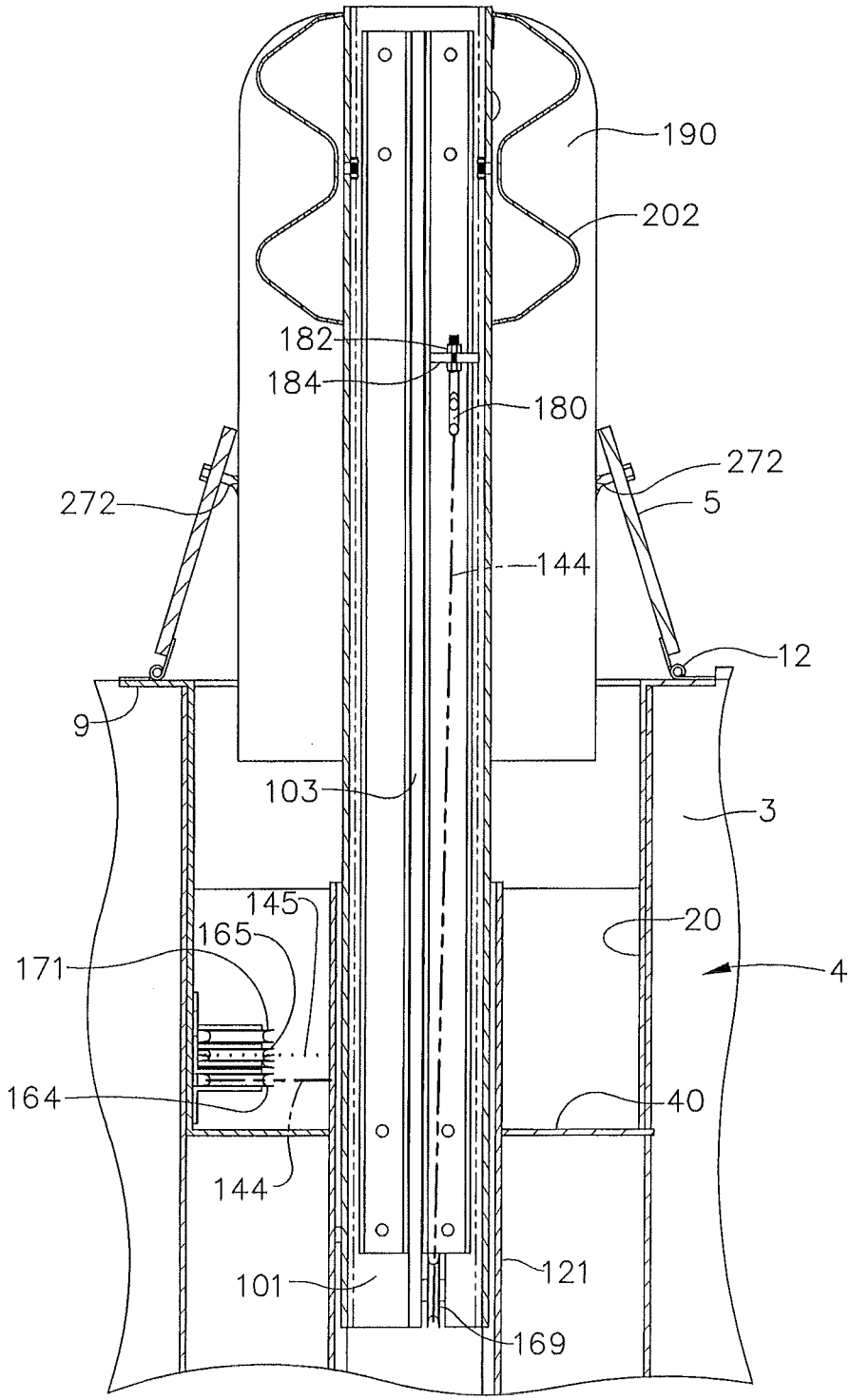
FIG. 4 is a cross-sectional view of the system of FIG. 1 in a deployed position, viewed from an end of the system toward the middle of the system.
Figure 8:
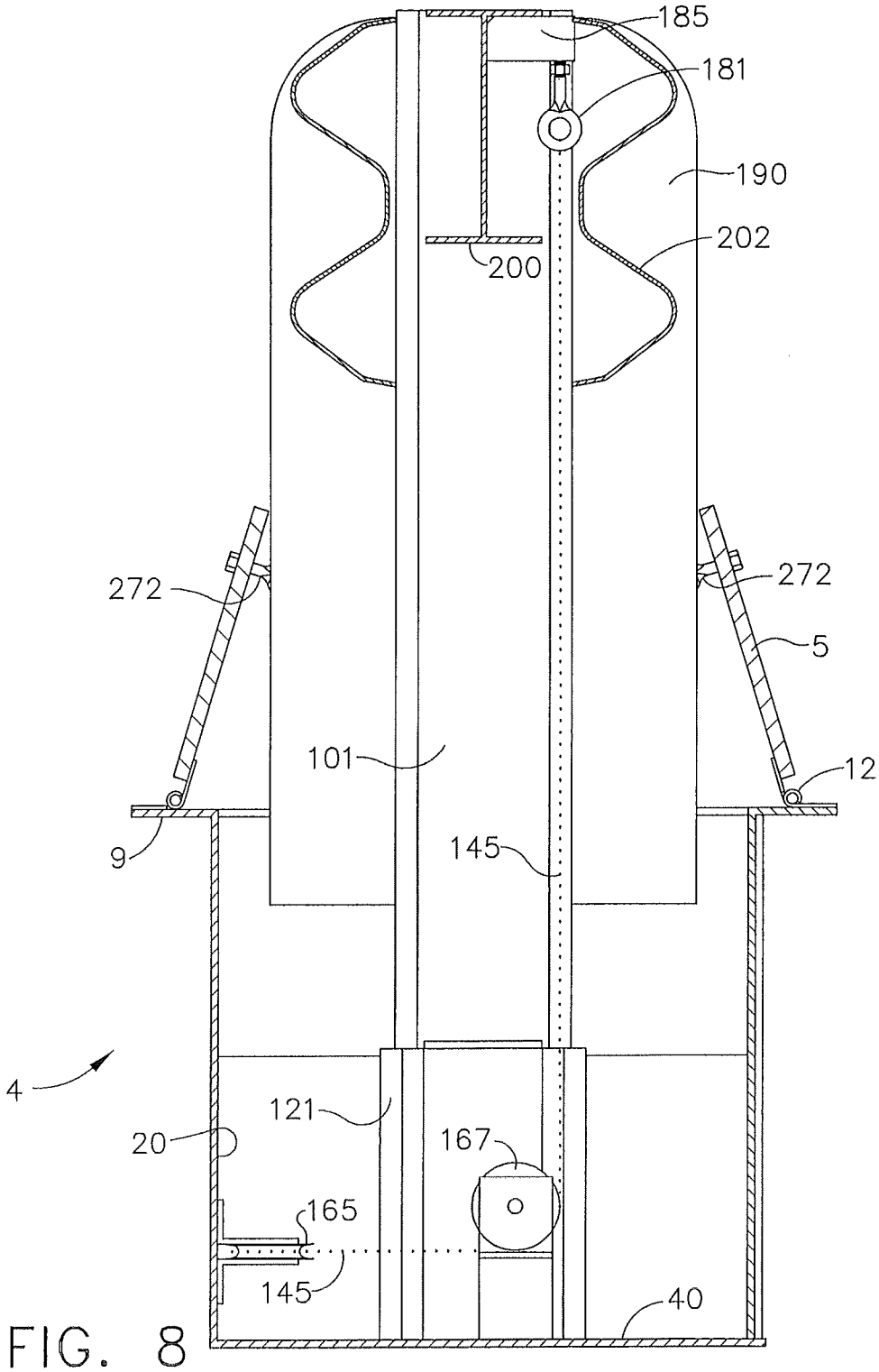
FIG. 8 is a partial end view of the cables and pulleys of FIG. 5, showing barrier retraction components, viewed from an inner portion of the barrier system of FIG. 1 toward an outer end of the barrier system.

FIGS. 1 and 3 show posts (100, 101) and guardrails (202) in a retracted or undeployed configuration. In this configuration, posts (100, 101) and guardrails (202) are completely recessed below ground level, and cover plates (5) are substantially flush with the ground level. FIGS. 2, 4, and 8 show posts (100, 101) and guardrails (202) in a deployed configuration, with cover plates (5) open. In this configuration, posts (100, 101) and guardrails (202) are positioned above ground level, and are configured to provide a barrier against passage of vehicles and the like. Barrier system (10) may therefore be provided within a road, median, sidewalk, or elsewhere to selectively prevent passage of vehicles and the like. Various suitable locations and ways in which barrier system (10) may be positioned and used will be described in greater detail below, while other suitable locations and ways in which barrier system (10) may be positioned and used will be apparent to those of ordinary skill in the art in view of the teachings herein.

In some versions, barrier system (10) may stop a vehicle that is traveling at a high rate of speed, even if the driver of the vehicle is intent on passing through the barrier provided by barrier system (10). For instance, posts (100, 101) and guardrails (202) may be substantially rigid, such that they provide little or no "give" when struck by a vehicle. By way of example only, some versions of barrier system (10) may meet a Department of State "K" certification requiring that the front line of cargo of a 15,000 pound vehicle traveling 50 mph must not go further than 1 meter past the line defined by barrier system (10). In addition or in the alternative, some versions of barrier system (10) may satisfy the American Association of State Highway and Transportation Officials (AASHTO) Manual for Assessing Safety Hardware (MASH) criteria. In some instances with some versions of barrier system (10), posts (100, 101) and/or guardrails (202) may essentially destroy a vehicle that strikes posts (100, 101) and/or guardrails (202), with relatively little damage being done to barrier system (10). For instance, barrier system (10) may be constructed such that no portions of barrier system (10) are released as projectiles when barrier system (10) is struck by a heavy vehicle moving at a high rate of speed.

As shown in FIGS. 3-6 and 8-9, housing (4) of the present example comprises sidewalls (20) and a floor (40). As shown in FIG. 1, a plurality of electrical components are provided within or near housing (4), including an electrical junction box (19), a transformer (32), a DC/AC inverter (33), a battery (43), a battery charger (41), and a limit switch (not shown). Of course, each and every one of these components is merely optional, and any of them may be varied, substituted, supplemented, or omitted as desired. In the present example, these components provide electricity to other components within housing (4), as will be described in greater detail below. Various ways in which these components may be selected and coupled will be apparent to those of ordinary skill in the art in view of the teachings herein. In the present example, these components are provided in compartment (11) at the side of housing (4), with a separate cover plate (13), though any other suitable location(s) may be used. Cover plate (13) may be hinged, bolted down, or otherwise be selectively removable or openable as desired.

It should be understood that compartment (11) may be provided at either or both ends of housing (4), in addition to or in lieu of being provided at the side of housing (4). Alternatively, compartment (11) may be provided at any other suitable location; or may be omitted altogether (e.g., components separated and located at various positions within housing (4), etc.). In some versions, battery (43) is rechargeable by solar power via a solar panel (not shown). In some other versions, battery (43) is omitted, and an external power line is fed to housing (4). It will be appreciated, therefore, that a variety of alternative components may be used to provide and/or regulate electricity to other components within housing (4). It will also be appreciated that, in some versions, barrier system (10) may be modified such that no external power source is required at all. A sump pump (18) may also be provided within housing (4), below housing (4), or elsewhere, such as to purge water from housing (4). For instance, a perforated drainage pipe or "French drain" may be located at the bottom of housing (4) (e.g., below floor (40)), and may be coupled with sump pump (18). Of course, as with various other components described herein, a sump pump (18) is merely optional.

Figure 9:
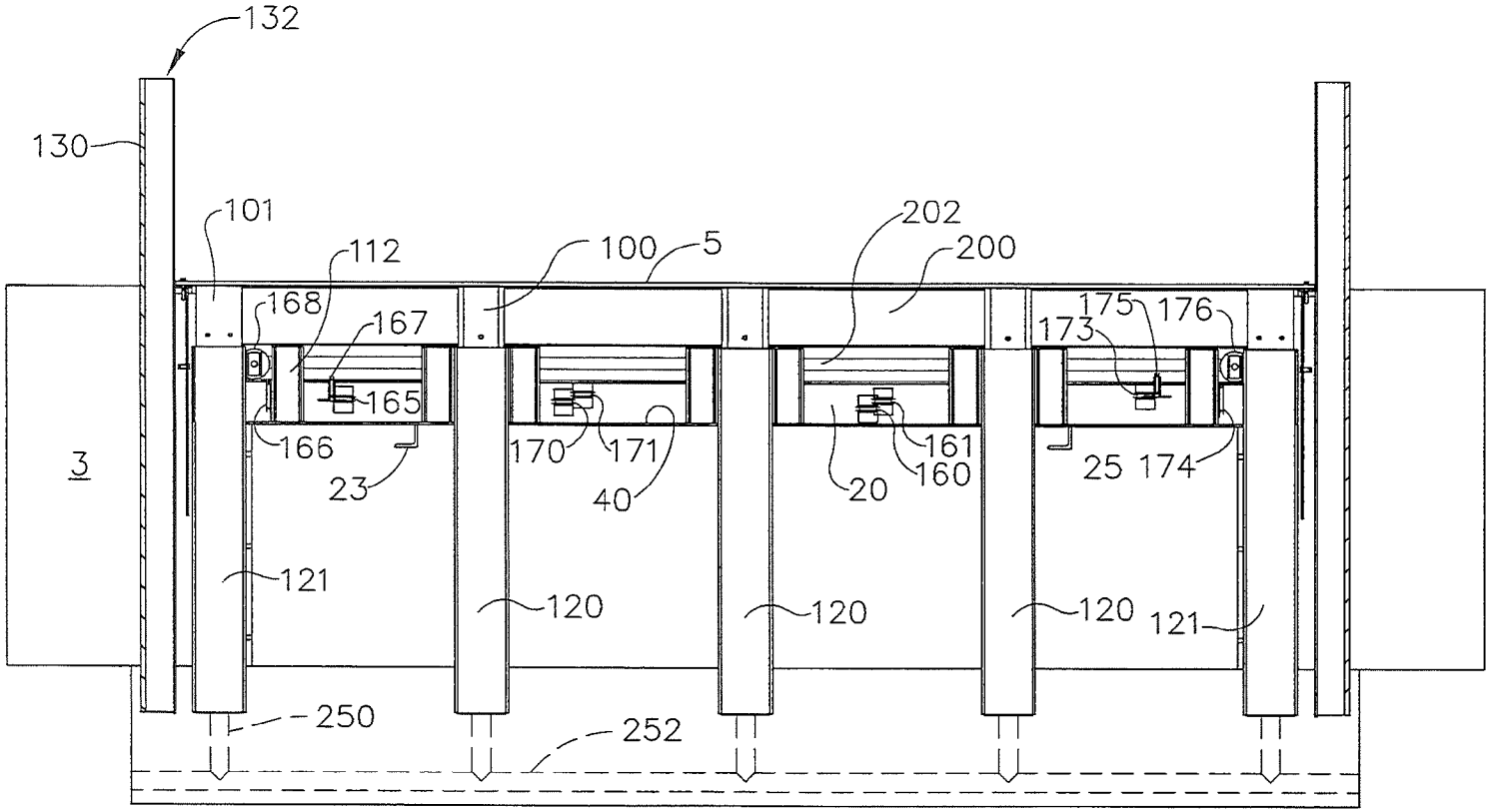
FIG. 9 is a side cross-sectional view of the system of FIG. 1.
Figure 10:
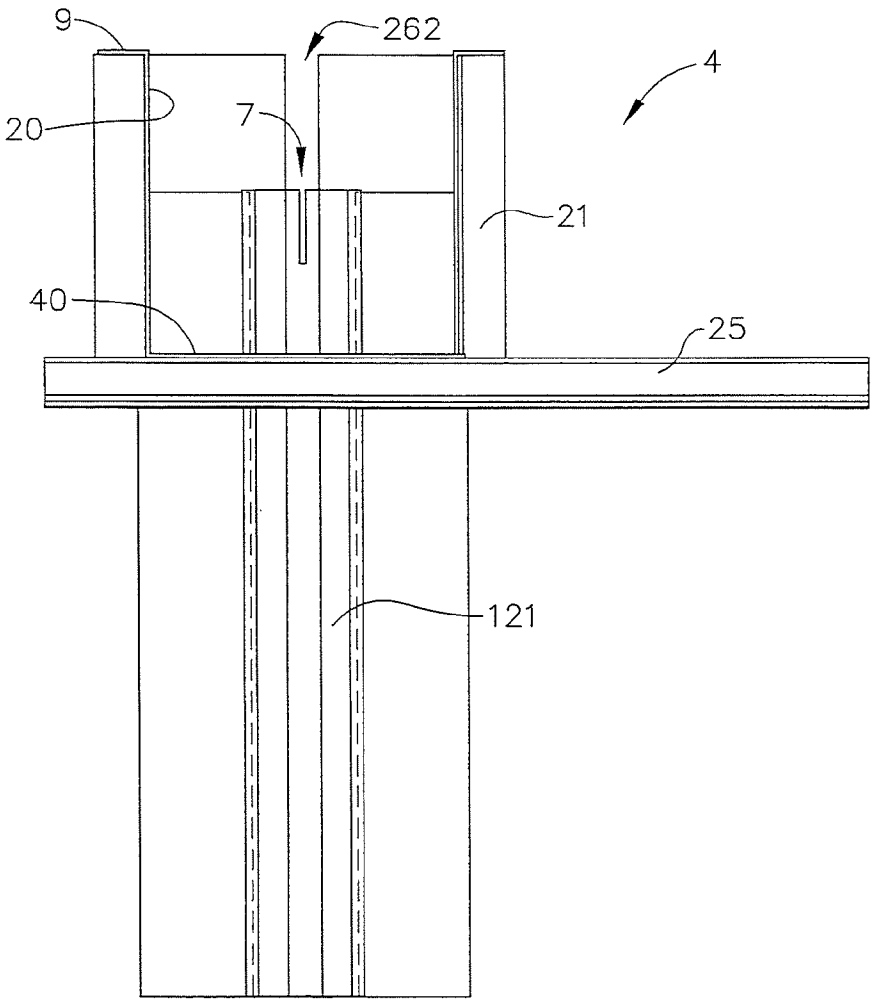
FIG. 10 is an end view of housing components of the system of FIG. 1.

As shown in FIGS. 3-6 and 8-10, housing (4) is provided with various structures and features for reinforcement in the present example. For instance, a flange (9) extends outwardly from the top of the outside surface of each sidewall (20) in the present example, such that flanges (9) extend substantially along the length of each sidewall (20). Flanges (9) may be anchored within reinforced concrete (3) by a plurality of J-bolts (not shown), though any other suitable anchoring structures or techniques may be used. Flanges (9) may be integrally formed with sidewalls (20). Alternatively, flanges (9) may comprise separate components (e.g., "structural angles," etc.) that are joined to sidewalls (20). In addition, a horizontal stiffener member (not shown) may be secured at the middle of the outside surface of each sidewall (20), such that horizontal stiffener members extend substantially along the length of each sidewall (20). A plurality of vertical stiffener members (21) may also be secured to the outer surface of each sidewall (20), such that each vertical stiffener member (21) extends substantially along the height of each sidewall (20). Furthermore, as shown in FIG. 9, one or more horizontal stiffener members (23) may be secured to pairs of vertical stiffener members (21) or otherwise be secured to housing (4), and may extend along the width of the outer surface of floor (40). As shown in FIGS. 9-10, a longer horizontal stiffener member (25) may be positioned to extend underneath compartment (11), such as to provide additional structural support for compartment (11). Accordingly, flanges (9), horizontal stiffener members (23, 25), vertical stiffener members (21), and/or any other suitable components may together form a reinforcing external "skeleton" for housing (4). Further reinforcement may be provided by including a matrix of rebar (not shown) in concrete (3). As with other components described herein, each of these components may be substituted, supplemented, relocated, or omitted in any suitable fashion as desired.

B. Exemplary Deployment and Retraction System

As shown in FIGS. 3-9 a plurality of post guides (120, 121) extend upwardly from floor (40) of housing (4). Post guides (120, 121) may comprise steel tubes having a square cross section. Alternatively, post guides (120, 121) may be formed of any other suitable material(s) and may have any other suitable cross section. Post guides (120) may be laterally supported by support posts (110) (e.g., I-beams, etc.), which are secured to floor (40) of housing (4). In addition or in the alternative, post guides (120) may optionally include "I-beams" or other suitable structures secured within their interior for reinforcement. Of course, support posts (110) may be positioned anywhere desired, and any other structures, features, or devices may be used to support post guides (120), and support posts (110) may even be omitted if desired. Post guides (120, 121) are configured to receive posts (100, 101). In particular, posts (100) are inserted in post guides (120); while posts (101) are inserted into post guides (121). Post guides (120, 121) are configured to restrict lateral movement of posts (100, 101), while permitting posts (100, 101) to move vertically (e.g., reciprocate) within post guides (120, 121). While three posts (100) and two posts (101) are shown in the present example, it should be understood that any desired number of posts (100, 101) may be used Likewise, any suitable number of post guides (120, 121) may be used.

Post guides (120, 121) may have a height that is greater than the height of sidewalls (20), though post guides (120, 121) do not extend above sidewalls (20) in this example. For instance, while the upper rims of post guides (120, 121) may be positioned below the upper rims of sidewalls (20), the lower portions of post guides (120, 121) may extend below floor (40) of housing (4). In particular, the lower portions of post guides (120, 121) may be embedded in concrete (3) or in the ground, below floor (40). Alternatively, post guides (120, 121) may have any other desired length and position relative to housing (4). In addition, as shown in FIG. 9, the lower end of each post guide (120, 121) may communicate with a respective vertical drain section (250). Each vertical drain section (250) may further communicate with a common horizontal drain section (252). Drain sections (250, 252) may collectively form part of a "French drain" system to assist in evacuating rain water, etc., from housing (4). Post guides (120, 121) may further include one or more side openings formed in the sidewalls of post guides (120, 121), just above floor (40) of housing (4), to further assist in communication of water from housing (4) down post guides (120, 121) and into drain sections (250, 252). Of course, a variety of other types of drainage systems may be provided; or barrier system (10) may even lack a drainage system.

As shown in FIGS. 1-3, 6, and 9, a pair of static guides (130) are positioned outside of housing (4), on opposite ends of housing (4). The lower ends of static guides (130) extend through concrete (3), below floor (40) of housing (4), such that the lower ends of static guides (130) are encased in concrete (3); while the upper ends of static guides (130) protrude above the ground. In some versions, at least a portion of upper ends of static guides (130) is attached with adjacent concrete barrier walls (not shown). For instance, when barrier system (10) is installed in a gap between preexisting concrete barrier walls, upper ends of static guides (130) may be bolted to or otherwise secured to adjacent concrete barrier walls. As another merely illustrative example, when barrier system (10) is installed with new adjacent concrete barrier walls, the new concrete barrier walls may be formed around static guides (130) such that static guides (130) are embedded in the new concrete barrier walls. As yet another merely illustrative example, when barrier system (10) is installed with new adjacent concrete barrier walls, the new concrete barrier walls may be formed with slots configured to insertingly receive static guides (130) after the new concrete barrier walls have sufficiently hardened or cured. Still other suitable ways in which the upper portions of static guides (130) may be laterally restrained will be apparent to those of ordinary skill in the art in view of the teachings herein.

Static guides (130) do not move in this example. Static guides (130) each define a bore (132) and a longitudinal slot (134) in communication with bore (132). Each post (101) has a unitary, outwardly extending extension (103); while each extension has a pipe (105) unitarily secured thereto. In particular, each bore (132) is positioned and configured to receive a corresponding pipe (105); while each slot (134) is positioned and configured to receive a corresponding extension (103). Bores (132), pipes (105), slots (134), and extensions (103) are all positioned and configured such that posts (101) may travel vertically upwardly and downwardly relative to static guides (130), without static guides (130) restricting such vertical movement.

Figure 5:
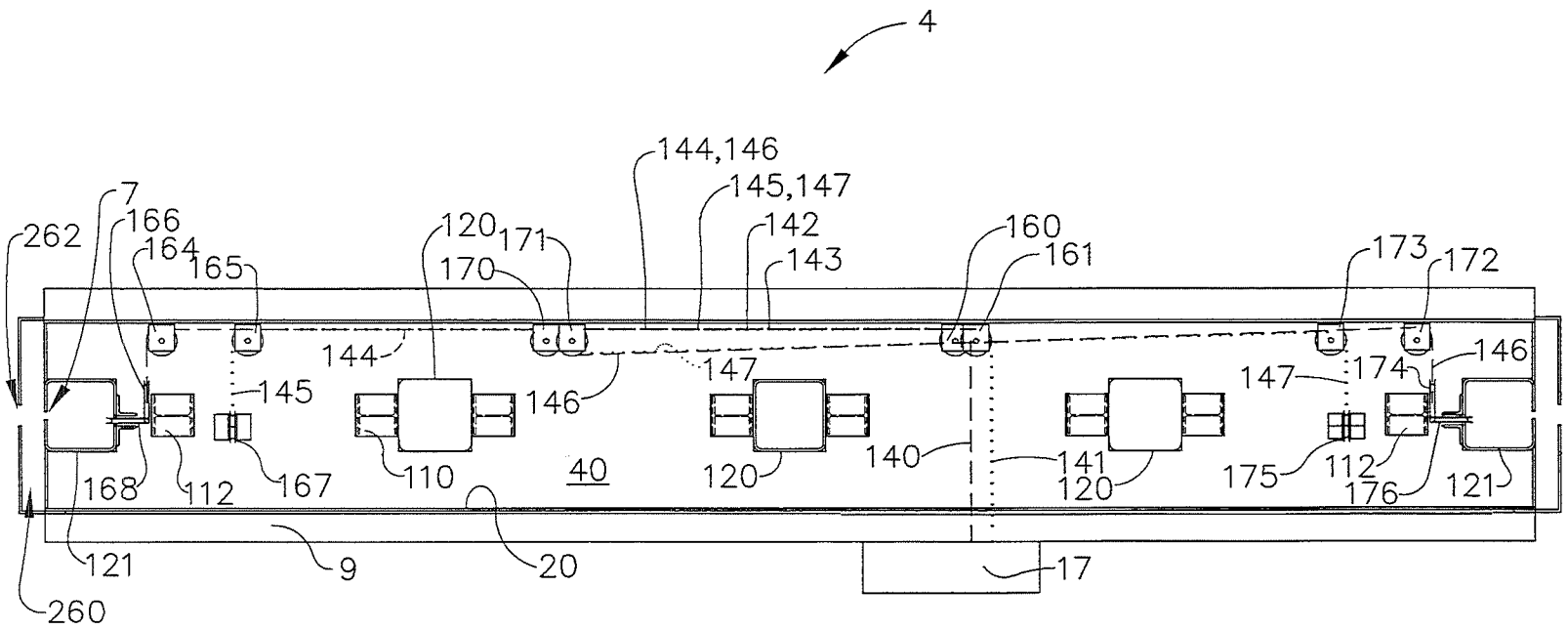
FIG. 5 is a partial top elevational view of the system of FIG. 1, with a cover and barriers removed, showing an arrangement of cables and pulleys.
Figure 6:
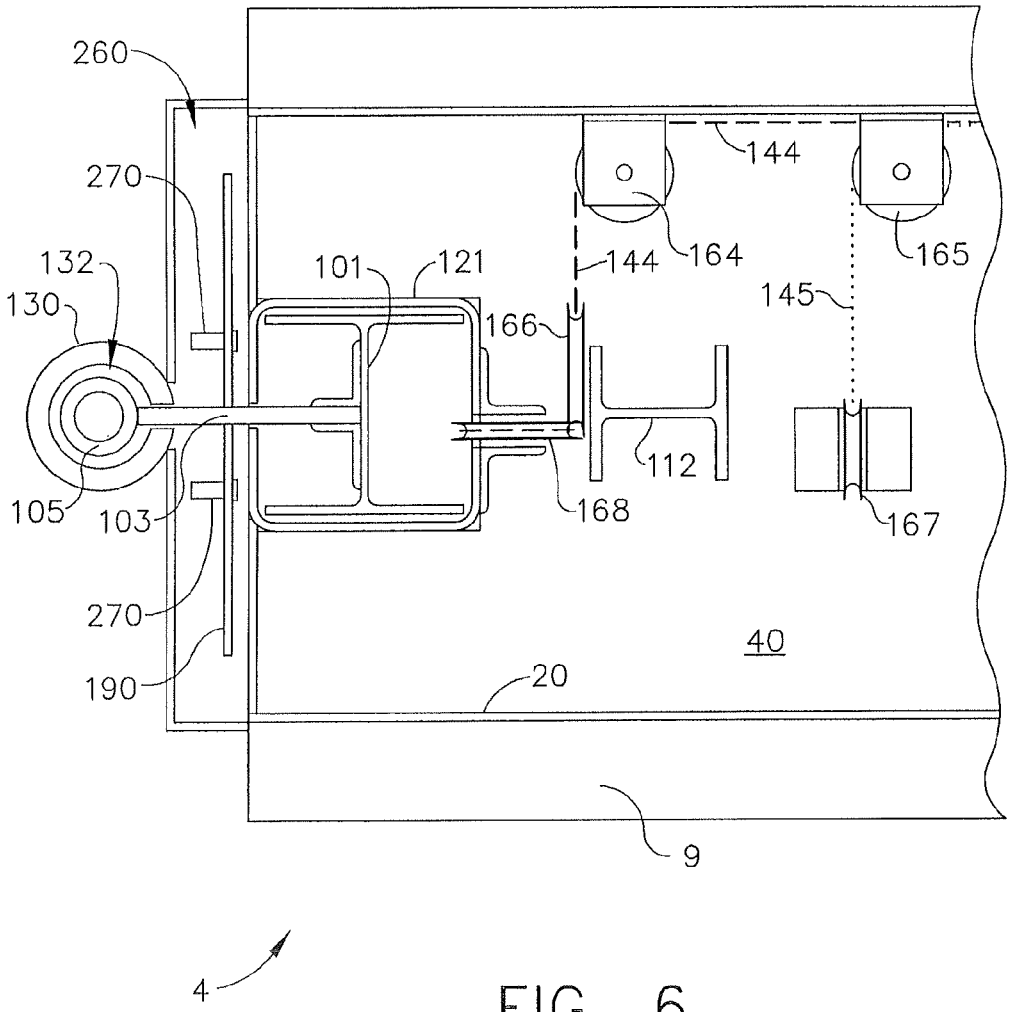
FIG. 6 is a partial top view of the cables and pulleys of FIG. 5, showing barrier deployment components.

As shown in FIGS. 5-6 and 10, housing (4) may also include slots (7) to provide clearance for extensions (103) when posts (101) are in a retracted position. In some versions, post guides (121) form part of the outer ends of housing (4), and/or post guides (121) include slots (7) to provide clearance for extensions (103) when posts (101) are in a retracted position. While static guides (130) do not restrict vertical movement of posts (101) in this example, static guides (130) do restrict horizontal movement of posts (101) in any direction. Static guides (130) may thus provide additional structural support for posts (101), such as when posts (100, 101) and/or guardrail (202) are/is struck by a vehicle when barrier system (10) is in a deployed configuration. As with other components described herein, static guides (130) are merely optional, and can be completely omitted if desired.

As shown in FIGS. 1 and 5, barrier system (10) of the present example further comprises a winch (17). Winch (17) may be secured to, within, or external to housing (4) (e.g., in the ground). To receive power, winch (17) of the present example is in electrical communication with the electrical components (e.g., battery (43) and/or external power source, etc.) described above. Winch (17) is in mechanical communication with cables (140, 141). In particular, deployment cable (140) extends from the top of the drum of winch (17); while retraction cable (141) extends from the bottom of the drum of winch (17). Cables (140, 141) and winch (17) are configured such that, when winch (17) is rotated in a first direction, cable (140) is pulled by winch (17) while cable (141) is released from winch (17). Likewise, when winch (17) is rotated in a second direction, cable (141) is pulled by winch (17) while cable (140) is released from winch (17). As will be described in greater detail below, these corresponding actions of cables (140, 141) may provide raising/deployment or lowering/retraction of posts (100, 101), depending on the direction in which winch (17) rotates.

In some versions, cables (140, 141) are simply opposing ends of a single, unitary cable. In other versions, cables (140, 141) are two separate cables that are coupled with the same winch (17). In some other versions, cables (140, 141) are two separate cables that are each coupled with their own corresponding winch (17), such that two winches (17) are provided. Of course, any other suitable number of cables (140, 141) and winches (17) may be used; and cables (140, 141) and winches (17) may have any other suitable relationships. Furthermore, any suitable alternative, substitute, or supplement for cables (140, 141) and/or winch (17) may be used.

1. Exemplary Deployment Components

As shown in FIG. 5, deployment cable (140) crosses a pulley (160) before reaching a clevis (142), which is fixedly secured to deployment cable (140). Pulley (160) is secured to one sidewall (20) of housing (4), which is opposite to the side that winch (17) is at, such that cable (140) crosses over the width of the interior housing (4) in its path from winch (17) to pulley (160). Pulley (160) rotates about a vertical axis, which intersects floor (40). After going around pulley (160), deployment cable (140) runs along sidewall (20) of housing, until cable (140) terminates at clevis (142). Of course, winch (17) may be positioned on the same sidewall (20) as pulley (160), if desired.

A pair of additional deployment cables (144, 146) are also secured to clevis (142), such that pulling on cable (140) is communicated to cables (144, 146) via clevis (142) to effect deployment of posts (100, 101). Similarly, pulling on cables (144, 146) is communicated to cable (140) via clevis (142) during retraction of posts (100, 101) as will be described in greater detail below. In the present example, clevis (142) will move in a first direction (to the right in the view of FIG. 5) when posts (100, 101) are raised; and in a second direction (to the left in the view of FIG. 5) when posts (100, 101) are lowered. Clevis (142) is positioned, and pulleys (160, 170) are sufficiently spaced apart from each other, such that clevis (142) does not engage or "ride on" either adjacent pulley (160, 170) during such movement of clevis (142) in either direction.

The following part of the description will describe deployment components that are employed to raise the deployment post (101) that would be at the left-hand side of FIG. 5. Such deployment of deployment post (101) is effected through deployment cable (144). In particular, after beginning at clevis (142), deployment cable (144) continues to run alongside sidewall (20) until it reaches pulley (164). Pulley (164) is mounted to sidewall (20), and rotates about a vertical axis that intersects floor (40). As shown in FIGS. 3-7, pulley (164) redirects deployment cable (144), in a direction laterally transverse to housing (4), to reach pulley (166).

Figure 7:
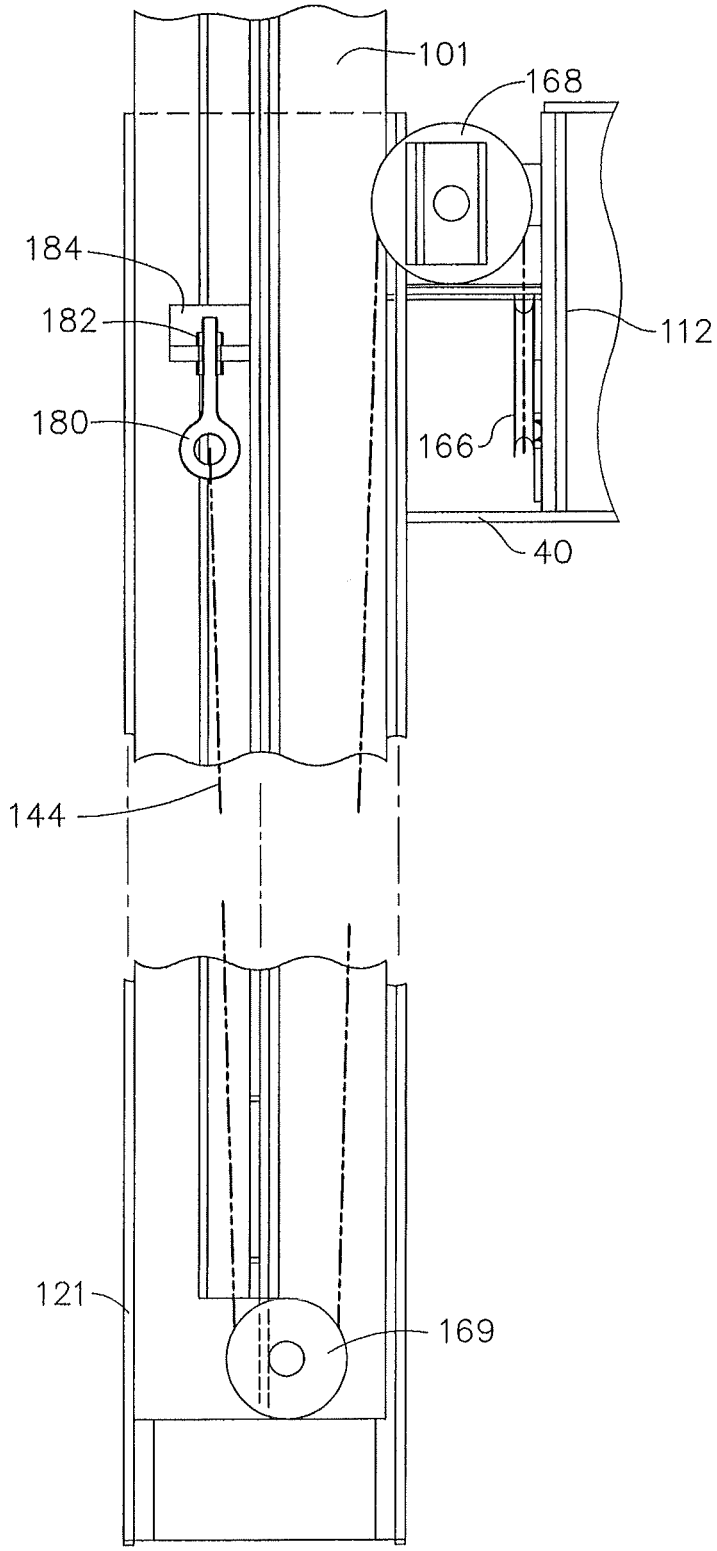
FIG. 7 is a partial side view of the cables and pulleys of FIG. 5, showing barrier deployment components.

Pulley (166) is mounted to a support post (112), and rotates about a horizontal axis that extends parallel to a longitudinal axis defined by housing (4). Pulley (166) redirects deployment cable (144) vertically upwardly to reach pulley (168), as shown in FIGS. 5-7. In particular, deployment cable (144) engages the lower side of pulley (166) then engages the top side of pulley (168).

Pulley (168) is mounted to post guide (121), and rotates about a horizontal axis that extends laterally transversely to a longitudinal axis defined by housing (4) (e.g., pulley (168) rotates about an axis that intersects both long sidewalls (20)). Pulley (168) redirects deployment cable (144) vertically downwardly toward the bottom of deployment post (101).

As shown in FIGS. 3-4 and 7, another pulley (169) that is located at the bottom of deployment post (101) redirects cable (144) upwardly to reach an eyelet of a eye bolt (180) as described in greater detail below. Pulley (169) is positioned about a horizontal axis that is parallel to the axis about which pulley (168) rotates. However, pulley (169) does not rotate in the present example, and instead merely redirects deployment cable (144) upwardly toward eye bolt (180) as described in greater detail below. It should be understood that a variety of alternative structures, features, or devices may be used in lieu of pulley (169), including but not limited to a pipe or other structure with a rounded edge. In the present example, the free end of deployment cable (144) is fixedly secured to eye bolt (180). Eye bolt (180) is secured to deployment post (101) by a bracket (184) in the present example, though it should be understood that eye bolt (180) may alternatively be secured to any other suitable structure in any other suitable location. By way of example only, eye bolt (180) may be secured to another structure and have some other position such that pulley (169) rotates and such that cable (144) acts as a "two-part line." It should be understood that the mechanical advantage of such a "two-part line" system may reduce the load on winch (17) in some versions.

It will therefore be understood that, with deployment post (101) starting at a vertically down position, retracted within post guide (121), deployment post (101) may be raised within post guide (121) by pulling from cable (144). Pulley (169) raises upwardly and unitarily with deployment post (101) in this example. It will also therefore be appreciated that deployment post (101) may be raised within post guide (121) by pulling on deployment cable (140), with such pulling being powered by winch (17) and communicated via pulley (160), clevis (142), cable (144), and pulleys (164, 166, 168, 169).

The following part of the description will describe deployment components that are employed to raise the deployment post (101) that would be at the right-hand side of FIG. 5. Such deployment of deployment post (101) is effected through deployment cable (146). In particular, and as noted above, deployment cable (146) is also fixedly secured to clevis (142). Deployment cable (146) continues to run alongside sidewall (20) until it reaches pulley (170). Pulley (170) is mounted to sidewall (20), and rotates about a vertical axis that intersects floor (40). Pulley (170) redirects deployment cable (146), by approximately 180°, to reach pulley (172).

Pulley (172) is mounted to sidewall (20), and rotates about a vertical axis that intersects floor (40). Like pulley (164) described above, pulley (172) redirects deployment cable (146), in a direction laterally transverse to housing (4), to reach pulley (174).

Pulley (174) is mounted to a support post (112), and rotates about a horizontal axis that extends parallel to a longitudinal axis defined by housing (4). Like pulley (166) described above, pulley (174) redirects deployment cable (146) vertically upwardly to reach pulley (176).

Pulley (176) is mounted to post guide (121), and rotates about a horizontal axis that extends laterally transversely to a longitudinal axis defined by housing (4) (e.g., an axis that intersects both long sidewalls (20)). Like pulley (168) described above, pulley (176) redirects deployment cable (146) vertically downwardly to reach the bottom of deployment post (101) (i.e., the deployment post (101) on the right-hand side in FIG. 5). In particular, the free end of deployment cable (146) is fixedly secured to the bottom of deployment post (101) in the present example. Alternatively, the bottom of deployment post (101) may include another pulley (not shown), like the bottom of deployment post (101) described above (i.e., the pulley (169) at the bottom of deployment post (101) on the left-hand side in FIG. 5 as shown in FIG. 7), redirecting deployment cable (146) to a eye bolt (180), etc. As noted above, while eye bolt (180) is secured to deployment post (101) in the present example, eye bolt (180) may alternatively be secured to any other suitable structure at any suitable location. By way of example only, the positioning of eye bolt (180) in relation to other components may cause cable (146) to become a "two-part line" as described above.

It will therefore be understood that, with deployment post (101) starting at a vertically down position, retracted within post guide (121), deployment post (101) may be raised within post guide (121) by vertically upward pulling from cable (146). It will also therefore be appreciated that deployment post (101) may be raised within post guide (121) by pulling on deployment cable (140), with such pulling being communicated via pulley (160), clevis (142), cable (146), and pulleys (170, 172, 174, 176).

In the present example, cables (144, 146) each have a length selected to provide simultaneous raising of both deployment posts (101) when deployment cable (140) is pulled by winch (17). Such length may be selectively adjustable in a variety of ways. By way of example only, a turnbuckle (not shown) may be provided between clevis (142) and any of cables (140, 144, 146) (or elsewhere) to adjust the effective length of such cable(s) (140, 144, 146). In addition or in the alternative, and as shown in FIGS. 3-4 and 7, an eye bolt (180) with a nut (182) secured thereto may be threadingly attached to a bracket (184) that is fixedly secured to post (101). In this example, the vertical position of eye bolt (180) relative to bracket (184) (and, hence, relative to post (101)) may be adjusted by rotating the nut (182) that is secured to eye bolt (180). In other words, when eye bolt (180) is rotated (via nut (182)) relative to bracket (184), the attachment point of cable (146) relative to post (101) tightens cable (144) by sliding the attachment point vertically relative to post (101). Eye bolt (180) may extend past the top of post guide (121) to allow adjustment by turning nut (182) from the top of barrier system (10). Alternatively, any other suitable structures, devices, or techniques may be used to adjust the effective length of cables (144, 146), such as to provide simultaneous raising of both deployment posts (101) when deployment cable (140) is pulled by winch (17).

In addition, as noted above, posts (100, 101) are all connected by both a set of horizontal members (200) (e.g., I-beams, etc.) and guardrails (202). With horizontal members (200) and guardrails (202) being substantially rigid, and with the connections between horizontal members (200) and posts (100, 101) (as well as the connections between guardrails (202) and posts (100, 101)) being substantially rigid, it will be appreciated that raising of posts (101) by cables (144, 146) in the present example will effect simultaneous raising of posts (100). In other words, the combination of posts (100, 101), horizontal members (200), and guardrails (202) may be raised or deployed collectively and simultaneously, merely by winch (17) pulling on cable (140). Tension may be maintained in cables (140, 144, 146) to keep posts (100, 101), horizontal members (200), and guardrails (202) in a raised or deployed position (e.g., by braking winch (17), etc.). Of course, there are a variety of other ways in which posts (100, 101), horizontal members (200), and/or guardrails (202) may be raised or otherwise deployed. One merely illustrative alternative is described in greater detail below (e.g., scissor arms (800, 802) assisting in raising of components, etc.), while others will be apparent to those of ordinary skill in the art in view of the teachings herein. Similarly, there are a variety of other ways in which posts (100, 101), horizontal members (200), and/or guardrails (202) may be kept in a raised position (e.g., without just relying on tension in cables (140, 144, 146), etc.). One merely illustrative alternative is described in greater detail below (e.g., scissor arms (800, 802) bearing weight of raised components, etc.), while others will be apparent to those of ordinary skill in the art in view of the teachings herein.

2. Exemplary Retraction Components

In some versions, a deployed combination of posts (100, 101), horizontal members (200), and guardrails (202) is retracted back into housing (4) by gravity. For instance, a brake on winch (17) may be released to relieve tension in cables (140, 144, 146), such that posts (100, 101) may simply fall back downwardly into their respective post guides (120, 121). As another merely illustrative alternative, winch (17) may be controllingly braked to slowly allow posts (100, 101) to fall back downwardly into their respective post guides (120, 121). In the present example, however, a deployed combination of posts (100, 101), horizontal members (200), and guardrails (202) is actively retracted back into housing (4).

As noted above, a retraction cable (141) extends from winch (17). As shown in FIG. 5, retraction cable (141) crosses a pulley (161) before reaching a clevis (143), which is fixedly secured to retraction cable (141). Pulley (161) is secured to one sidewall (20) of housing (4), which is opposite to the side that winch (17) is at, such that cable (141) crosses over the width of the interior housing (4) in its path from winch (17) to pulley (161). Pulley (161) rotates about a vertical axis, which intersects floor (40). After going around pulley (161), retraction cable (141) runs along sidewall (20) of housing, until cable (141) terminates at clevis (143). Of course, winch (17) may be positioned on the same sidewall (20) as pulley (161), if desired.

A pair of additional retraction cables (145, 147) are also secured to clevis (143), such that pulling on cable (141) is communicated to cables (145, 147) via clevis (142) to effect retraction of posts (100, 101). Similarly, pulling on cables (145, 147) is communicated to cable (141) via clevis (143) during deployment of posts (100, 101). In the present example, clevis (143) will move in a first direction (to the left in the view of FIG. 5) when posts (100, 101) are raised; and in a second direction (to the right in the view of FIG. 5) when posts (100, 101) are lowered. Clevis (143) is positioned, and pulleys (161, 171) are sufficiently spaced apart from each other, such that clevis (143) does not engage or "ride on" either adjacent pulley (161, 171) during such movement of clevis (143) in either direction.

The following part of the description will describe deployment components that are employed to lower the deployment post (101) that would be at the left-hand side of FIG. 5. Such retraction of deployment post (101) is effected through deployment cable (145). In particular, after beginning at clevis (143), deployment cable (145) continues to run alongside sidewall (20) until it reaches pulley (165). Pulley (165) is mounted to sidewall (22), and rotates about a vertical axis that intersects floor (40). As shown in FIGS. 5 and 8, pulley (165) redirects deployment cable (145), in a direction laterally transverse to housing (4), to reach pulley (167).

Pulley (167) is mounted to floor (40), and rotates about a horizontal axis that extends parallel to a longitudinal axis defined by housing (4). Pulley (167) redirects retraction cable (145) vertically upwardly to reach an eye-bolt (181). As shown in FIG. 8, eye-bolt (181) is secured to a bracket (185), which is secured to a horizontal member (200) that spans between post (101) and post (100). The vertical positioning of eye-bolt (181) relative to horizontal member (200) is adjustable, such as by rotating eye-bolt (181) and/or by rotating nuts engaged with eye-bolt (181). Such adjustment may be used to obtain optimum tension in cables (141, 145, 147). The end of retraction cable (145) is fixedly secured to eye-bolt (181), such that downward pulling on cable (145) will effect downward pulling on eye-bolt (181) and bracket (185), which will in turn effect downward pulling on horizontal member (200) and posts (100, 101). It will also therefore be appreciated that posts (100, 101) may be actively lowered within post guides (120, 121) by winch (17) pulling on retraction cable (141), with such pulling being communicated via pulley (161), clevis (143), cable (145), pulleys (165, 167), eye-bolt (181), and horizontal members (200).

The following part of the description will describe deployment components that are employed to lower the deployment post (101) that would be at the right-hand side of FIG. 5. Such retraction of deployment post (101) is effected through retraction cable (147). In particular, and as noted above, retraction cable (147) is also fixedly secured to clevis (143). Retraction cable (147) continues to run alongside sidewall (20) until it reaches pulley (171). Pulley (171) is mounted to sidewall (20), and rotates about a vertical axis that intersects floor (40). Pulley (171) redirects retraction cable (147), by approximately 180°, to reach pulley (173).

Pulley (173) is mounted to sidewall (20), and rotates about a vertical axis that intersects floor (40). Like pulley (165) described above, pulley (173) redirects retraction cable (147), in a direction laterally transverse to housing (4), to reach pulley (175).

Pulley (175) is mounted to floor (40), and rotates about a horizontal axis that extends parallel to a longitudinal axis defined by housing (4). Like pulley (167) described above, pulley (175) redirects retraction cable (145) vertically upwardly to reach an eye-bolt (not shown). Like eye-bolt (181), this eye-bolt is secured to a horizontal member (200) that spans between post (101) and post (100) (i.e., the posts (101, 100) at the right-hand side in the view of FIG. 5). The vertical positioning of this eye-bolt relative to horizontal member (200) is adjustable, such as by rotating the eye-bolt and/or by rotating nuts engaged with the eye-bolt. Such adjustment may be used to obtain optimum tension in cables (141, 147). The end of retraction cable (147) is fixedly secured to the eye-bolt, such that downward pulling on cable (147) will effect downward pulling on the eye-bolt, which will in turn effect downward pulling on horizontal member (200) and posts (100, 101). It will also therefore be appreciated that posts (100, 101) may be actively lowered within post guides (120, 121) by pulling on retraction cable (141), with such pulling being communicated via pulley (161), clevis (143), cable (147), pulleys (171, 173, 175), the eye-bolt, and horizontal members (200).

In the present example, cables (145, 147) each have a length selected to provide simultaneous lowering of both deployment posts (101) when deployment cable (141) is pulled by winch (17). It should be understood that the effective lengths of cables (145, 147) may be selectively adjustable using any of the components and techniques described above to provide selective adjustability of cables (144, 146); or using any other suitable structures, devices, or techniques. In addition, as noted above, posts (100, 101) are all connected by both a set of horizontal members (200) (e.g., I-beams, etc.) and guardrails (202). With horizontal members (200) and guardrails (202) being substantially rigid, and with the connections between horizontal members (200) and posts (100, 101) (as well as the connections between guardrails (202) and posts (100, 101)) being substantially rigid, it will be appreciated that lowering of posts (101) by cables (145, 147) in the present example will effect simultaneous lowering of posts (100). In other words, the combination of posts (100, 101), horizontal members (200), and guardrails (202) may be lowered or retracted collectively and simultaneously, merely by winch (17) pulling on cable (141). Of course, there are a variety of other ways in which posts (100, 101), horizontal members (200), and/or guardrails (202) may be lowered or otherwise retracted. One merely illustrative alternative is described in greater detail below, while others will be apparent to those of ordinary skill in the art in view of the teachings herein.

In some versions, one or more plates (not shown) may be provided in housing (4), to substantially cover at least some of the above described cables and/or pulleys, such as to protect such cables and/or pulleys from debris, etc. Of course, such plates are merely optional.

C. Exemplary Covers

Cover plates (5) are pivotally engaged relative to flanges (9) of housing (4), such that cover plates (5) may provide a selectively openable "lid" for barrier system (10). In particular, cover plates (5) are each mounted to a respective set of hinges (12), each of which is mounted to a corresponding flange (9). While each cover plate (5) has a plurality of associated hinges (12) in the present example, some versions may provide just a single hinge (e.g., a continuous hinge or piano hinge) for each cover plate (5). As shown in FIGS. 1 and 3, when cover plates (5) are down, cover plates (5) are configured to cover the opening defined by sidewalls (20) of housing (4). While a pair of pivoting cover plates (5) are shown, it will be appreciated that cover plate (5) may be varied or modified in a number of ways. For instance, a single hinged cover plate may be used. Furthermore, cover plates (5) may be modified to slide open, to swing downward into housing (4), or to open in any other suitable way. Other variations of cover plate (5) and methods of opening cover plate (5) will be apparent to those of ordinary skill in the art in view of the teachings herein.

Some versions may also include plates (not shown) on each side of hinges (12). Such plates may be configured to deflectingly force snow plow blades or the like to be raised above hinges (12), to avoid snow plow blades or the like getting snagged on hinges (12). For instance, such plates may wrap over at least part of the "knuckle" (e.g., the part that contains the hinge pin) of each hinge (12). As one merely illustrative alternative, each hinge (12) may be installed facing down such that the knuckles of hinges (12) are covered. To the extent that flanges (9) of housing (4) are exposed, such flanges (9) may include a beveled edge to also reduce the likelihood of snow plow blades or the like getting snagged on flanges (9). To the extent that tread plates or other components are positioned above flanges (9) and obscure flanges (9), such tread plates or other components may have such a beveled edge to also reduce the likelihood of snagging. In addition, cover plates (5) may each include a beveled edge to also reduce the likelihood of snow plow blades or the like getting snagged on cover plates (5). Of course, these features and configurations are merely optional, and may be varied, substituted, supplemented, or omitted as desired.

In the present example, and as shown in FIGS. 2-4, 6, and 8, each lifting post (101) includes cover opening plates (190) that are transversely coupled with extension (103) (e.g., via welding, etc.). Cover opening plates (190) are configured to raise cover plates (5) as posts (100, 101) are raised. Cover opening plates (190) also keep cover plates (5) in an open position as posts (100, 101) remain in a raised position. For instance, as posts (100, 101) begin to advance upwardly, cover opening plates (190) engage cover plates (5) and begin to urge them open. In the present example, cover opening plates (190) have a curved upper edge that reduces the likelihood of cover opening plates (190) getting snagged as cover opening plates (190) travel upwardly to open cover plates (5), though it should be understood that cover opening plates (190) may have any other suitable configuration. Cover plates (5) "ride" cover opening plates (190) as posts (100, 101) continue to advance upwardly to their fully deployed position. Cover opening plates (190) then hold cover plates (5) open as posts (100, 101) remain in their upwardly deployed position.

Cover opening plates (190) also allow cover plates (5) to close as posts (100, 101) are lowered into housing (4). In particular, as posts (100, 101) are lowered back down into housing (4), cover plates (5) "ride" cover opening plates (190). Cover plates (5) then reach a closed position as cover opening plates (190) retract fully into compartments (260) of housing (4). As noted above, cover plates (5) may be substantially flush with the ground when in the closed position as shown in FIGS. 1 and 3. For instance, regular vehicle traffic may drive over closed cover plates (5) with little or no disturbance. Closed cover plates (5) may therefore not present any type of ramp, "speed bump," or other disturbance to drivers in some versions. Of course, cover plates (5) may be differently configured to produce a ramp, speed bump, other disturbance to drivers, or in any other suitable fashion, as desired.

As shown in FIGS. 1 and 6, static guides (130) are spaced away from housing (4) to provide clearance for cover opening plates (190) to retract below the ground. In addition, and as shown in FIGS. 5-6, each end of housing (4) include a compartment (260) that is configured to provide clearance for cover opening plates (190) to retract below the ground. Compartments (260) also include slots (262), which provide clearance for extensions (103) like slots (7). While cover opening plates (190) are positioned at ends of barrier system (10) and external to housing (4) in this example, it should be understood that cover opening plates (190) may be positioned at any other suitable locations (e.g., within housing (4)).

Cover opening plates (190) of this example may have a width selected to provide a desired angular orientation of cover plates (5) when cover opening plates (190) hold cover plates (5) in an open position. For instance, where concrete barrier walls (e.g., "Jersey Barrier" walls, etc.) (not shown) are adjacently positioned at each end of barrier system (10), cover opening plates (190) may have a width selected to provide an angular orientation of opened cover plates (5) that matches, approximates, or is less than the angle defined by the bases of the adjacent barrier walls. In some instances, such angles may keep the wheel of a vehicle that strikes barrier system (10) turned into barrier system (10) or adjacent walls. Furthermore, having the angles defined by opened cover plates (5) matching, approximating, or being less than the angle defined by the bases of adjacent concrete walls may reduce if not eliminate the likelihood of a vehicle's wheel being snagged by opened cover plates (5) as the vehicle drives closely alongside the length of barrier system (10).

In the present example, and as shown in FIG. 6, a pair of pins (270) are secured to each cover opening plate (190), such that pins (270) will be raised and lowered unitarily with cover opening plates (190) and lifting posts (101). Pins (270) each extend along an axis that is parallel to the longitudinal axis defined by housing (4). As shown in FIGS. 4 and 8, an eye bolt (272) is secured to each end of each cover plate (5). An additional member (not shown) couples each pin (270) with a corresponding eye bolt (272). Such an additional member may comprise a cable, a chain, a rod and/or linkage, etc. Together, these components may restrict the degree to which cover plates (5) open, while still permitting cover plates (50) to open to the rotational position shown in FIG. 4. In other words, pins (270), eye bolts (272), and whatever components are used to couple pins (270) and corresponding eye bolts (272) may substantially prevent cover plates (5) from falling over or otherwise opening "too far" when lifting posts (101) are raised to the extended position. For instance, a limiting chain, cable rod, and/or linkage may be configured to prevent cover plates (5) from opening to an angle greater than about 180° relative to sidewalls (20) of housing (4). In addition, pins (270), eye bolts (272), and whatever components are used to couple pins (270) and corresponding eye bolts (272) may assist in closing cover plates (5) when lifting posts (101) are lowered from an extended position to a retracted position. That is, pins (270), eye bolts (272), and whatever components are used to couple pins (270) and corresponding eye bolts (272) may pull cover plates (5) closed when lifting posts (101) are lowered.

Of course, there are a variety of other structures, components, and techniques that may be employed to provide opening and/or closing of cover plates (5), in addition to or in lieu of those described above. By way of example only, lift assist springs (not shown) may be provided to assist in opening of cover plates (5). Similarly, a spring or other resilient member may bias cover plates (5) to a closed position. It should also be understood that, in versions where at least one limiting chain, cable rod, and/or linkage is used to restrict the degree to which cover plates (5) may be opened, completely separate chain(s), cable(s), rod(s), and/or linkage(s) may be used to assist in closing cover plates (5). For instance, components that assist in closing cover plates (5) may be secured to cover opening plates (190); while components that restrict the degree to which cover plates (5) may be opened may be secured to housing (4). In some other versions, cover opening plates (190) are omitted, and each post (101) includes a set of plates, rollers, and arms that are configured to urge and hold cover plates (5) open when posts (100, 101) are raised. Examples of such sets of plates, rollers, and arms are disclosed in U.S. Provisional Patent Application Ser. No. 61/143,466, filed Jan. 9, 2009, entitled "Vertically Actuated Vehicle Barrier System," the disclosure of which is incorporated by reference herein. Still other suitable structures, components, and techniques for opening, holding open, and/or closing cover plates (5) will be apparent to those of ordinary skill in the art in view of the teachings herein.

As yet another merely illustrative variation, barrier system (10) includes an integral cover plate (not shown) that is not hinged. For instance, an integral cover plate may span across the tops of posts (100, 101), and may have a width that is configured to overlay at least a portion of flanges (9) on both sides of housing (4). Thus, such an integral cover plate may fully cover or substantially cover the entire top opening defined by housing (4) when posts (100, 101) are in a retracted/undeployed position Like closed cover plates (5), such a "closed" integral cover plate may also be substantially flush with the ground when posts (100, 101) are in a retracted/undeployed position. Such an integral cover plate may also raise unitarily with posts (100, 101) as posts (100, 101) are raised to the deployed position. In some versions where an integral cover plate is used in lieu of cover plates (5), cover opening plates (190) and compartments (260) are also omitted. Still various other suitable ways in which the top opening defined by housing (4) may be fully covered or substantially covered will be apparent to those of ordinary skill in the art in view of the teachings herein. Of course, some versions of barrier system (10) may provide cover that is less than substantial, or no cover at all, over the top opening defined by housing (4).

D. Exemplary Control

Control of barrier system (10) may be provided in a variety of ways. In some versions, control is provided locally. For instance, a switchbox or other device may be located proximate to barrier system (10) to permit selective activation of winch (17). Such a switchbox may include any of a variety of security features, including but not limited to keyed control, a card reader, a keypad for entry of a code, a biometrics reader, or any other suitable security feature. Barrier system (10) may also be triggered by an in-road sensor or other device. Furthermore, barrier system (10) may be capable of manual operation, such as in the case of a power loss or under other circumstances.

In some versions, control is provided remotely. For instance, in some versions, winch (17) is in communication with a small portable remote control device, similar to a conventional garage door opener controller. In particular, a receiver (not shown) may be coupled with winch (17), and may be configured to receive commands from a remote control device, and translate such commands into corresponding operation of winch (17) to deploy or retract posts (100, 101) and guardrails (202). Such communication may be encrypted using a rolling code or any other suitable techniques, such that the receiver only responds to a particular remote control device or particular group of remote control devices. By way of example only, suitable personnel such as firefighters, ambulance drivers, highway patrol, etc., may be provided with such remote control devices. Alternatively, to the extent that a building is wholly or partially surrounded by a barrier system (10), a building manager, building security, or other personnel may be provided with such a remote control device. Still other suitable personnel and other ways in which a portable remote control device may be used with barrier system (10) will be apparent to those of ordinary skill in the art in view of the teachings herein.

As another merely illustrative example of remote control, winch (17) may be in communication with a network, such that a user may selectively activate winch (17) from a remote location, via wire or wirelessly. Such a network may be a dedicated closed network, the Internet, or any other communication structure. It will be appreciated that any of the security features noted above with respect to local control of barrier system (10) may also be implemented for remote control of barrier system (10). It will also be appreciated that one barrier system (10) may be in communication with one or more other barrier systems (10). For instance, one barrier system (10) may act as a "master" system, such that other barrier systems (10) will automatically deploy or retract in response to deployment or retraction of the "master" system. Alternatively, one barrier system (10) may act as a relay for data or commands to and/or from other barrier systems (10). To the extent that a barrier system (10) is in communication with some type of network, operational data may be communicated to a remote location via the network. For instance, the charge left in battery (43), the operability of winch (17), the presence of water or debris in housing (4), the striking of posts (100, 101) and/or guardrails (202) by a vehicle, or any other type of data may be communicated via a network.

Barrier system (10) may also include safety or warning features such as lights or horns when barrier system (10) is activated. For instance, one or more limit switches may be used to stop winch (17) when posts (100, 101) have reached a fully raised/deployed and/or a fully lowered/retracted position. By way of example only, such limit switches may comprise at least one metal tab or other structure mounted to at least one post (100, 101) that provides contact with another switch position when posts (100, 101) have reached a fully raised/deployed and/or a fully lowered/retracted position. Alternatively, limit switches may take any other suitable form, to the extent that limit switches are even used. In addition, barrier system (10) may include a kill switch to prevent deployment of barrier system (10) when a person or obstacle is detected in the path of barrier system (10); and/or when there is a limit switch failure. Suitable components and arrangements for providing such sensor and kill switch systems will be apparent to those of ordinary skill in the art in view of the teachings herein. Still other ways in which barrier system (10) may be controlled or monitored will be apparent to those of ordinary skill in the art in view of the teachings herein. Similarly, various other suitable components, features, configurations, operabilities, and uses of barrier system (10) will be apparent to those of ordinary skill in the art in view of the teachings herein. By way of example only, a substitute or supplement for guardrails (202) may include chains, cables, rods, bars, rails, ropes, netting, plates, or any other suitable structures, including combinations of such structures, and including any suitable material or combination of materials.

II. Exemplary Vehicle Barrier with Chains

A. Overview

FIGS. 11-17 show an exemplary alternative vehicle barrier system (300) that includes chains (302, 304) and that is selectively retractable into the ground. Barrier system (300) comprises a housing (310) that is embedded within reinforced concrete (3). A pair of vertical posts (320) are operable to reciprocate relative to housing (310). While just two vertical posts (320) are provided in the present example, it should be understood that any other suitable number of vertical posts (320) may be used in any suitable arrangement. Posts (320) of the present example comprise steel I-beams in the present example, though it should be understood that posts (320) may alternatively be formed of any other suitable material(s) and may have any other suitable cross sectional form(s). As will also be described in greater detail below, barrier system (300) is operable to selectively raise and lower posts (320) relative to housing (310). For instance, posts (320) may be raised such that the lowermost horizontal chain (302) is at a height of anywhere between approximately 27 inches and approximately 36 inches (e.g., relative to the ground and/or relative to concrete (3), etc.), or at any other suitable height. Furthermore, a horizontal member (305) is configured to substantially close posts (320) and chains (302, 304) within housing (310) when posts (320) and chains (302, 304) are retracted downward.

Figure 11:
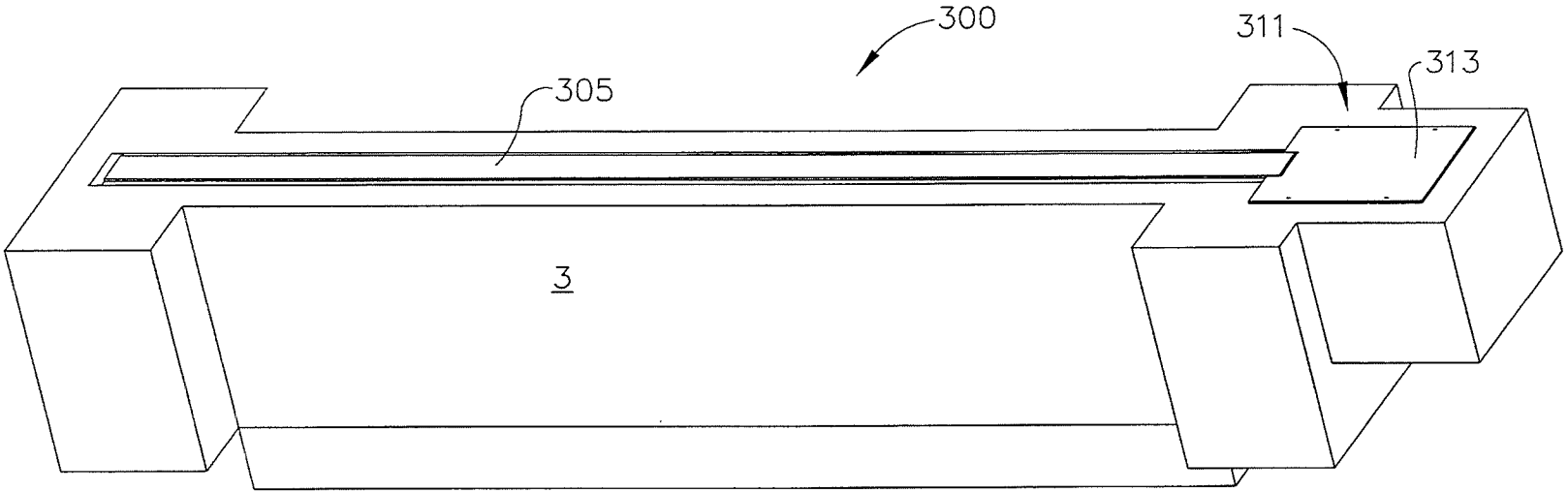
FIG. 11 is a perspective view of an exemplary alternative vehicle barrier system in an undeployed position.
Figure 12:
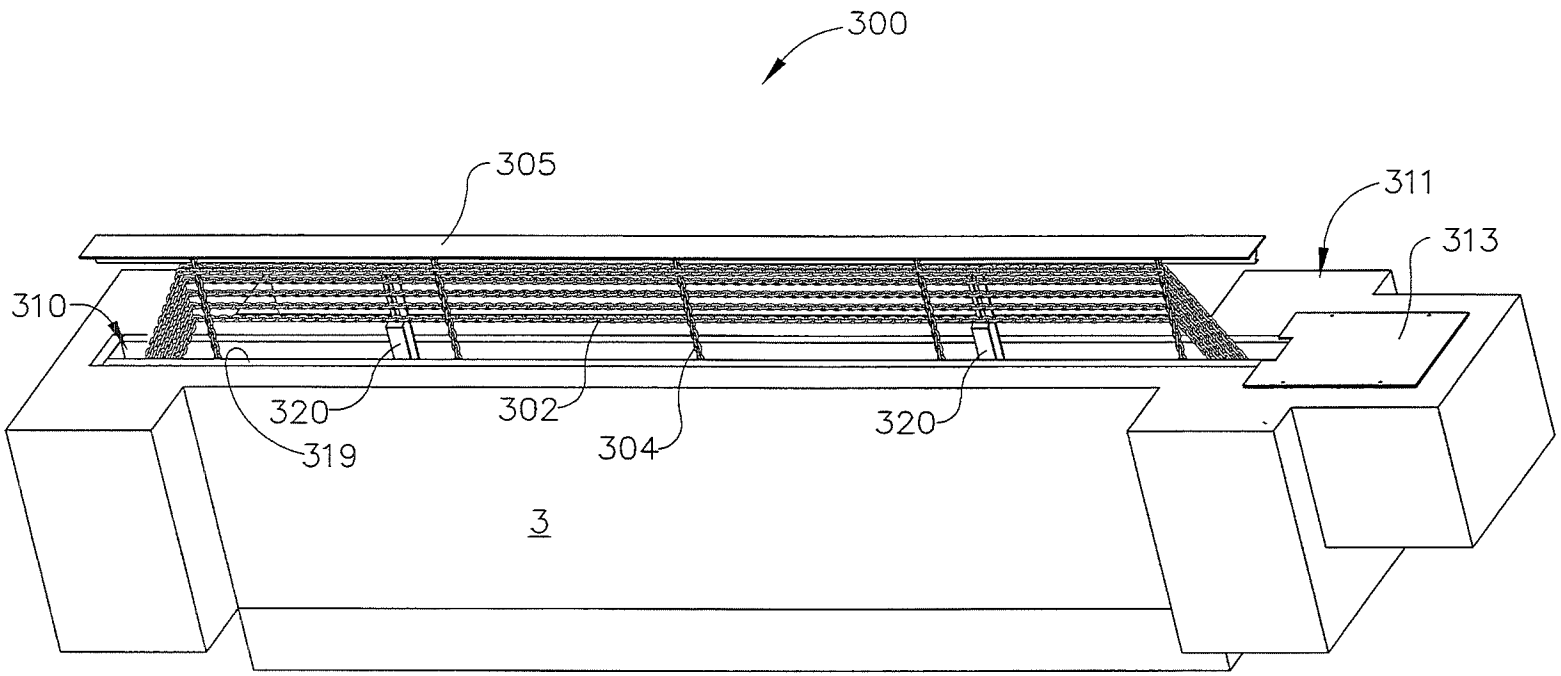
FIG. 12 is a perspective view of the system of FIG. 11 in a deployed position.

FIG. 11 shows posts (320) and chains (302, 304) in a retracted or undeployed configuration. In this configuration, posts (320) and chains (302, 304) are completely recessed below ground level, and the top portion of horizontal member (305) is substantially flush with the ground level. FIGS. 12-16 show posts (320) and chains (302, 304) in a deployed configuration. In this configuration, posts (320) and chains (302, 304) are positioned above ground level, and are configured to provide a barrier against passage of vehicles and the like. Barrier system (300) may therefore be provided within a road, median, sidewalk, or elsewhere to selectively prevent passage of vehicles and the like. Various suitable locations and ways in which barrier system (300) may be positioned and used will be described in greater detail below, while other suitable locations and ways in which barrier system (300) may be positioned and used will be apparent to those of ordinary skill in the art in view of the teachings herein.

In some versions, barrier system (300) may stop a vehicle that is traveling at a high rate of speed, even if the driver of the vehicle is intent on passing through the barrier provided by barrier system (300). For instance, posts (320) and chains (302, 304) may be sufficiently anchored such that they provide little or no "give" when struck by a vehicle. By way of example only, some versions of barrier system (300) may meet a Department of State "K" certification requiring that the front line of cargo of a 15,000 pound vehicle traveling 50 mph must not go further than 1 meter past the line defined by barrier system (300). In addition or in the alternative, some versions of barrier system (10) may satisfy the American Association of State Highway and Transportation Officials (AASHTO) Manual for Assessing Safety Hardware (MASH) criteria. In some instances with some versions of barrier system (300), posts (320) and/or chains (302, 304) may essentially destroy a vehicle that strikes posts (320) and/or chains (302, 304), with relatively little damage being done to barrier system (300). For instance, barrier system (300) may be constructed such that no portions of barrier system (300) are released as projectiles when barrier system (300) is struck by a heavy vehicle moving at a high rate of speed. In some versions, as described in greater detail below, vertical chains (304) are coupled with housing (310) by shear joints, such that vertical chains (304) may break away from housing (310) to some degree. Nevertheless, horizontal chains (302) and/or posts (320) may still destroy or at least stop an impacting vehicle in some such versions, without barrier system (300) providing elastic "give."

Housing (310) of the present example comprises sidewalls (312) and a floor (314). In addition, as shown in FIG. 11, a compartment (311) is provided at an end of housing (310). A cover plate (313) is secured over the top of compartment (311). In some versions, compartment (311) contains some if not all of the same components contained in compartment (11) as described above. Various suitable ways in which such components may be incorporated into barrier system (300) of this example will be apparent to those of ordinary skill in the art in view of the teachings herein. Similarly, various other types of components that could be provided in compartment (311) or otherwise be incorporated into barrier system (300) will be apparent to those of ordinary skill in the art in view of the teachings herein. Of course, compartment (311) need not be located at an end of housing (310), and could be located at any other suitable position, including but not limited to along a side of housing (310) or within housing (310).

Figure 13:
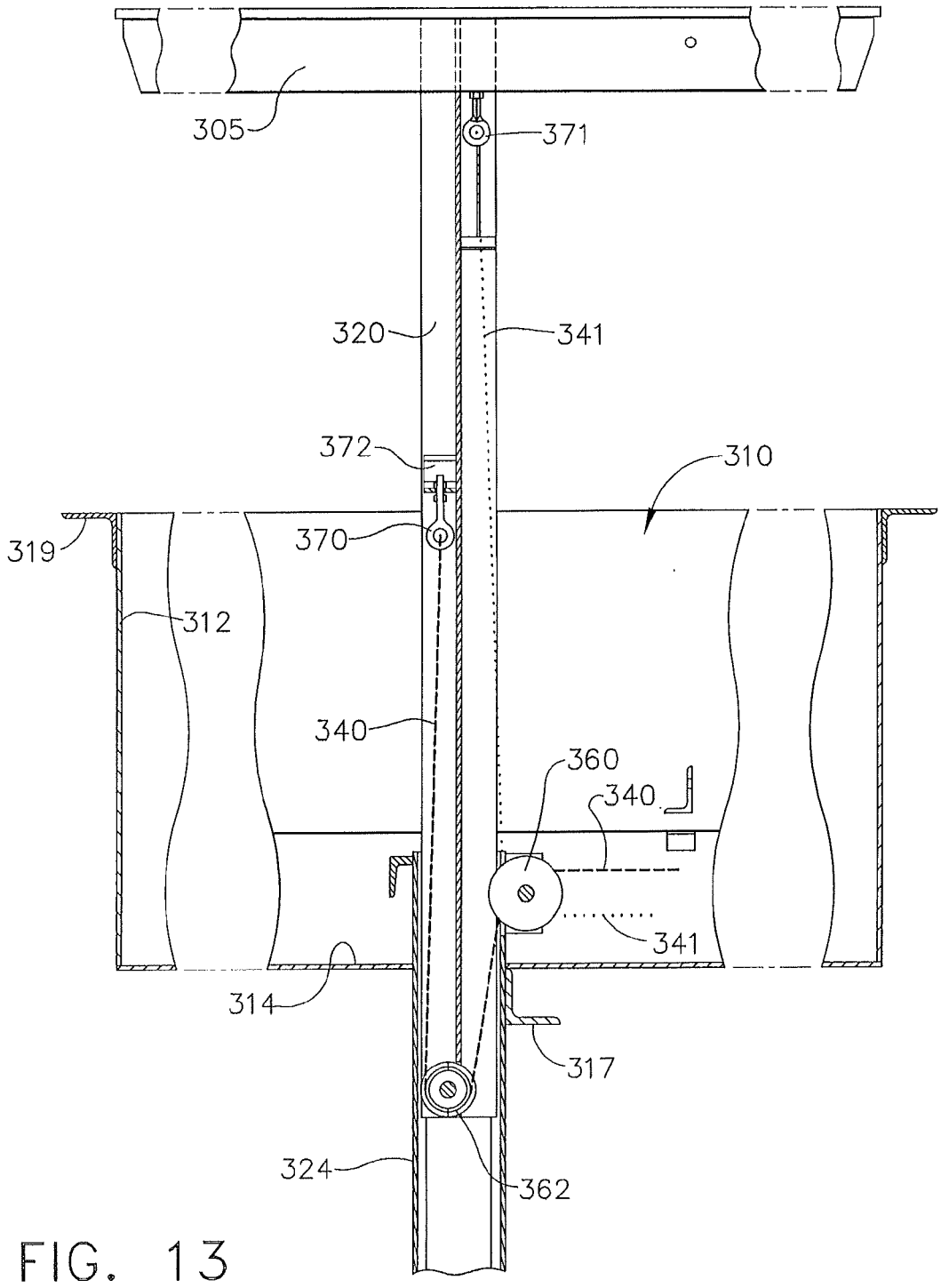
FIG. 13 is an partial, side cross-sectional view of the system of FIG. 11 in a deployed position.

As shown in FIG. 13, housing (310) may be provided with various structures and features for reinforcement. For instance, a flange (319) extends outwardly from the top of the outside surface of each sidewall (312) in the present example, such that flanges (319) extend substantially along the length of each sidewall (312). Flanges (319) may be anchored within reinforced concrete (3) by a plurality of J-bolts (not shown), though any other suitable anchoring structures or techniques may be used. Flanges (319) may be integrally formed with sidewalls (312). Alternatively, flanges (319) may comprise separate components (e.g., "structural angles," etc.) that are joined to sidewalls (312). In addition, a horizontal stiffener member (not shown) may be secured at the middle of the outside surface of each sidewall (312), such that horizontal stiffener members extend substantially along the length of each sidewall (312). Housing (310) may also be provided with any of the types of reinforcement structures described above with respect to housing (4). Alternatively, housing (310) may have any other suitable type of reinforcement; or may even lack reinforcement features and structures if desired. As with other components described herein, each of these components may be substituted, supplemented, relocated, or omitted in any suitable fashion as desired.

A horizontal member (305) spans across the tops of posts (320); and will raise and lower unitarily with posts (320). While just a single horizontal member (305) is used in the present example, it should be understood that more than one horizontal member (305) may be used. For instance, two or more horizontal member (305) may be placed adjacent to each other at a substantially common vertical height relative to posts (320). In addition or in the alternative, two or more horizontal members (305) may be placed at different vertical heights relative to posts (320). While horizontal member (305) comprises a rigid steel "T-rail" in the present example, horizontal member (305) may take a variety of alternative forms. By way of example only, in some versions horizontal member (305) comprises a horizontal chain (302) that is in tension, with vertical chains (304) being hung from horizontal chain (302). In some such versions, it may be desirable to add additional reciprocating posts (e.g., more than just posts (320) shown in FIG. 12) to support a horizontal member (305) that is formed by a top horizontal chain (302). Such additional reciprocating posts may be "active" like posts (320) or may be "passive" like posts (100) of barrier system (10). In addition or in the alternative, posts (320) may be moved outwardly to a desired gate width and a cable or chain version of horizontal member (305) may be stretched across the top of posts (320) with sufficient tension to support the attachment of vertical chains (304) and horizontal chains (302). As yet another merely illustrative example, horizontal member (305) may comprise a horizontal cable in tension rather than a rigid "T-rail" or chain in tension. In some versions where horizontal member (305) is provided by a chain or cable, one or more posts (320) may extend at a slightly outward angle relative to each other (e.g., rather than extending in a purely vertical direction), such that posts (320) "stretch" such a top chain or cable or otherwise increase tension in such a top chain or cable as posts (320) reach a fully extended position. Still other suitable forms that horizontal member (305) may take and various ways in which such alternative forms of horizontal member (305) may be integrated into barrier system (300) will be apparent to those of ordinary skill in the art in view of the teachings herein. It should also be understood that posts (320) (or portions thereof) may be configured to "break away" from other components of barrier system (300) upon sufficient impact by a vehicle, such as to prevent or reduce snagging.

Horizontal member (305) of the present example is configured to cover the opening defined by sidewalls (312) of housing (310). In particular, horizontal member (305) may be substantially flush with the ground when posts (320) are in the lowered/undeployed position as shown in FIG. 11. For instance, regular vehicle traffic may drive over lowered horizontal member (305) with little or no disturbance. Lowered horizontal member (305) may therefore not present any type of ramp, "speed bump," or other disturbance to drivers in some versions. Of course, horizontal member (305) may be differently configured to produce a ramp, speed bump, other disturbance to drivers, or in any other suitable fashion, as desired. It should also be understood that barrier system (300) may include one or more hinged cover plates (5) (e.g., like barrier system (10) described above, etc.). By way of example only, it may be desirable to add one or more hinged cover plates (5) in some versions where horizontal member (305) is provided by a horizontal chain (302) in tension rather than a rigid "T-rail." In some such versions, posts (320) may be provided with an analog to cover opening plate (190) described above, in order to assist with the opening and closing of the one or more cover plates (5).

It should be understood that using a chain or cable for horizontal member (305) may permit the opening defined by the top of housing (310) to have a relatively slimmer size. In some versions where a chain or cable is used for horizontal member (305,) the opening defined by the top of housing (310) is slim enough that a cover plate (5) is not needed in order to permit vehicles to safely drive over the top of housing (310) when barrier system is in a retracted configuration. In other words, the opening defined by the top of housing (310) may be configured to permit vehicles to safely drive over the top of housing (310) even in the absence of any cover plates. To the extent that flanges (319) of housing (310) are exposed, such flanges (319) may include a beveled edge to also reduce the likelihood of snow plow blades or the like getting snagged on flanges (319). To the extent that tread plates or other components are positioned above flanges (319) and obscure flanges (319), such tread plates or other components may have such a beveled edge to also reduce the likelihood of snagging. In addition, in versions where horizontal member (305) comprises a rigid "T-rail," such a "T-rail" may also have beveled edges to reduce the likelihood of snow plow blades or the like getting snagged on horizontal member (305). Likewise, to the extent that cover plates (5) are provided as part of barrier system (300), such cover plates (5) may each include a beveled edge to also reduce the likelihood of snow plow blades or the like getting snagged on cover plates (5). Of course, these features and configurations are merely optional, and may be varied, substituted, supplemented, or omitted as desired.

B. Exemplary Deployment and Retraction System

Barrier system (300) of the present example is raised and lowered in a manner similar to the manner in which barrier system (10) described above is raised and lowered. A pair of post guides (324) extend upwardly from floor (314) of housing (310). Post guides (324) may comprise steel tubes having a square cross section. Alternatively, post guides (324) may be formed of any other suitable material(s) and may have any other suitable cross section. Post guides (120) may be laterally supported by support posts (not shown) (e.g., I-beams, etc.), which may be secured to floor (314) of housing (310). In addition, and as shown in FIG. 13, a structural angle (317) is joined to post guides (324), beneath housing (310), providing further reinforcement to post guides (324). Of course, structural angle (317) is merely optional like other components described herein. Optionally, post guides (324) may include "I-beams" or other suitable structures secured within their interior for reinforcement. Post guides (324) are configured to receive posts (320). In particular, posts (320) are inserted in post guides (324). Post guides (324) are configured to restrict lateral movement of posts (320), while permitting posts (320) to move vertically (e.g., reciprocate) within post guides (324).

Post guides (324) may have a height that is greater than the height of sidewalls (312), though post guides (324) do not extend above sidewalls (312) in this example. For instance, while the upper rims of post guides (324) may be positioned below the upper rims of sidewalls (312), the lower portions of post guides (3234) may extend below floor (314) of housing (310). In particular, the lower portions of post guides (324) may be embedded in concrete (3) or in the ground, below floor (314). Alternatively, post guides (324) may have any other desired length and position relative to housing (310). In addition, the lower end of each post guide (324) may communicate with a drainage system, like post guides (120, 121) described above. Of course, a variety of other types of drainage systems may be provided; or barrier system (300) may even lack a drainage system.

Figure 14:
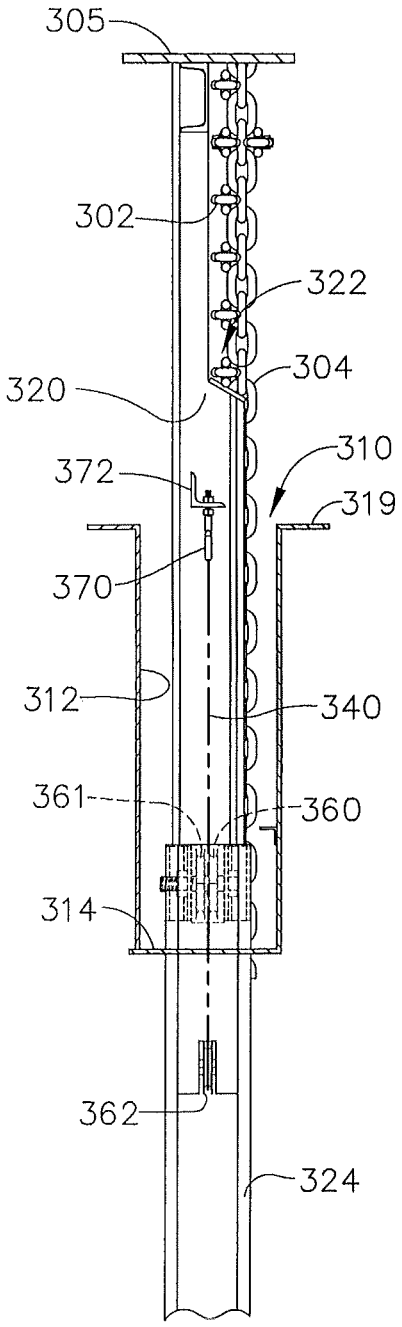
FIG. 14 is a cross-sectional view of a lifting post of the system of FIG. 11, showing lifting components, viewed from a first end of the system toward a second end of the system.
Figure 15:
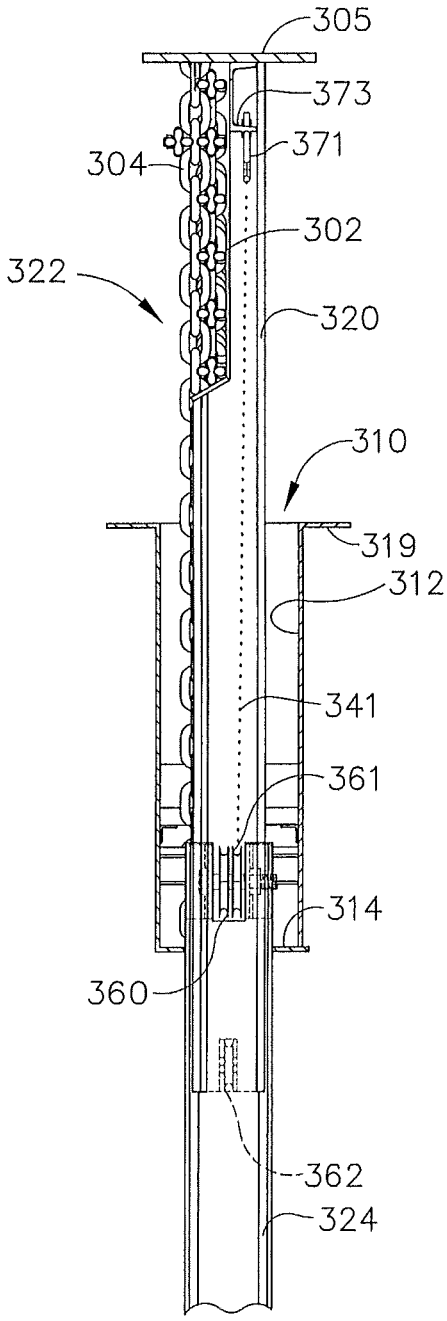
FIG. 15 is a cross-sectional view of a lifting post of the system of FIG. 11, showing lowering components, viewed from the second end of the system toward the first end of the system.

Like barrier system (10) described above, barrier system (300) may include a winch (not shown). Such a winch may be secured to, within, or external to housing (310) (e.g., in the ground); and may receive power from a source in compartment (311) or elsewhere. The winch in the present example is in communication with cables (340, 341), which are shown in FIGS. 13-15. In particular, deployment cable (340) extends from the top of the drum of the winch; while retraction cable (341) extends from the bottom of the drum of the winch. Cables (340, 341) and the winch are configured such that, when the winch is rotated in a first direction, cable (340) is pulled by the winch while cable (341) is released from the winch. Likewise, when the winch is rotated in a second direction, cable (341) is pulled by the winch while cable (340) is released from the winch. As will be described in greater detail below, these corresponding actions of cables (340, 341) may provide raising/deployment or lowering/retraction of posts (320), depending on the direction in which the winch rotates.

In some versions, cables (340, 341) are simply opposing ends of a single, unitary cable. In other versions, cables (340, 341) are two separate cables that are coupled with the same winch. In some other versions, cables (340, 341) are two separate cables that are each coupled with their own corresponding winch, such that two winches are provided. Of course, any other suitable number of cables (340, 341) and winches may be used; and cables (340, 341) and winches may have any other suitable relationships. Furthermore, any suitable alternative, substitute, or supplement for cables (340, 341) and/or winch may be used.

While FIGS. 13-14 show deployment and retraction components for just one post (320), it should be understood that the other post (320) may be deployed and retracted in a similar fashion. For instance, cables (340, 341) may each be coupled with one or more respective devises (or other components), and additional cables may be coupled with such devises (or other components) to provide simultaneous movement of several cables. Such additional cables may be fed around additional pulleys in a manner similar to that described above with respect to barrier system (10). Various ways in which the following teachings of deployment and retraction components may be applied to both posts (320) simultaneously will be apparent to those of ordinary skill in the art in view of the teachings herein.

As shown in FIGS. 14-15, a pair of pulleys (360, 361) are positioned adjacent to each other at the top of post guide (324). For instance, a bolt may pass through both pulleys (360, 361) and secure both pulleys (360, 361) to post guide (324). The same bolt may provide an axis of rotation for both pulleys (360, 361). In particular, the axis of rotation for both pulleys (360, 361) is a horizontal axis that extends laterally transversely to the longitudinal axis defined by housing (310) in the present example (e.g., pulleys (360, 361) each rotate about an axis that intersects both long sidewalls (312)).

As shown in FIG. 13, deployment cable (340) extends from the winch to reach pulley (360). Of course, deployment cable (340) may first encounter one or more additional pulleys after the winch, before reaching pulley (360). Deployment cable (340) goes over and around the top portion of pulley (360), and pulley (360) redirects deployment cable (340) downward to reach pulley (362). As shown in FIGS. 13-14, pulley (362) is mounted to the bottom of post (320), and redirects deployment cable (340) upwardly to reach an eyelet of an eye bolt (370) as described in greater detail below. Pulley (362) is positioned about a horizontal axis that is parallel to the axis about which pulley (360) rotates. However, pulley (362) does not rotate in the present example, and instead merely redirects deployment cable (340) upwardly toward eye bolt (370) as described in greater detail below. It should be understood that a variety of alternative structures, features, or devices may be used in lieu of pulley (362), including but not limited to a pipe or other structure with a rounded edge. In the present example, the free end of deployment cable (340) is fixedly secured to eye bolt (370). Eye bolt (370) is secured to deployment post (320) by a bracket (372) in the present example, though it should be understood that eye bolt (370) may alternatively be secured to any other suitable structure in any other suitable location. By way of example only, eye bolt (370) may be secured to another structure and have some other position such that pulley (362) rotates and such that cable (340) acts as a "two-part line." It should be understood that the mechanical advantage of such a "two-part line" system may reduce the load on the winch in some versions.

It will therefore be understood that, with post (320) starting at a vertically down position, retracted within post guide (324), post (320) may be raised within post guide (324) by pulling from cable (340). Pulley (362) raises upwardly and unitarily with post (320) in this example. It will also therefore be appreciated that deployment post (320) may be raised within post guide (324) by pulling on deployment cable (340), with such pulling being powered by a winch (not shown) and communicated via pulleys (360, 362).

As noted above, deployment cable terminates at eye bolt (370), which is secured to post (320) via a bracket (372). As with eye bolt (180) described above with respect to barrier system (10), eye bolt (370) of barrier system (300) may be used to adjust the effective length of cable (340), such as to provide suitable simultaneous raising of both posts (320) when deployment cable (340) is pulled by the winch. Of course, a variety of alternative components, devices, or techniques may be used to adjust the effective length of one or more cables, including but not limited to one or more turnbuckles. As also noted above, while eye bolt (370) is secured to deployment post (320) in the present example, eye bolt (370) may alternatively be secured to any other suitable structure at any suitable location. By way of example only, the positioning of eye bolt (370) in relation to other components may cause cable (340) to become a "two-part line" as described above.

In addition, as noted above, posts (320) are connected by horizontal member (305). With posts (320) and horizontal member (305) all being substantially rigid (e.g., steel I-beams, etc.), and with the connections between posts (320) and horizontal member (305) being substantially rigid (e.g., welds, bolts, rivets, etc.), it will be appreciated that raising of posts (320) by cable (340) (and perhaps other cables) in the present example will effect simultaneous raising of horizontal member (305). In addition, with chains (302, 304) being secured to or secured relative to horizontal member (305) as described in greater detail below, raising of posts (320) will also effect simultaneous raising of chains (302, 304).

In other words, the combination of posts (320), horizontal member (305), and chains (302, 304) may be raised or deployed collectively and simultaneously, merely by a winch pulling on cable (340) (and perhaps other cables). Tension may be maintained in cables (340) (and perhaps other cables)

to keep posts (320), horizontal member (305), and chains (302, 304) in a raised or deployed position (e.g., by braking the winch, etc.). Of course, there are a variety of other ways in which posts (320), horizontal member (305), and/or chains (302, 304) may be raised or otherwise deployed. One merely illustrative alternative is described in greater detail below (e.g., scissor arms (800, 802) assisting in raising of components, etc.), while others will be apparent to those of ordinary skill in the art in view of the teachings herein. Similarly, there are a variety of other ways in which posts (320), horizontal member (305), and chains (302, 304) may be kept in a raised position (e.g., without just relying on tension in cables, etc.). One merely illustrative alternative is described in greater detail below (e.g., scissor arms (800, 802) bearing weight of raised components, etc.), while others will be apparent to those of ordinary skill in the art in view of the teachings herein.

In some versions, a deployed combination of posts (320), horizontal members (305), and chains (302, 304) is retracted back into housing (310) by gravity. For instance, a brake on the winch may be released to relieve tension in cable (340) (and perhaps other cables), such that posts (320) may simply fall back downwardly into their respective post guides (324). As another merely illustrative alternative, the winch may be controllingly braked to slowly allow posts (320) to fall back downwardly into their respective post guides (324). In the present example, however, a deployed combination of posts (320), horizontal members (305), and chains (302, 304) is actively retracted back into housing (310).

As noted above, a retraction cable (341) extends from the winch. As shown in FIGS. 13 and 15, retraction cable (341) extends from the winch to reach pulley (361). Of course, retraction cable (341) may first encounter one or more additional pulleys after the winch, before reaching pulley (361). Retraction cable (341) goes under and around the bottom portion of pulley (361), and pulley (361) redirects retraction cable (341) upward to reach an eyelet of eye bolt (371). Eye bolt (371) is secured to a bracket (373), which is secured to horizontal member (305). The vertical positioning of eye-bolt (371) relative to horizontal member (305) is adjustable, like adjustable eye-bolt (181) of barrier system (10) described above. Such adjustment may be used to obtain optimum tension in cable (341) (and perhaps other cables) and/or to provide a desired effective length of cable (341) (and perhaps other cables). The end of retraction cable (341) is fixedly secured to eye-bolt (371), such that downward pulling on cable (341) will effect downward pulling on eye-bolt (371) and bracket (373), which will in turn effect downward pulling on horizontal member (305) and posts (320). It will also therefore be appreciated that posts (320) may be actively lowered within post guides (324) by the winch pulling on retraction cable (341), with such pulling being communicated via pulley (361), eye-bolt (371), and horizontal member (305). Furthermore, it will be appreciated that the combination of posts (320), horizontal member (305), and chains (302, 304) may be lowered or retracted collectively and simultaneously, merely by the winch pulling on cable (341) (and perhaps other cables). Of course, there are a variety of other ways in which posts (320), horizontal member (305), and/or chains (302, 304) may be lowered or otherwise retracted. One merely illustrative alternative is described in greater detail below, while others will be apparent to those of ordinary skill in the art in view of the teachings herein.

In some versions, one or more plates (not shown) may be provided in housing (310), to substantially cover at least some of the above described cables and/or pulleys, such as to protect such cables and/or pulleys from debris, etc. Of course, such plates are merely optional.

C. Exemplary Chain Configurations

Chains (302, 304) of the present example include a plurality of horizontal chains (302) and a plurality of vertical chains (304). Each vertical chain (402) has a top end coupled with horizontal member (305) in the present example. By way of example only, vertical chains (302) may be coupled with horizontal member (305) via respective brackets, bolts, or using any other suitable devices, structures, components, and/or techniques. The top ends of vertical chains (304) are thus raised with horizontal member (305) when posts (320) are raised to the deployed position. The bottom end of each vertical chain (304) is coupled with anchors (350), which are secured to floor (314) of housing (310). If desired, vertical chains (304) may be coupled with anchors (350) with pins or bolts that will shear during impact of barrier system (300) by a vehicle, such as to prevent damage to floor (314) from being caused by such impact and/or for any other purpose. Alternatively, anchors (350) may be configured to allow vertical chains (304) to "break away" from anchors (350) upon sufficient force at the coupling of chains (304) with anchors (350). Examples of suitable break away anchors are described in U.S. Pub. No. 2007/0264080, entitled "Vehicle Barrier Deployment System," published Nov. 15, 2007, the disclosure of which is incorporated by reference herein. Other suitable ways in which vertical chains (304) may be secured relative to housing (310), including alternative break away couplings and non-break away couplings, will be apparent to those of ordinary skill in the art in view of the teachings herein.

Figure 17:
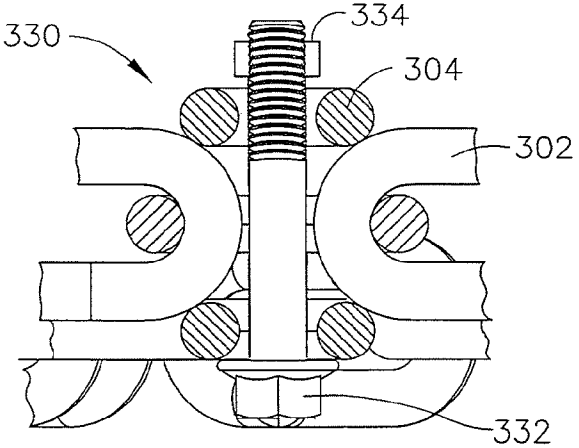
FIG. 17 is a partial, cross sectional view showing a chain coupling of the lifting system of FIG. 11.

Vertical chains (304) are collapsed when barrier system (300) is in a retracted or undeployed position; and are extended vertically when barrier system (300) is in an extended or deployed position. In the present example, horizontal chains (302) and vertical chains (304) are coupled together at couplings (330). As shown in FIG. 17, each coupling (330) comprises a bolt (332) and a corresponding nut (334). Bolt (332) is inserted through aligned links of chains (302, 304), though any other suitable features, components, devices, or techniques may be used if desired. The coupling of horizontal chains (302) with vertical chains (304) is such that, as vertical chains (304) are lifted to an extended position by horizontal member (305), vertical chains (304) lift horizontal chains (302). The coupling of horizontal chains (302) with vertical chains (304) also maintains a degree of vertical spacing between horizontal chains (302) when horizontal chains (302) have been lifted to the raised position. As can be seen in FIG. 17, vertical chains (304) are provided in pairs—one vertical chain (304) being on one side of each horizontal chain (302) at each coupling (330) and another vertical chain (304) being on the other side of each horizontal chain (302) at each coupling (330). It should be understood, though, that some versions may include just one vertical chain (304) on just one side of horizontal chains (302).

Horizontal chains (302) span across posts (320). However, horizontal chains (302) are not directly attached to posts (320) in the present example. Nevertheless, horizontal chains (302) may be directly attached to posts (320) in some versions. As shown in FIGS. 14-15, each post (320) of the present example has a recess (322) formed in it to provide space to accommodate horizontal chains (302). In addition, horizontal chains (302) and the top edge of post guides (324) are positioned such that horizontal chains (302) are not pulled into post guides (302) when barrier system (300) is in the retracted or undeployed position.

Figure 16:
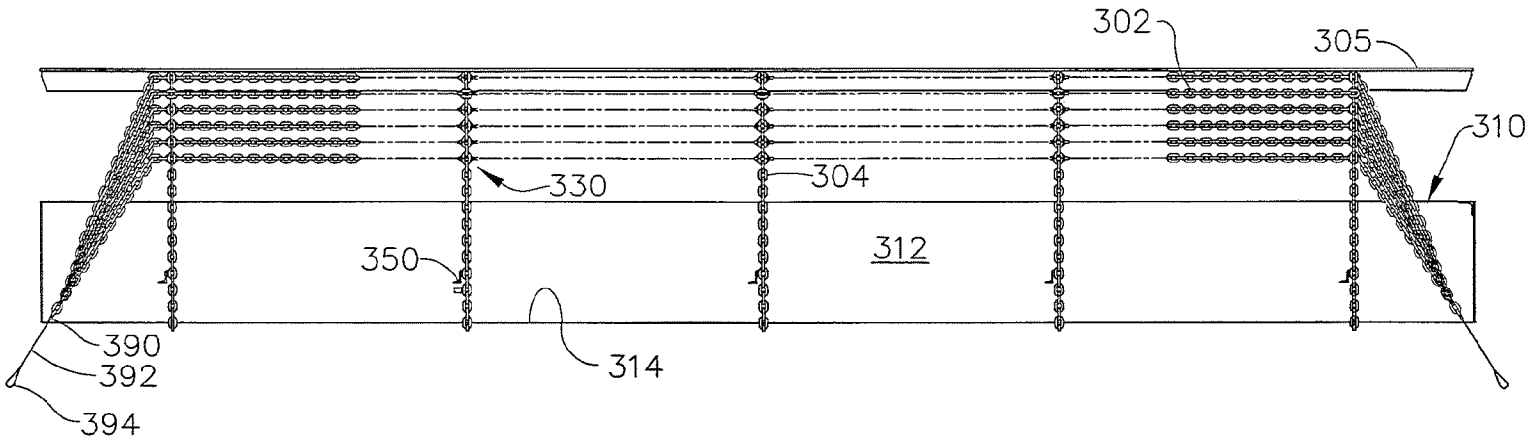
FIG. 16 is a partial, side cross-sectional view of the lifting system of FIG. 11, in a deployed position, with posts and post guides removed.

As shown in FIG. 16, at each end of barrier system (300), the free ends of horizontal chains (302) converge at a coupling (390) and are connected to coupling (390) in the present example. An anchoring member (392) is also connected with each coupling (390). Various ways in which horizontal chains (302) and anchoring members (392) maybe secured to their corresponding couplings (390), as well as various forms that such couplings (390) may take, will be apparent to those of ordinary skill in the art in view of the teachings herein. Each anchoring member (392) forms a loop (394) at its opposite end. Each anchoring member (420) passes through floor (314) of housing (310) in the present example, such that loops (394) are positioned lower than floor (314) of housing (310). A deadman bar (not shown) is passed through each loop (394), and is anchored within concrete (3) or within the ground (e.g., when concrete (3) casing is omitted). For instance, the deadman bar may itself be anchored by a concrete deadman in the ground below housing (310). The ends of horizontal chains (302) may alternatively be anchored by outside the ends of housing (310). With anchors being located external to housing (310), each horizontal chain (302), or just anchoring members (392), may pass through a chain exit opening formed through sidewall (312) or floor (314) of housing (310). In still other versions, horizontal chains (302) are anchored directly to floor (314), to some other component that is secured to floor (314), directly to sidewalls (312), or to some other component that is secured to sidewalls (312). Other suitable structures and techniques for securing horizontal chains (302) will be apparent to those of ordinary skill in the art in view of the teachings herein.

Chains (302, 304) may comprise links that are formed of material (e.g., steel, etc.) that is approximately a half-inch thick, though any other suitable dimension or material(s) may be used. It should also be understood that horizontal chains (302) may have a different thickness than vertical chains (304) (e.g., horizontal chains (302) being thicker than vertical chains (304)). In the present example, six or seven horizontal chains (302) are used, and are vertically spaced evenly relative to horizontal member (305). Alternatively, any suitable number of horizontal chains (302) may be used. Similarly, any suitable number of vertical chains (304) may be used. Various other suitable ways in which chains (302, 304) may be configured, coupled together, coupled with other parts of barrier system (300), and anchored will be apparent to those of ordinary skill in the art in view of the teachings herein.

D. Exemplary Control

Control of barrier system (300) may be provided in a variety of ways. For instance, control may be provided locally or remotely, just as in the various options for control described above with respect to barrier system (10). Similarly, barrier system (300) may include safety or warning features, etc., just like those features described above with respect to barrier system (10). In fact, any teachings herein relating to barrier system (10) (or other barrier systems described herein) may be readily applied to barrier system (300) as will be apparent to those of ordinary skill in the art. Barrier system (300) may be thus deployed and undeployed using any of the deployment/undeployment mechanisms and control systems described herein. Alternatively, any other suitable deployment/undeployment mechanisms and/or control systems may be used Likewise, any teachings herein relating to barrier system (300) may be readily applied to barrier system (10) (or other barrier systems described herein) as will be apparent to those of ordinary skill in the art. Various other suitable components, features, configurations, operabilities, and uses of barrier system (300) will also be apparent to those of ordinary skill in the art in view of the teachings herein. By way of example only, a substitute or supplement for chains (302, 304) may include guardrails, cables, rods, bars, rails, ropes, netting, plates, or any other suitable structures, including combinations of such structures, and including any suitable material or combination of materials.

III. Exemplary Vehicle Barrier with Cables

A. Overview

Figure 18:
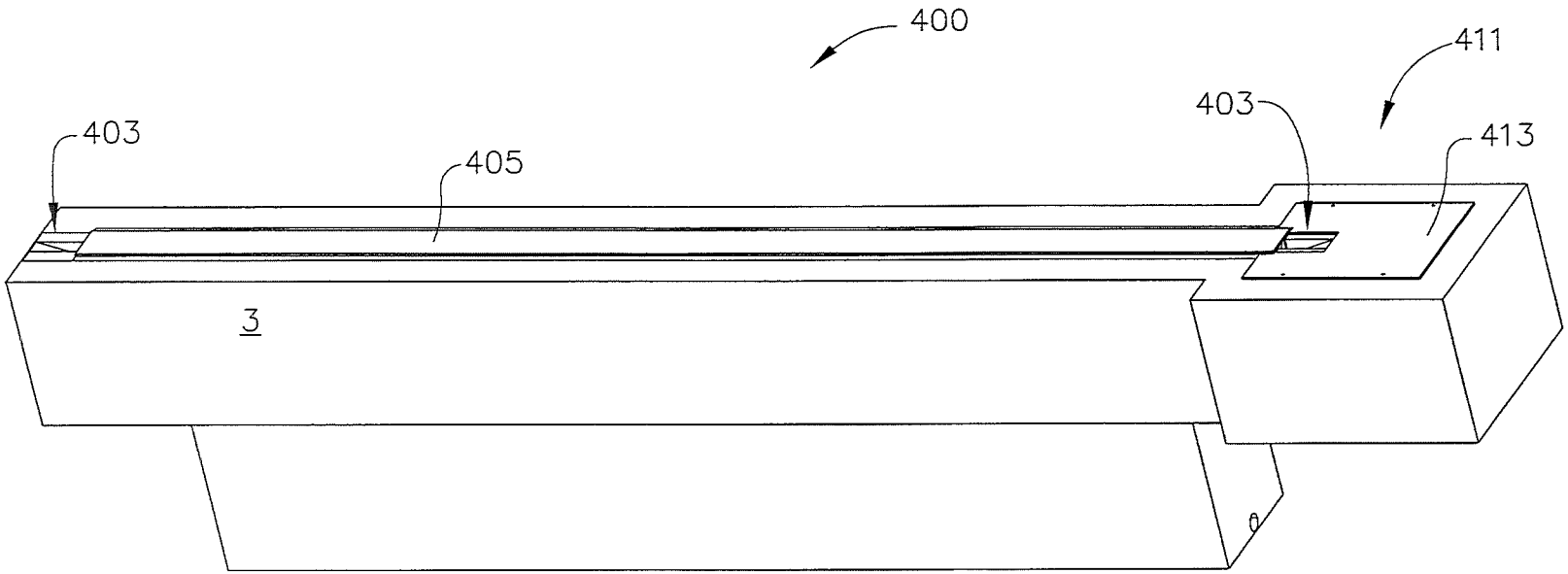
FIG. 18 is a perspective view of another exemplary alternative vehicle barrier system in an undeployed position.
Figure 19:
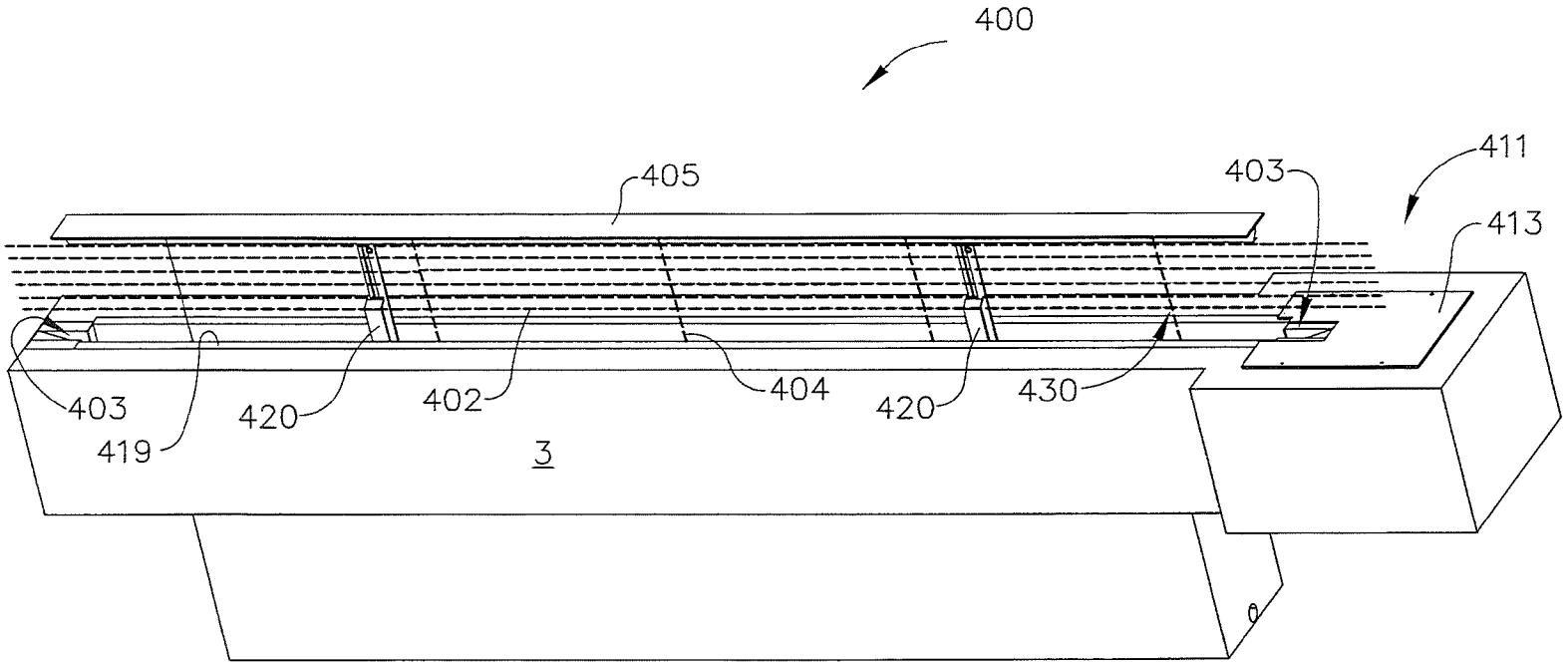
FIG. 19 is a perspective view of the system of FIG. 18 in a deployed position.
Figure 20:
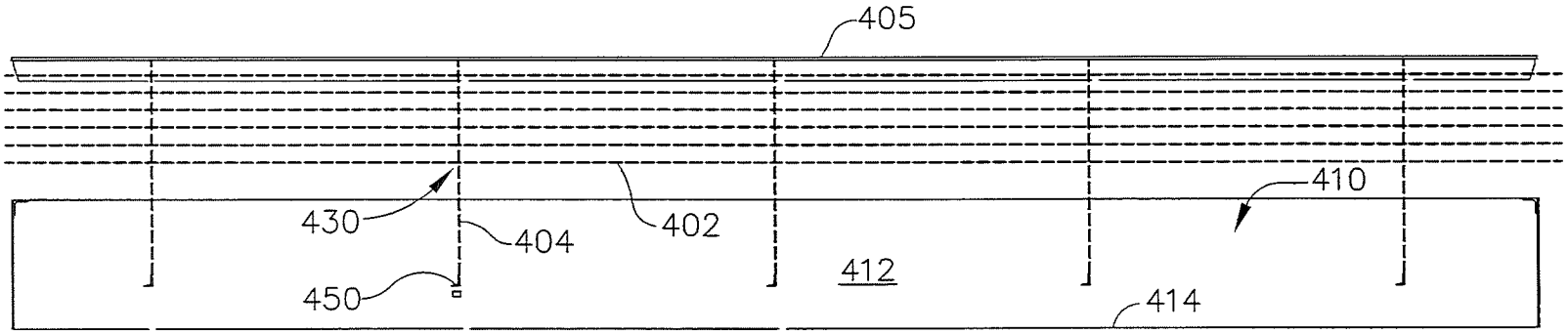
FIG. 20 is a partial, side cross-sectional view of the lifting system of FIG. 18, in a deployed position, with posts and post guides removed.

FIGS. 18-20 show an exemplary alternative vehicle barrier system (400) that includes cables (402, 404) and that is selectively retractable into the ground. This example of barrier system (400) is similar to barrier system (300), described above, in several respects. For instance, barrier system (400) comprises a housing (410) that is embedded within reinforced concrete (3). A pair of vertical posts (420) are operable to reciprocate relative to housing (410). While just two vertical posts (420) are provided in the present example, it should be understood that any other suitable number of vertical posts (420) may be used in any suitable arrangement. Posts (420) of the present example have a substantially identical configuration as posts (320) described above, though it should be understood that posts (420) may alternatively have any other suitable configuration.

In addition, barrier system (400) is operable to selectively raise and lower posts (420) relative to housing (410) in a manner that is substantially identical to the manner in which barrier system (300) is operable to selectively raise and lower posts (320) as described above. In particular, barrier system (400) of the present example includes raising and lowering components that are substantially identical to the raising and lowering components described above with respect to barrier system (300). Of course, barrier system (400) may include any other suitable types of raising and lowering components, as desired. Posts (420) may be raised such that the lowermost horizontal cable (402) is at a height of anywhere between approximately 27 inches and approximately 36 inches (e.g., relative to the ground and/or relative to concrete (3), etc.), or at any other suitable height. Furthermore, like horizontal member (305) described above, a horizontal member (405) is configured to substantially close posts (420) and cables (402, 404) within housing (410) when posts (420) and cables (402, 404) are retracted downward.

FIG. 18 shows posts (420) and cables (402, 404) in a retracted or undeployed configuration. In this configuration, posts (420) are completely recessed below ground level, a substantial portion of cables (402, 404) are completely recessed below ground level, and the top portion of horizontal member (405) is substantially flush with the ground level. FIGS. 19-20 show posts (420) and cables (402, 404) in a deployed configuration. In this configuration, posts (420) and cables (402, 404) are positioned above ground level, and are configured to provide a barrier against passage of vehicles and the like. Barrier system (400) may therefore be provided within a road, median, sidewalk, or elsewhere to selectively prevent passage of vehicles and the like. Various suitable locations and ways in which barrier system (400) may be positioned and used will be described in greater detail below, while other suitable locations and ways in which barrier system (400) may be positioned and used will be apparent to those of ordinary skill in the art in view of the teachings herein.

In some versions, barrier system (400) may stop a vehicle that is traveling at a high rate of speed, even if the driver of the vehicle is intent on passing through the barrier provided by barrier system (400). For instance, posts (420) and cables (402, 404) may be sufficiently anchored such that they provide little or no "give" when struck by a vehicle. By way of example only, some versions of barrier system (400) may meet a Department of State "K" certification requiring that the front line of cargo of a 15,000 pound vehicle traveling 50 mph must not go further than 1 meter past the line defined by barrier system (400). In addition or in the alternative, some versions of barrier system (10) may satisfy the American Association of State Highway and Transportation Officials (AASHTO) Manual for Assessing Safety Hardware (MASH) criteria. In some instances with some versions of barrier system (400), posts (420) and/or cables (402, 404) may essentially destroy a vehicle that strikes posts (420) and/or cables (402, 404), with relatively little damage being done to barrier system (400). For instance, barrier system (400) may be constructed such that no portions of barrier system (400) are released as projectiles when barrier system (400) is struck by a heavy vehicle moving at a high rate of speed. In some versions, as described in greater detail below, vertical cables (404) are coupled with housing (410) by shear joints, such that vertical cables (404) may break away from housing (410) to some degree. Nevertheless, horizontal cables (402) and/or posts (420) may still destroy or at least stop an impacting vehicle in some such versions, without barrier system (400) providing elastic "give."

Housing (410) of the present example comprises sidewalls (412) and a floor (414). In addition, as shown in FIGS. 18-19, a compartment (411) is provided at an end of housing (410). A cover plate (413) is secured over the top of compartment (411). In some versions, compartment (411) contains some if not all of the same components contained in compartment (11) as described above. Various suitable ways in which such components may be incorporated into barrier system (400) of this example will be apparent to those of ordinary skill in the art in view of the teachings herein. Similarly, various other types of components that could be provided in compartment (411) or otherwise be incorporated into barrier system (400) will be apparent to those of ordinary skill in the art in view of the teachings herein. Of course, compartment (411) need not be located at an end of housing (410), and could be located at any other suitable position, including but not limited to along a side of housing (410) or within housing (410). Housing (410) may also be provided with various structures and features for reinforcement, including but not limited to structures and features described elsewhere herein in the context of reinforcement for other housings (4, 310). Alternatively, housing (410) may have any other suitable type of reinforcement; or may even lack reinforcement features and structures if desired. As with other components described herein, each of these components may be substituted, supplemented, relocated, or omitted in any suitable fashion as desired.

A horizontal member (405) spans across the tops of posts (420); and will raise and lower unitarily with posts (420). While just a single horizontal member (405) is used in the present example, it should be understood that more than one horizontal member (405) may be used. For instance, two or more horizontal member (405) may be placed adjacent to each other at a substantially common vertical height relative to posts (420). In addition or in the alternative, two or more horizontal members (405) may be placed at different vertical heights relative to posts (420). While horizontal member (405) comprises a rigid steel "T-rail" in the present example, horizontal member (405) may take a variety of alternative forms. By way of example only, in some versions horizontal member (405) comprises a horizontal cable (402) that is in tension, with vertical cables (404) being hung from horizontal cable (402). In some such versions, it may be desirable to add additional reciprocating posts (e.g., more than just posts (420) shown in FIG. 19) to support a horizontal member (405) that is formed by a top horizontal cable (402). Such additional reciprocating posts may be "active" like posts (420) or may be "passive" like posts (100) of barrier system (10). In addition or in the alternative, posts (420) may be moved outwardly to a desired gate width and a cable or chain version of horizontal member (405) may be stretched across the top of posts (420) with sufficient tension to support the attachment of vertical cables (404) and horizontal cables (402). As yet another merely illustrative example, horizontal member (405) may comprise a horizontal chain in tension rather than a rigid "T-rail" or cable in tension. In some versions where horizontal member (405) is provided by a chain or cable, one or more posts (420) may extend at a slightly outward angle relative to each other (e.g., rather than extending in a purely vertical direction), such that posts (420) "stretch" such a top chain or cable or otherwise increase tension in such a top chain or cable as posts (420) reach a fully extended position. Still other suitable forms that horizontal member (405) may take and various ways in which such alternative forms of horizontal member (405) may be integrated into barrier system (400) will be apparent to those of ordinary skill in the art in view of the teachings herein.

Horizontal member (405) of the present example is configured to cover the opening defined by sidewalls (412) of housing (410). In particular, horizontal member (405) may be substantially flush with the ground when posts (420) are in the lowered/undeployed position as shown in FIG. 18. For instance, regular vehicle traffic may drive over lowered horizontal member (405) with little or no disturbance. Lowered horizontal member (405) may therefore not present any type of ramp, "speed bump," or other disturbance to drivers in some versions. Of course, horizontal member (405) may be differently configured to produce a ramp, speed bump, other disturbance to drivers, or in any other suitable fashion, as desired. It should also be understood that barrier system (400) may include one or more hinged cover plates (5) (e.g., like barrier system (10) described above, etc.). By way of example only, it may be desirable to add one or more hinged cover plates (5) in some versions where horizontal member (405) is provided by a horizontal cable (402) in tension rather than a rigid "T-rail." In some such versions, posts (420) may be provided with an analog to cover opening plate (190) described above, in order to assist with the opening and closing of the one or more cover plates (5).

It should be understood that using a chain or cable for horizontal member (405) may permit the opening defined by the top of housing (410) to have a relatively slimmer size. In some versions where a chain or cable is used for horizontal member (405,) the opening defined by the top of housing (410) is slim enough that a cover plate (5) is not needed in order to permit vehicles to safely drive over the top of housing (410) when barrier system is in a retracted configuration. In other words, the opening defined by the top of housing (410) may be configured to permit vehicles to safely drive over the top of housing (410) even in the absence of any cover plates. To the extent that flanges (419) of housing (410) are exposed, such flanges (419) may include a beveled edge to also reduce the likelihood of snow plow blades or the like getting snagged on flanges (419). To the extent that tread plates or other components are positioned above flanges (419) and obscure flanges (419), such tread plates or other components may have such a beveled edge to also reduce the likelihood of snagging. In addition, in versions where horizontal member (405) comprises a rigid "T-rail," such a "T-rail" may also have beveled edges to reduce the likelihood of snow plow blades or the like getting snagged on horizontal member (405). Likewise, to the extent that cover plates (5) are provided as part of barrier system (400), such cover plates (5) may each include a beveled edge to also reduce the likelihood of snow plow blades or the like getting snagged on cover plates (5). Of course, these features and configurations are merely optional, and may be varied, substituted, supplemented, or omitted as desired.

B. Exemplary Deployment and Retraction System

As noted above, barrier system (400) may include the same deployment and retraction components described above with respect to barrier system (300). For instance, barrier system (400) may include components that are analogous to post guides (324), cables (340, 341), pulleys (360, 361, 362), a winch, etc. In other words, the combination of posts (420), horizontal member (405), and cables (402, 404) may be raised or deployed collectively and simultaneously, merely by a winch pulling on one or more cables (not shown). Tension may be maintained in such one or more cables to keep posts (420), horizontal member (405), and cables (402, 404) in a raised or deployed position (e.g., by braking the winch, etc.). Of course, there are a variety of other ways in which posts (420), horizontal member (405), and/or cables (402, 404) may be raised or otherwise deployed. One merely illustrative alternative is described in greater detail below (e.g., scissor arms (800, 802) assisting in raising of components, etc.), while others will be apparent to those of ordinary skill in the art in view of the teachings herein. Similarly, there are a variety of other ways in which posts (420), horizontal member (405), and cables (402, 404) may be kept in a raised position (e.g., without just relying on tension in cables, etc.). One merely illustrative alternative is described in greater detail below (e.g., scissor arms (800, 802) bearing weight of raised components, etc.), while others will be apparent to those of ordinary skill in the art in view of the teachings herein.

Furthermore, it will be appreciated that the combination of posts (420), horizontal member (405), and cables (402, 404) may be lowered or retracted collectively and simultaneously, merely by a winch pulling on one or more cables (not shown). Of course, there are a variety of other ways in which posts (420), horizontal member (405), and/or cables (402, 404) may be lowered or otherwise retracted. One merely illustrative alternative is described in greater detail below, while others will be apparent to those of ordinary skill in the art in view of the teachings herein.

In some versions, one or more plates (not shown) may be provided in housing (410), to substantially cover at least some of the above described cables and/or pulleys, such as to protect such cables and/or pulleys from debris, etc. Of course, such plates are merely optional.

C. Exemplary Cable Configurations

Cables (402, 404) of the present example include a plurality of horizontal cables (402) and a plurality of vertical cables (404). Each vertical cable (404) has a top end coupled with horizontal member (405) in the present example. By way of example only, vertical cables (402) may be coupled with horizontal member (405) via respective brackets, bolts, or using any other suitable devices, structures, components, and/or techniques. The top ends of vertical cables (404) are thus raised with horizontal member (405) when posts (420) are raised to the deployed position as will be described in greater detail below. The bottom end of each vertical cable (404) is coupled with anchors (450), which are secured to floor (414) of housing (410). If desired, vertical cables (404) may be coupled with anchors (450) with pins or bolts that will shear during impact of barrier system (400) by a vehicle, such as to prevent damage to floor (414) from being caused by such impact and/or for any other purpose. Alternatively, anchors (450) may be configured to allow vertical cables (404) to "break away" from anchors (450) upon sufficient force at the coupling of cables (404) with anchors (450). Examples of suitable break away anchors are described in U.S. Pub. No. 2007/0264080, entitled "Vehicle Barrier Deployment System," published Nov. 15, 2007, the disclosure of which is incorporated by reference herein. Other suitable ways in which vertical cables (404) may be secured relative to housing (410), including alternative break away couplings and non-break away couplings, will be apparent to those of ordinary skill in the art in view of the teachings herein.

Vertical cables (404) are collapsed when barrier system (400) is in a retracted or undeployed position; and are extended vertically when barrier system (400) is in an extended or deployed position. In the present example, horizontal cables (402) and vertical cables (404) are coupled together at couplings (430). Various suitable forms that couplings (430) may take, including but not limited to structures, features, components, and configurations of couplings (430), will be apparent to those of ordinary skill in the art in view of the teachings herein. The coupling of horizontal cables (402) with vertical cables (404) is such that, as vertical cables (404) are lifted to an extended position by horizontal member (405), vertical cables (404) lift horizontal cables (402). The coupling of horizontal cables (402) with vertical cables (404) also maintains a degree of vertical spacing between horizontal cables (402) when horizontal cables (402) have been lifted to the raised position. In some versions, vertical cables (404) are provided in pairs—one vertical cable (404) being on one side of each horizontal cable (402) at each coupling (430) and another vertical cable (404) being on the other side of each horizontal cable (402) at each coupling (430). It should be understood, though, that some versions may include just one vertical cable (404) on just one side of horizontal cables (402).

In some versions, vertical cables (404) are substituted with chains, while horizontal cables (402) are still used. For instance, vertical cables (404) may be substituted with the same vertical chains (304) described above with respect to barrier system (300). Various suitable ways in which vertical chains (304) may be incorporated into barrier system (400) in place of vertical cables (404) will be apparent to those of ordinary skill in the art in view of the teachings herein. By way of example only, horizontal cables (402) may be inserted through links of such vertical chains. Alternatively, horizontal cables (402) may be clipped to, clamped to, or otherwise coupled with such vertical chains.

Horizontal cables (402) span across posts (420). However, horizontal cables (402) are not directly attached to posts (420) in the present example. Nevertheless, horizontal cables (402) may be directly attached to posts (420) in some versions. Each post (420) of the present example has a recess formed in it, substantially identical to recesses (322) in posts (320) described above, to provide space to accommodate horizontal cables (402). One difference between barrier system (400) of the present example and barrier system (300) described above is that barrier system (400) includes angled recesses (403) at opposing longitudinal ends of barrier system (400). These recesses (403) provide clearance for horizontal cables (402) to exit the longitudinal ends of barrier system (400) when barrier system (400) is in the retracted configuration shown in FIG. 18. Furthermore, these recesses (403) prevent horizontal cables (402) from restricting full retraction of horizontal member (405) and posts (420) relative to housing (410). In particular, horizontal member (405) may remain substantially flush with the ground when barrier system (400) is in the retracted configuration shown in FIG. 18, with horizontal cables (402) exiting the longitudinal ends of barrier system (400) via recesses (403).

In the present example, the free ends of horizontal cables (402) are coupled with preexisting above-ground cables and/or posts in a highway median or elsewhere. Recesses (403) may thus permit horizontal cables (402) to maintain their connection with external above-ground components, even as barrier system (400) is in the retracted configuration shown in FIG. 18, without horizontal cables (402) providing substantial interference against such retraction of horizontal member (405) and posts (420). In some versions, each horizontal cable (402) is coupled to a portion of the length of a corresponding preexisting cable of a conventional above-ground cable barrier. For instance, the end of a horizontal cable (402) may be positioned alongside and parallel to part of the length of a corresponding preexisting cable of a conventional above-ground cable barrier; and cable (402) may thereby be secured to the corresponding preexisting cable of a conventional above-ground cable barrier by one or more conventional cable clamps, swaged fittings, or using other components or techniques. As another merely illustrative example, the end of a horizontal cable (402) may be interweavingly spliced with the end of a corresponding preexisting cable of a conventional above-ground cable barrier. Other suitable ways in which horizontal cables (402) may be coupled with preexisting cables or other components of preexisting cable barrier systems will be apparent to those of ordinary skill in the art in view of the teachings herein. Alternatively, the free ends of horizontal cables (402) may be anchored to housing (410) (e.g., to sidewalls (412) or floor (414)), anchored to concrete deadmen (e.g., outside the ends of housing (410) or below housing (410)), or may be otherwise anchored.

Cables (402, 404) may comprise steel or any other suitable material(s), and may have strength sufficient to stop a vehicle traveling at a high rate of speed. For instance, cables (402, 404) may be configured in accordance with cables typically found in highway medians. Alternatively, cables (402, 404) may have any other desired properties. In the present example, six or seven horizontal cables (402) are used, and are vertically spaced evenly relative to horizontal member (405). Alternatively, any suitable number of cables (402, 404) may be used.

D. Exemplary Control

Control of barrier system (400) may be provided in a variety of ways. For instance, control may be provided locally or remotely, just as in the various options for control described above with respect to barrier systems (10, 300). Similarly, barrier system (400) may include safety or warning features, etc., just like those features described above with respect to barrier systems (10, 300). In fact, any teachings herein relating to barrier systems (10, 300) (or other barrier systems described herein) may be readily applied to barrier system (400) as will be apparent to those of ordinary skill in the art. Barrier system (400) may be thus deployed and undeployed using any of the deployment/undeployment mechanisms and control systems described herein. Alternatively, any other suitable deployment/undeployment mechanisms and/or control systems may be used. Likewise, any teachings herein relating to barrier system (400) may be readily applied to barrier systems (10, 300) (or other barrier systems described herein) as will be apparent to those of ordinary skill in the art. Various other suitable components, features, configurations, operabilities, and uses of barrier system (400) will also be apparent to those of ordinary skill in the art in view of the teachings herein. By way of example only, a substitute or supplement for cables (402, 404) may include guardrails, chains, rods, bars, rails, ropes, netting, plates, or any other suitable structures, including combinations of such structures, and including any suitable material or combination of materials.

IV. Exemplary Vehicle Barrier with Beams

A. Overview

FIGS. 21-41 show an exemplary alternative vehicle barrier system (500) that includes horizontal gate beams (520, 560) and that is selectively retractable into the ground. This example of barrier system (500) is similar to barrier system (10), described above, in several respects. For instance, barrier system (500) comprises a housing (510) that is embedded within reinforced concrete (3). A pair of hinged cover plates (502) are coupled with housing (510), and a plurality of vertical posts (504, 506) are operable to reciprocate relative to housing (510). Cover plates (502) are configured to substantially close posts (504, 506) and horizontal members (508, 520, 560) within housing (510) when posts (504, 506) and horizontal members (508, 520, 560) are retracted downward.

Posts (504, 506) include passive posts (504) and lifting posts (506), as will be described in greater detail below. It will be appreciated that any suitable number of passive posts (504) and/or lifting posts (506) may be used in any suitable arrangement. In the present example, lifting posts (506) comprise steel I-beams, while passive posts (504) comprise steel square tubes. That is, lifting posts (506) of the present example comprise steel extrusions having an "I"-shaped cross section, while passive posts (504) of the present example comprise steel tubes having a square cross section. Optionally, posts (504) may include "I-beams" or other suitable structures secured within their interior for reinforcement. Alternatively, posts (504, 506) may be formed of any other suitable material (s) and may have any other suitable cross sectional form(s). By way of example only, posts (504) may alternatively have a cross sectional form that is similar to the cross sectional form of posts (506) in some versions, or vice versa. Furthermore, in some versions posts (504) are omitted entirely, such that only posts (506) are included. In some such versions, posts (506) are coupled together via one or more horizontal members (508, 520, 560) and/or other components.

As will be described in greater detail below, posts (504, 506) are connected by a plurality of horizontal members (508, 520, 560) in the present example, such that posts (504, 506) move vertically substantially simultaneously. In some versions, a single horizontal member (508) spans across all posts (504, 506) (e.g., along the tops of posts (504, 506)), while separate horizontal gate beams (520, 560) span between adjacent posts (504, 506). While barrier system (500) of the present example comprises two horizontal gate beams (520) and one horizontal gate beam (560), it should be understood that any other suitable number of horizontal gate beams (520) and/or horizontal gate beams (560) may be used. It should also be understood that various structures other than horizontal gate beams (520, 560) may be used. Several structures that may be used as an alternative to horizontal gate beams (520, 560) are described elsewhere herein, while others will be apparent to those of ordinary skill in the art in view of the teachings herein.

Figure 21:
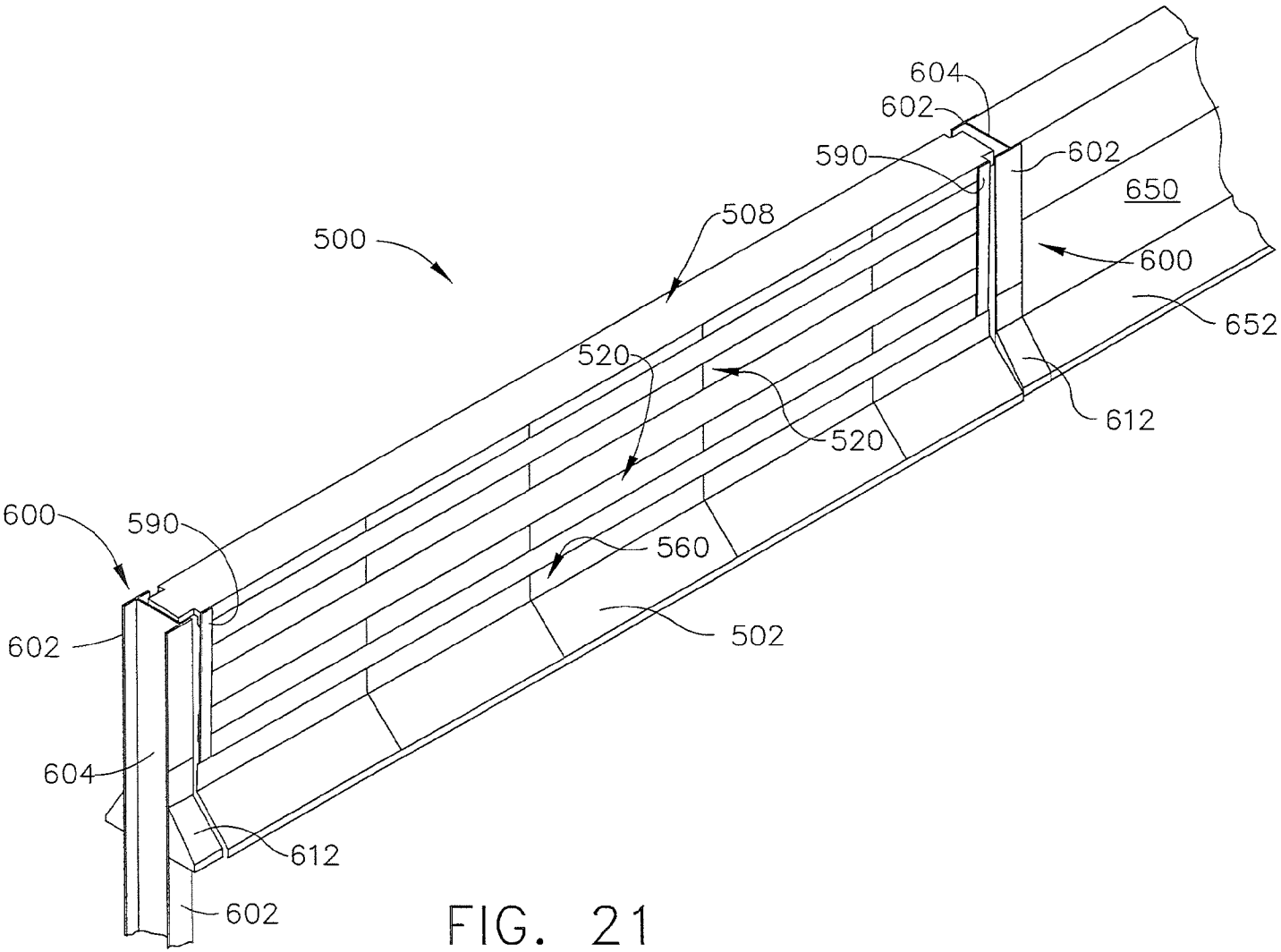
FIG. 21 is a perspective view of another exemplary alternative vehicle barrier system in a deployed position.
Figure 22:
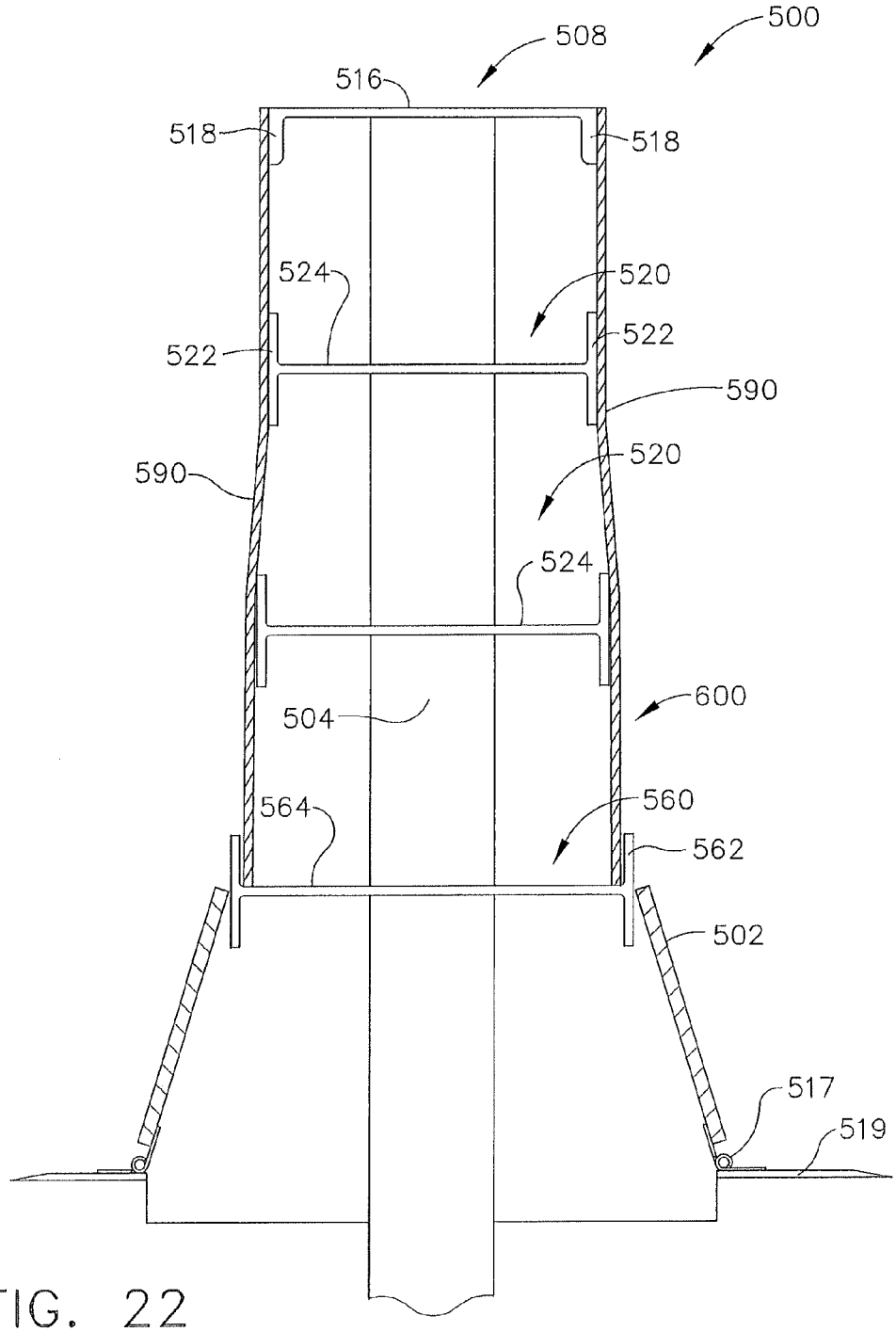
FIG. 22 is a partial, end cross-sectional view of the system of FIG. 21.

FIGS. 21-22 show posts (504, 506) and horizontal members (508, 520, 560) in a deployed configuration, with cover plates (502) open. In this configuration, posts (504, 506) and horizontal members (508, 520, 560) are substantially positioned above ground level, and are configured to provide a barrier against passage of vehicles and the like. Barrier system (500) may therefore be provided within a road, median, sidewalk, or elsewhere to selectively prevent passage of vehicles and the like. Various suitable locations and ways in which barrier system (500) may be positioned and used will be described in greater detail below, while other suitable locations and ways in which barrier system (500) may be positioned and used will be apparent to those of ordinary skill in the art in view of the teachings herein.

In some versions, barrier system (500) may stop a vehicle that is traveling at a high rate of speed, even if the driver of the vehicle is intent on passing through the barrier provided by barrier system (500). For instance, posts (504, 506) and horizontal members (508, 520, 560) may be sufficiently anchored such that they provide little or no "give" when struck by a vehicle. By way of example only, some versions of barrier system (500) may meet a Department of State "K" certification requiring that the front line of cargo of a 15,000 pound vehicle traveling 50 mph must not go further than 1 meter past the line defined by barrier system (500). In addition or in the alternative, some versions of barrier system (10) may satisfy the American Association of State Highway and Transportation Officials (AASHTO) Manual for Assessing Safety Hardware (MASH) criteria. In some instances with some versions of barrier system (500), posts (504, 506) and/or horizontal members (508, 520, 560) may essentially destroy a vehicle that strikes posts (504, 506) and/or horizontal members (508, 520, 560), with relatively little damage being done to barrier system (500). For instance, barrier system (500) may be constructed such that no portions of barrier system (500) are released as projectiles when barrier system (500) is struck by a heavy vehicle moving at a high rate of speed.

Housing (510) of the present example comprises sidewalls (512) and a floor (514). Flanges (519) extend outwardly from the top portions of sidewalls (512). In some versions, tread plates (not shown) are secured to flanges (519). In addition, a compartment (not shown) may be provided at an end of housing (510) or at any other suitable location. A cover plate (not shown) may be secured over the top of such a compartment. In some versions, such a compartment contains some if not all of the same components contained in compartment (11) as described above. Various suitable ways in which such components may be incorporated into barrier system (500) of this example will be apparent to those of ordinary skill in the art in view of the teachings herein. Similarly, various other types of components that could be provided in such a compartment or otherwise be incorporated into barrier system (500) will be apparent to those of ordinary skill in the art in view of the teachings herein. Housing (510) may also be provided with various structures and features for reinforcement, including but not limited to structures and features described elsewhere herein in the context of reinforcement for other housings (4, 310, 410). Alternatively, housing (510) may have any other suitable type of reinforcement; or may even lack reinforcement features and structures if desired. As with other components described herein, each of these components may be substituted, supplemented, relocated, or omitted in any suitable fashion as desired.

Cover plates (502) are pivotally coupled to upper flanges (519) of housing (510) via hinges (517), such that cover plates (502) may provide a selectively openable "lid" for barrier system (500). In some versions, hinges (517) comprise a single continuous hinge (e.g., a "piano hinge") on each side of barrier system (500), such that a single hinge (517) couples each cover plate (502) with its respective flange (519). In some other versions, a plurality of hinges (517) are provided on each side of barrier system (500). Some versions may also include plates (not shown) on each side of hinges (517) such plates may be configured to deflectingly force snow plow blades or the like to be raised above hinges (517), to avoid snow plow blades or the like getting snagged on hinges (517). For instance, such plates may wrap over at least part of the "knuckle" (e.g., the part that contains the hinge pin) of each hinge (517). As one merely illustrative alternative, each hinge (517) may be installed facing down such that the knuckles of hinges (517) are covered. To the extent that flanges (519) of housing (510) are exposed, such flanges (519) may include a beveled edge to also reduce the likelihood of snow plow blades or the like getting snagged on flanges (519). To the extent that tread plates or other components are positioned above flanges (519) and obscure flanges (519), such tread plates or other components may have such a beveled edge to also reduce the likelihood of snagging. Of course, these features and configurations are merely optional, and may be varied, substituted, supplemented, or omitted as desired.

Figure 37:
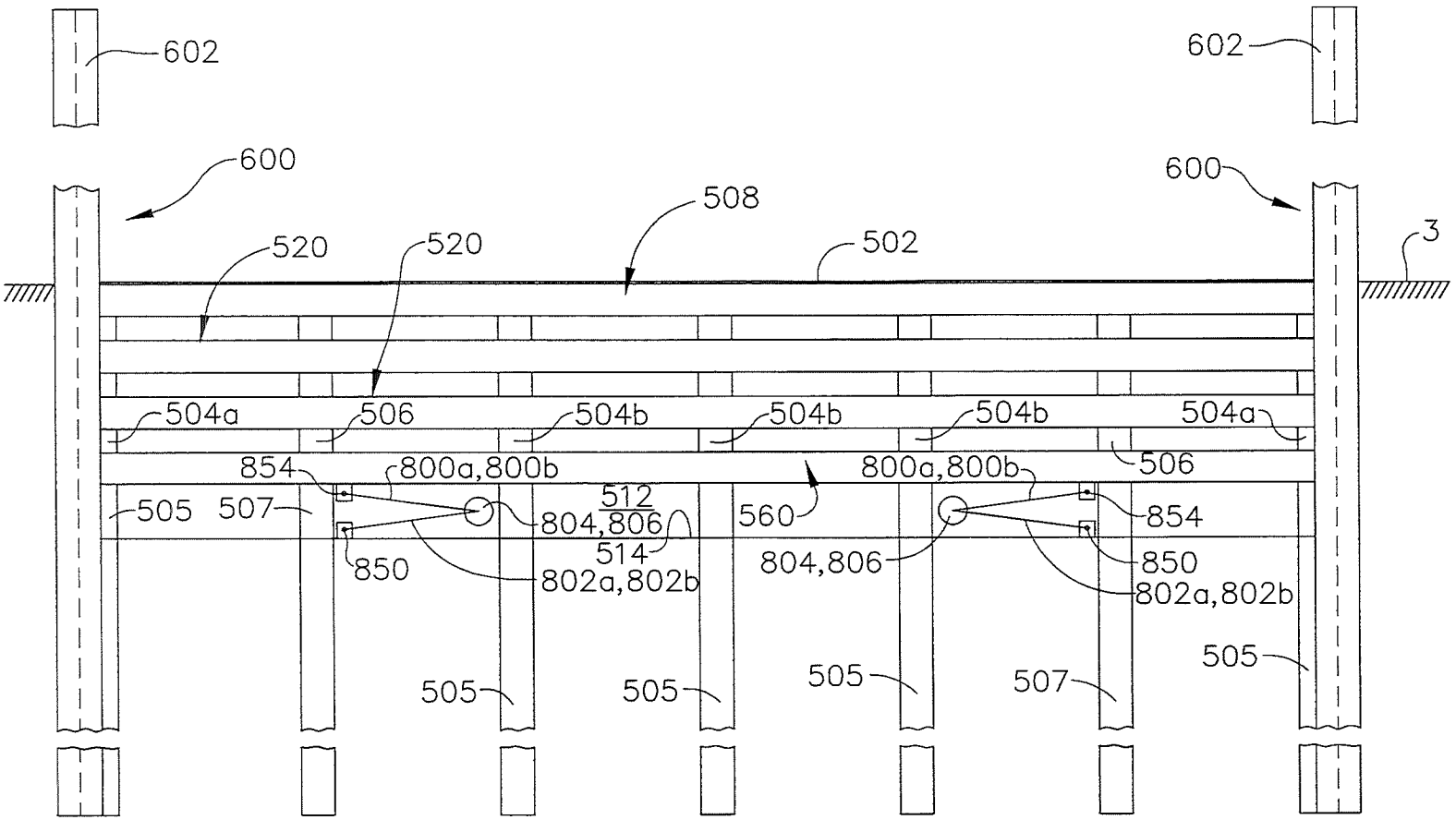
FIG. 37 is a side, cross-sectional schematic view of a modification to the system of FIG. 21, including folding support member assemblies.

FIG. 37 schematically shows posts (504, 506) and horizontal members (508, 520, 560) in a retracted or undeployed configuration. In this configuration, posts (504, 506) and horizontal members (508, 520, 560) are completely recessed below ground level (which is approximately at the same height as the top of concrete (3) in FIG. 37); and cover plates (502) are substantially flush with ground level. For instance, regular vehicle traffic may drive over closed cover plates (502) with little or no disturbance. Closed cover plates (502) may therefore not present any type of ramp, "speed bump," or other disturbance to drivers in some versions. Of course, cover plates (502) may be differently configured to produce a ramp, speed bump, other disturbance to drivers, or in any other suitable fashion, as desired.

As shown in FIGS. 21-22, vertical bars (590) are secured to each end of barrier system (500) at each side of gate beams (520). In particular, vertical bars (590) comprise strips of steel that are secured to the outer face of each vertical section (518) of horizontal member (508); and to the outer face of each flange (522) of each gate beam (520). In addition, each vertical bar (590) is secured to the inner face of each flange (562) of gate beam (560). Vertical bar (590) may be secured to horizontal member (508) and gate beams (520, 590) by welding, bolts, rivets, or using any other suitable components, features, structures, or techniques. Vertical bars (590) are approximately 1 inch wide in the present example (their width relative to other components is exaggerated in FIG. 21) and are configured to break away upon impact by a vehicle. Alternatively, vertical bars (590) may have any other suitable size and/or may not be configured to break away upon impact by a vehicle. Vertical bars (590) of the present example are configured to assist in the opening of cover plates (502) as posts (504, 506) are raised to the extended position. For instance, cover plates (502) may "ride on" vertical bars (590) as posts (504, 506) are raised to the extended position. In addition, vertical bars (590) of the present example are configured to substantially prevent cover plates (502) from getting snagged on horizontal member (508) and gate beams (520, 590) as posts (504, 506) are lowered to the retracted position. Vertical bars (590) may have any suitable width. In addition, any suitable number of vertical bars (590) may be used at any suitable positioning and spacing along horizontal member (508) and gate beams (520, 590). While vertical bars (590) are secured to the inner face of each flange (562) of gate beam (560) in the present example, it should be understood that vertical bars (590) may instead be secured to the top of each flange (562) of gate beam (560) and/or to the outer face of each flange (562) of gate beam (560). It should also be understood that, as described above with respect to barrier system (10), one or more cables, chains, rods, and/or linkages, etc., may be used to restrict the degree to which cover plates (502) may open and/or to assist in closing cover plates (502) as posts (504, 506) are lowered to the retracted position.

While a pair of pivoting cover plates (502) are shown, it will be appreciated that cover plates (502) may be varied or modified in a number of ways. For instance, a single hinged cover plate may be used. Furthermore, cover plates (502) may be modified to slide open, to swing downward into housing (510), or to open in any other suitable way. Other variations of cover plates (502) and methods of opening cover plates (502) will be apparent to those of ordinary skill in the art in view of the teachings herein.

B. Exemplary Guide Structures

Figure 24:
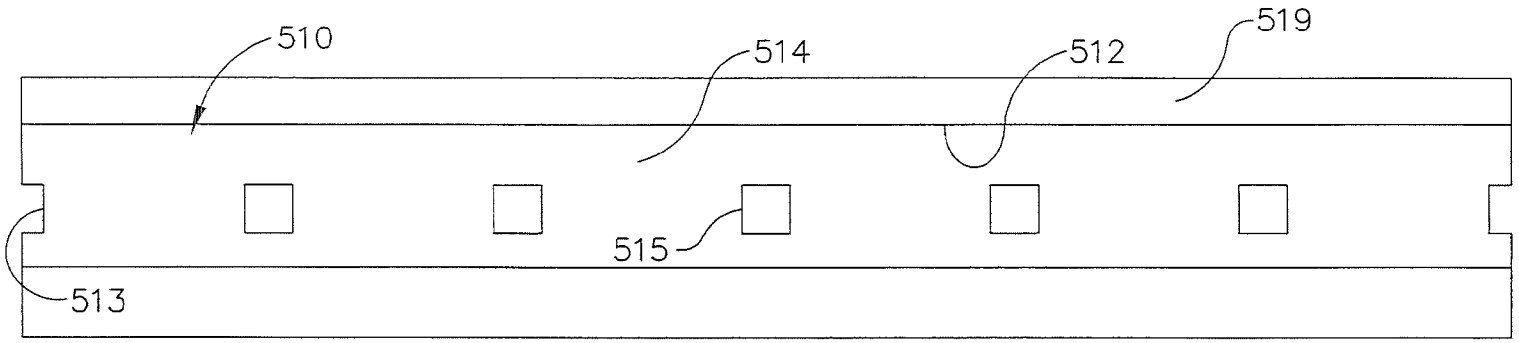
FIG. 24 is a top view of a housing of the system of FIG. 21.
Figure 25:
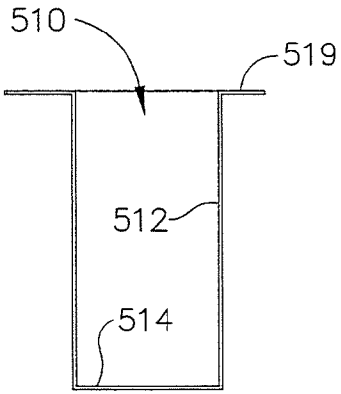
FIG. 25 is an end cross-sectional view of the housing of FIG. 24.
Figure 27:
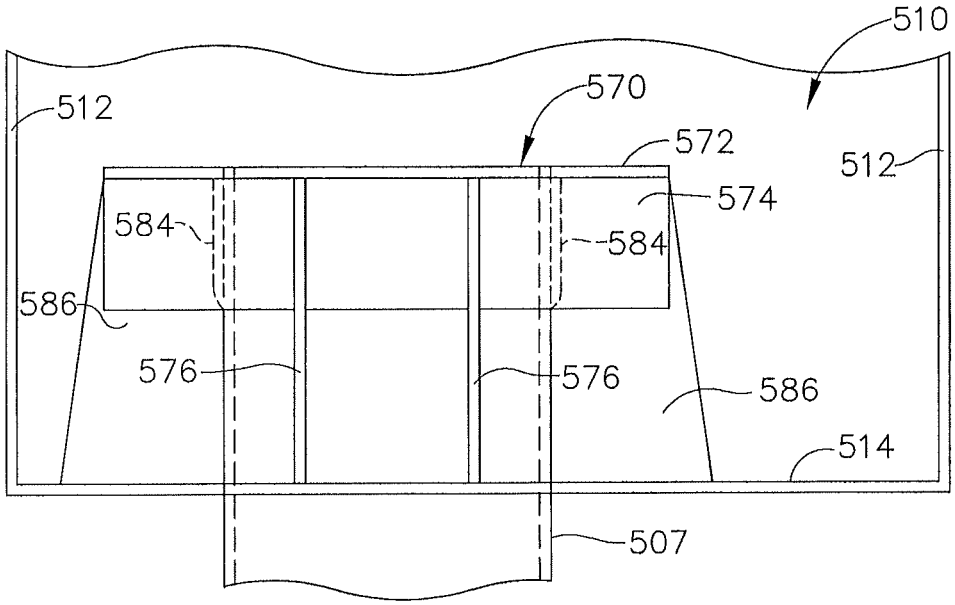
FIG. 27 is a side view of a tube support collar assembly of the system of FIG. 21.
Figure 28:
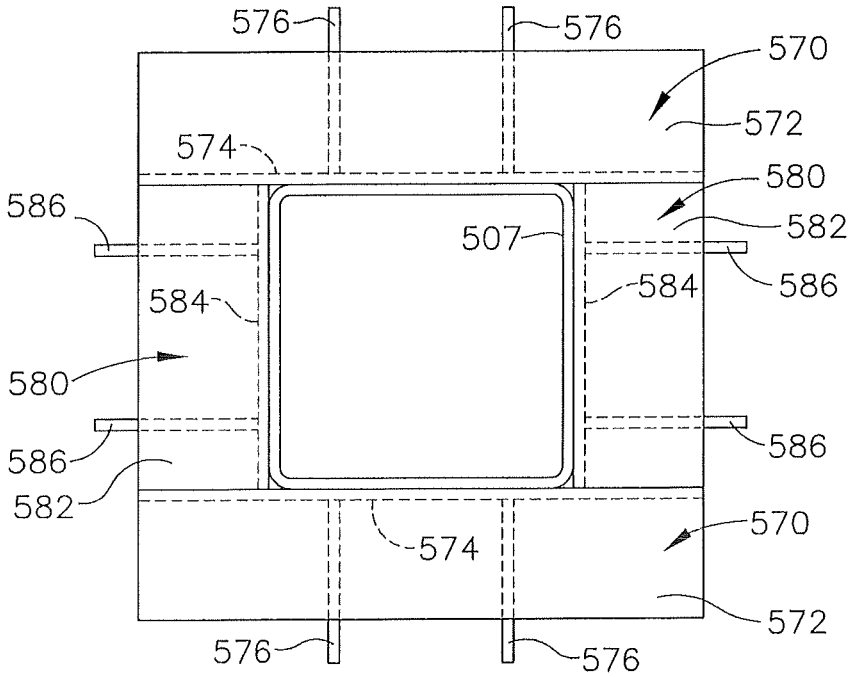
FIG. 28 is a top view of the tube support collar assembly of FIG. 27.

As shown in FIGS. 27-28 and 37-39, a plurality of post guides (505, 507) extend upwardly from floor (514) of housing (510). With reference to FIG. 24, post guides (505) are positioned in notches (513) at the outer ends of housing (510); while post guides (507) are positioned in openings (515) formed through floor (514) of housing (510). Post guides (505, 507) may comprise steel tubes having a square cross section. Alternatively, post guides (505, 507) may be formed of any other suitable material(s) and may have any other suitable cross section. As shown in FIGS. 27-28, each post guide (507) has a plurality of reinforcement members (570, 580) that collectively form a reinforcement collar about the portion of post guide (507) that protrudes upwardly from floor (514) of housing (510). In particular, a pair of transverse reinforcement members (570) extend transversely relative to the longitudinal axis defined by housing (510). Transverse reinforcement members (570) each include a vertically extending portion (574) that is welded to the exterior of post guide (507). Transverse reinforcement members (570) also each include a horizontally extending portion (572). Transverse reinforcement members (570) are each engaged with floor (514) of housing (510) via a respective pair of feet (576). Feet (576) are also welded to floor (514) in this example. Of course, reinforcement members (570) may be joined with post guide (507) and/or floor (514) in any other suitable fashion using any other suitable types of devices, components, features, or techniques. Optionally, post guides (505, 507) may include "I-beams" or other suitable structures secured within their interior for reinforcement.

A pair of longitudinal reinforcement members (580) extend substantially parallel to the longitudinal axis defined by housing (510). Reinforcement members (580) each include a vertically extending portion (584) that is welded to the exterior of post guide (507). Reinforcement members (580) also each include a horizontally extending portion (582). Reinforcement members (580) are each engaged with floor (514) of housing (510) via a respective pair of feet (586). Feet (586) are also welded to floor (514) in this example. Of course, reinforcement members (580) may be joined with post guide (507) and/or floor (514) in any other suitable fashion using any other suitable types of devices, components, features, or techniques. In the present example, reinforcement members (570, 580) are configured and arranged such that the top surfaces of horizontal portions (572) of reinforcement members (570) are substantially coplanar with each other and are substantially coplanar with horizontal portions (582) of reinforcement members (580). It should be understood that reinforcement members (570, 580) may have any other suitable components, configurations, and arrangements. It should also be understood that reinforcement members (570, 580) may provide bearing support for barrier system (500) and passing traffic when barrier system (500) is in the retracted position. Of course, post guides (507) and/or any other components of barrier system (500) may be supported or reinforced in any other suitable fashion.

Figure 26:
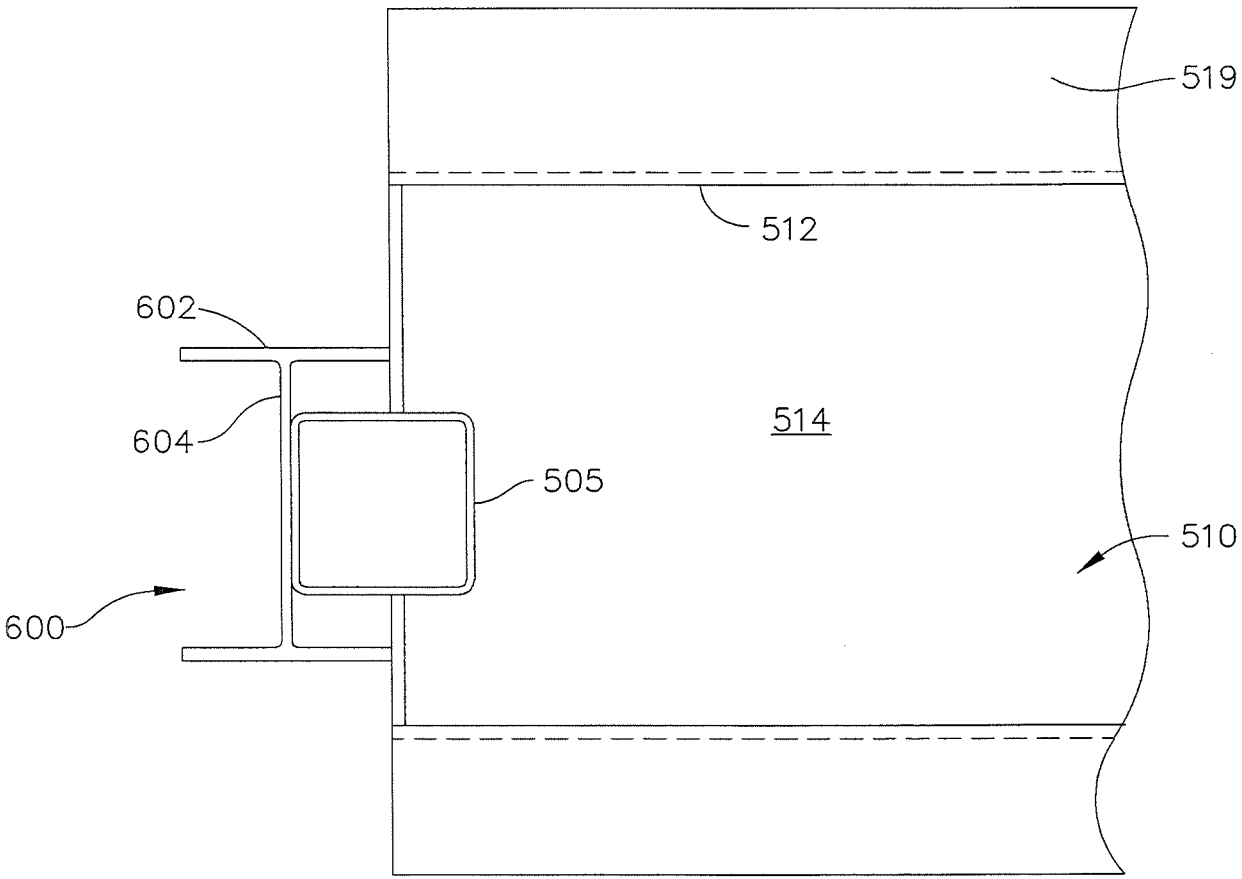
FIG. 26 is a partial, top view of an end portion of the system of FIG. 21.

As shown in FIG. 26 and as will be described in greater detail below, post guides (505) are engaged with static guides (600). In particular, post guides (505) are each welded to or otherwise secured to a central member (604) of a respective static guide (600).

Post guides (505, 507) are configured to receive posts (504, 506). In particular, posts (504) are inserted in post guides (505); while posts (506) are inserted into post guides (507). Post guides (505, 507) are configured to restrict lateral movement of posts (504, 506), while permitting posts (504, 506) to move vertically (e.g., reciprocate) within post guides (505, 507). While five posts (504) and two posts (506) are shown in the present example, it should be understood that any desired number of posts (504, 506) may be used. Likewise, any suitable number of post guides (505, 507) may be used. As shown in FIGS. 29, 32, and 35-36, a shim plate (690) is secured to the exterior of post (504*a*), and is configured to regulate the space between the exterior of post (504*a*) and the adjacent surface of central member of static guide (600). Of course, a plurality of shim plates (690) may be secured to exterior of post (504*a*) at different vertical heights if desired. It should also be understood that shim plates (690) may also be secured to the exteriors of posts (504, 506) to regulate the space between the exterior of posts (504, 506) and post guides (505, 507); and that such shim plates (690) may be placed at different vertical heights along each post (504, 506). For instance, in some versions, shim plates (690) are placed along the outer face of just one flange of each post (506); and shim plates (690) are also placed along an adjacent side of each post (506), spanning between the flanges and secured to both of the flanges. Similarly, shim plates (690) are placed along the outer faces of just two adjacent sides of posts (504*b*) in some versions. Other suitable arrangements will be apparent to those of ordinary skill in the art in view of the teachings herein. It should also be understood that shim plates (690) may be provided in any other barrier system (10, 300, 400) described herein. For instance, shim plates (690) may be provided on the exterior of one component that reciprocates within or adjacent to another component in any barrier system (10, 300, 400).

Post guides (505, 507) may have a height that is greater than the height of sidewalls (512), though post guides (505, 507) do not extend above sidewalls (512) in this example. For instance, while the upper rims of post guides (505, 507) may be positioned below the upper rims of sidewalls (512), the lower portions of post guides (505, 507) may extend below floor (514) of housing (510). In particular, the lower portions of post guides (505, 507) may be embedded in concrete (3) or in the ground, below floor (514). Alternatively, post guides (505, 507) may have any other desired length and position relative to housing (510). In addition, the lower end of each post guide (505, 507) may communicate with a drainage system, like post guides (120, 121) described above. Of course, a variety of other types of drainage systems may be provided; or barrier system (500) may even lack a drainage system.

As shown in FIGS. 21-23 and 37, a pair of static guides (600) are positioned outside of housing (510), on opposite ends of housing (510). Static guides (600) of the present example comprise steel I-beams having flanges (602) that extend from a central member (604). As shown in FIGS. 26 and 37, a post guide (505) abuts the central member (604) of each static guide (600). The lower ends of static guides (600) extend through concrete (3), below floor (514) of housing (510), such that the lower ends of static guides (130) are encased in concrete (3); while the upper ends of static guides (600) protrude above the ground. In the present example, a portion of the upper end each static guide (600) is attached with an adjacent concrete barrier wall (650) (e.g., a "Jersey Barrier" wall), such that the concrete barrier wall (650) is inserted between opposing flanges (602) and abuts central member (604). Static guide (600) may thus act as a cap piece for the end of barrier wall (650). For instance, when barrier system (500) is installed in a gap between preexisting concrete barrier walls (650), upper ends of static guides (600) may be bolted to or otherwise secured to adjacent concrete barrier walls (650) (e.g., a bolt inserted through opposing flanges (602) and through concrete barrier wall (650), etc.). As another merely illustrative example, when barrier system (500) is installed with new adjacent concrete barrier walls (650), the new concrete barrier walls (650) may be formed around or adjacent to static guides (600) such that static guides (600) are embedded in the new concrete barrier walls (650). Still other suitable ways in which the upper portions of static guides (600) may be laterally restrained will be apparent to those of ordinary skill in the art in view of the teachings herein.

Figure 23:
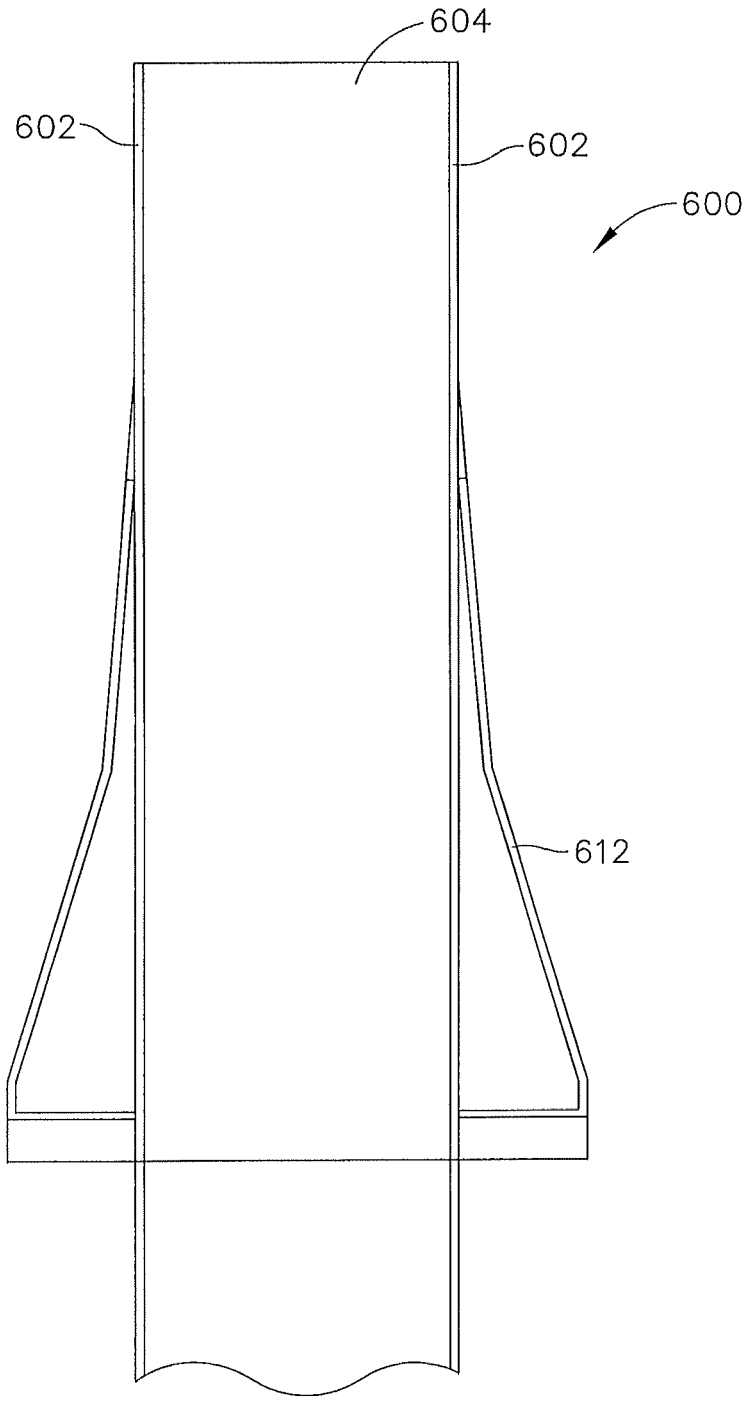
FIG. 23 is an end view of a barrier cap piece of the system of FIG. 21.

In the present example and as shown in FIGS. 21 and 23, each static guide (600) includes a pair of foot portions (612). In particular, foot portions (612) extend outwardly from the outer faces of flanges (602). As best seen in FIG. 21, foot portions (612) have a profile configured to mimic the profile of foot portion (652) of concrete barrier (650). Foot portions (652) thus provide a substantially smooth transition from concrete barrier (650) to static guide (600). In some versions, foot portions (652) include beveled edges and/or other structural features that are configured to avoid snow plow blades or the like getting snagged on foot portions (612). Of course, as with other components described herein, foot portions (612) are merely optional, and static guides (600) may have a variety of alternative components, features, and configurations.

C. Exemplary Horizontal Member Configurations

1. Exemplary Upper Horizontal Member Configuration

Figure 36:
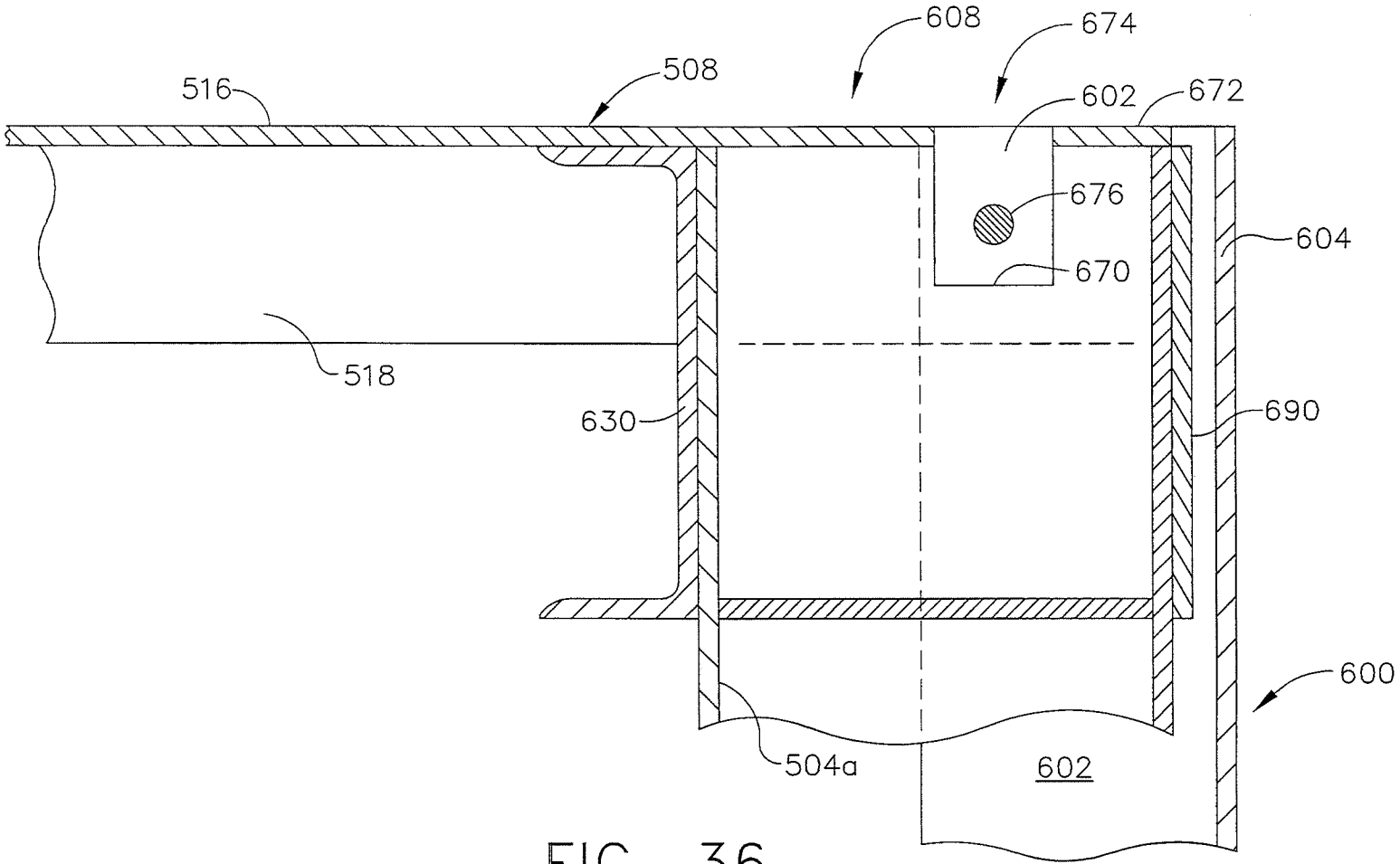
FIG. 36 is a side cross-sectional view of the barrier member retention assembly of FIG. 35.

Horizontal member (508) of the present example has a "U"-shaped cross-section, and comprises a horizontal section (516) and a pair of opposing, downwardly extending vertical sections (518). Horizontal section (516) of horizontal member (508) spans across the tops of posts (504, 506); and will raise and lower unitarily with posts (504, 506). As shown in FIG. 36, a bracket (630) is welded to post (504) and to horizontal member (508) to provide a secure connection between post (504) and horizontal member (508). Horizontal member (508) may be coupled with posts (506) in a similar fashion. However, it should be understood that posts (504, 506) and horizontal member (508) may alternatively be coupled in any other suitable fashion. While just a single horizontal member (508) is used in the present example, it should be understood that more than one horizontal member (508) may be used. For instance, two or more horizontal member (508) may be placed adjacent to each other at a substantially common vertical height relative to posts (504, 506). In addition or in the alternative, two or more horizontal members (508) may be placed at different vertical heights relative to posts (504, 506).

Horizontal member (508) of the present example is configured to cooperate with cover plates (502) to cover the opening defined by sidewalls (512) of housing (510), when barrier system (500) is in the undeployed configuration shown in FIG. 37. For instance, horizontal member (508) may provide structural support underneath closed cover plates (502). In addition or in the alternative, horizontal member (508) may substantially fill a gap between closed cover plates (502). As another merely illustrative example, cover plates (502) may be omitted, such that horizontal member (508) itself substantially covers the opening defined by sidewalls (512) of housing (510), when barrier system (500) is in the undeployed configuration. Other suitable relationships between horizontal member (508) and cover plates (502) will be apparent to those of ordinary skill in the art in view of the teachings herein.

Figure 35:
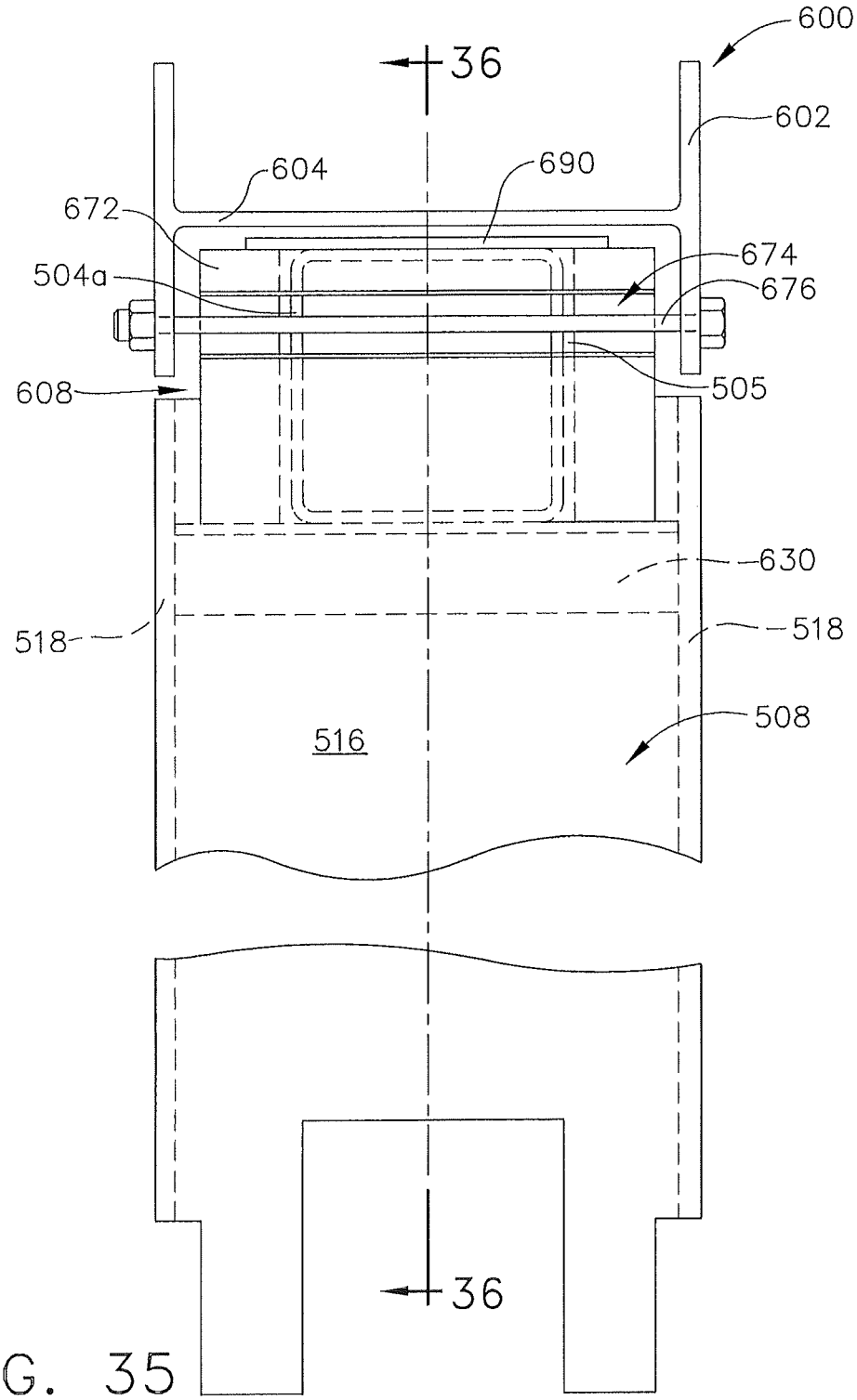
FIG. 35 is a top view of a barrier member retention assembly of the system of FIG. 21.

As shown in FIGS. 35-36, horizontal section (516) of horizontal member (508) includes a tab section (608) that extends toward central section (604) of static guide (600), between flanges (602) of static guide (600). A notch (670) is formed in the top of post (504), adjacent to tab section (608). A cap (672) is secured to the top of post (504), on the side of notch (670) opposite to tab section (608) of horizontal member (508). Tab section (608), notch (670), and cap (672) collectively define a gap (674) in the present example. This gap (674) is configured to receive a bolt (676), which is secured through opposing flanges (602) of static guide (600). In particular, gap (674) and bolt (674) are sized, configured, and aligned such that bolt (676) will be positioned within gap (674) when barrier system (500) is actuated to the deployed configuration in FIG. 21. Such positioning of bolt (676) within gap (674) may reduce the likelihood of (if not prevent the occurrence of) portions of barrier system (500) getting dislodged from their registered positions when a vehicle strikes barrier system (500). For instance, the positioning of bolt (676) within gap (674) may prevent horizontal member (508) from passing over the top of static guide (600) when a vehicle strikes barrier system (500), and may substantially maintain a substantially coplanar relationship between barrier system (500) and adjacent concrete barriers (650). In some versions, bolt (676) is removable to allow removal of horizontal member (508) and other components of an installed barrier system (500) (e.g., for maintenance or replacement of parts, etc.); while also providing structural security to central member (604) of static guide (600) and barrier wall (650). Of course, a variety of alternative structures (removable or non-removable) and configurations may be used in addition to or in lieu of bolt (676) and gap (674).

2. Exemplary Gate Beam Configurations

In the present example, and as best shown in FIGS. 21-22, gate beams (520, 560) comprise a wide gate beam (560) and relatively narrower gate beams (520). Gate beam (560) is positioned vertically lower than gate beams (520). The size and arrangement of gate beams (520, 560) are configured to substantially mimic the profile of a preexisting concrete barrier (650). However, it should be understood that any other suitable sizes, arrangements, and configurations may be used. For instance, some versions of barrier system (500) may include gate beams (520, 560) that all have approximately the same width. Gate beams (520, 560) of the present example all comprise steel I-beams. In particular, gate beams (520) each comprise vertically oriented flanges (522) and horizontally oriented webs (524). Similarly, gate beam (560) comprises vertically oriented flanges (562) and horizontally oriented web (564). It should be understood, however, that gate beams (520, 560) may alternatively have any other suitable configurations and that any other suitable material(s) may be used to form gate beams (520, 560).

Figure 29:
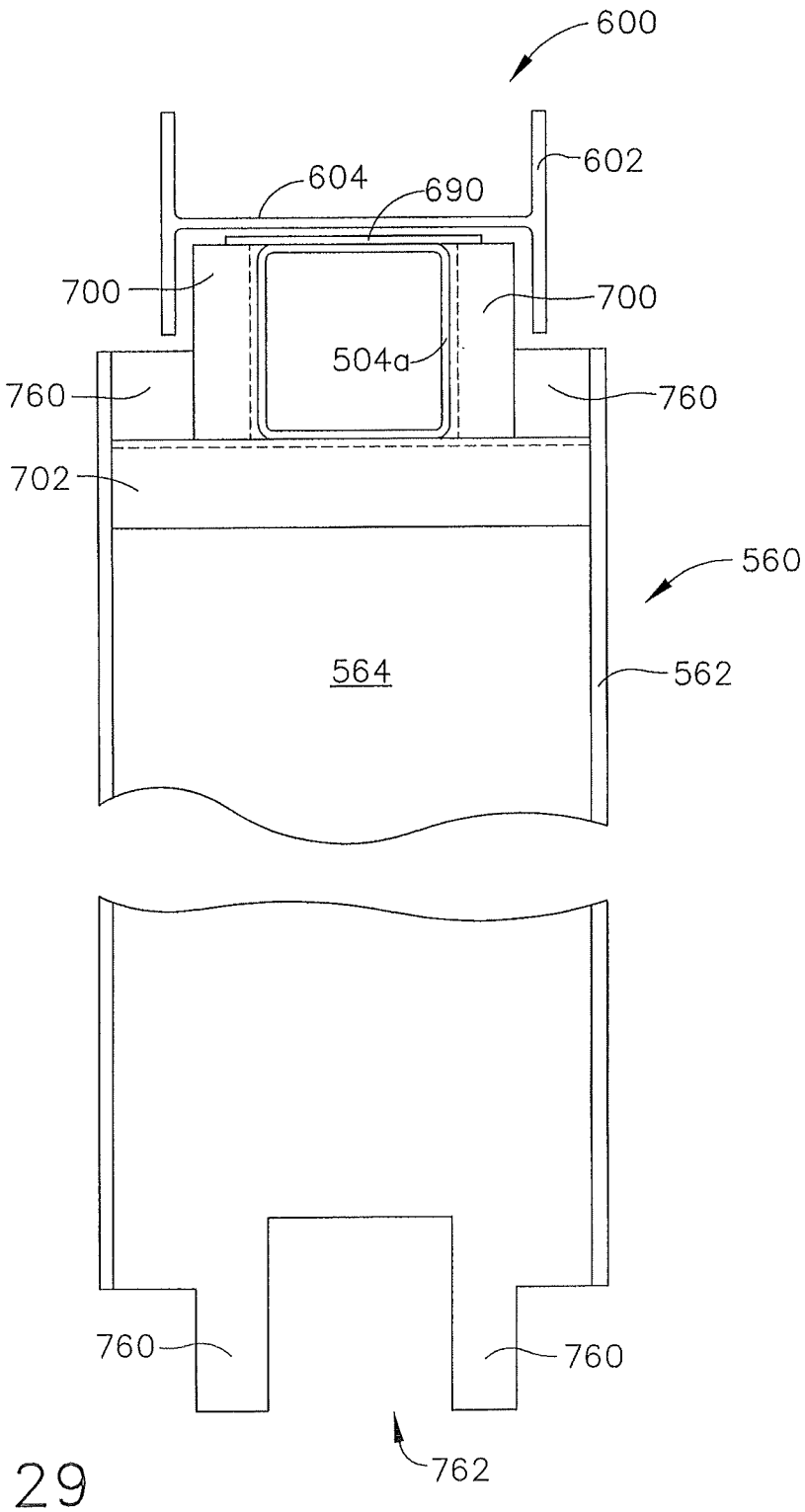
FIG. 29 is a partial top view of a first barrier member of the system of FIG. 21.
Figure 30:
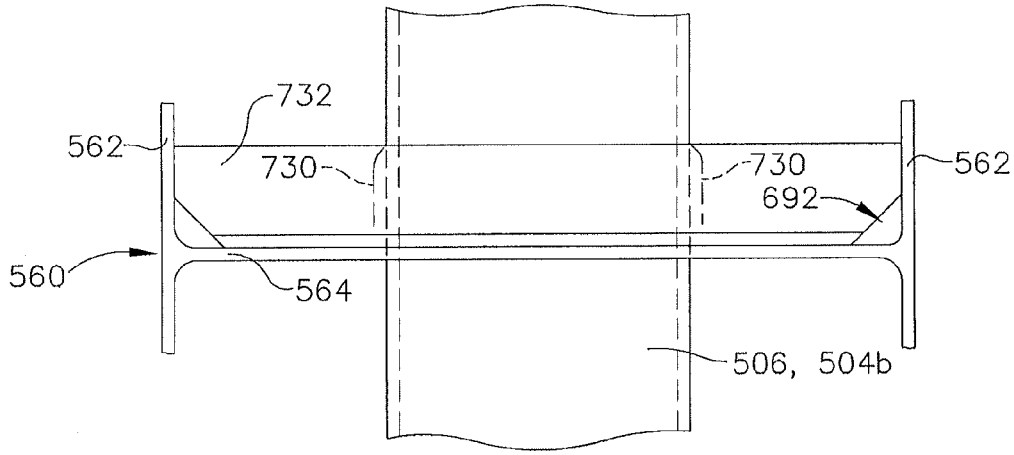
FIG. 30 is a side view of a support collar assembly for the first barrier member of FIG. 29.
Figure 31:
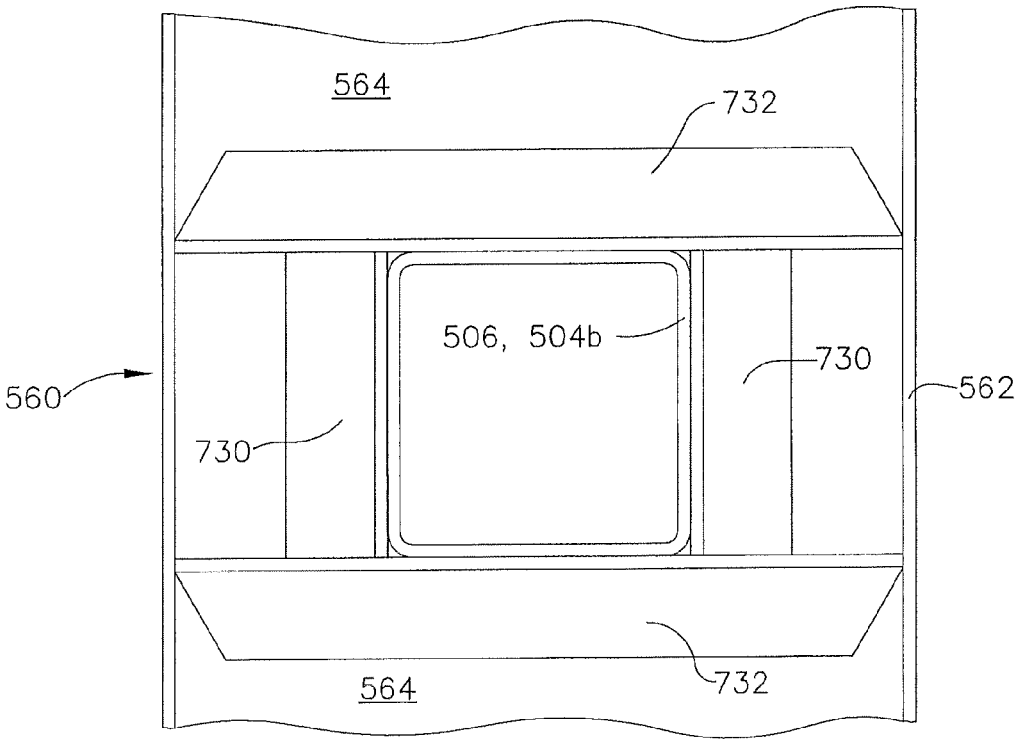
FIG. 31 is a top view of the support collar assembly of FIG. 30.

Gate beams (520, 560) are coupled with posts (504, 506) via collar assemblies in the present example. For instance, FIG. 29 shows structures for coupling gate beam (560) with outermost posts (504*a*); while FIGS. 30-31 show structures for coupling gate beam (560) with posts (506) and inner posts (504*b*). As shown in FIG. 29, a notch (762) is formed in web (564) of gate beam (560), permitting arms (760) of gate beam (560) to extend along sides of post (504*a*), with portions of arms (760) fitting between flanges (602) of static guide (600). In addition, structural channels (700) are secured to opposing sides of post (504*a*), and are secured to the top surfaces of arms (760) of gate beam (560). Furthermore, an additional structural channel (702) is secured to post (504*a*). This additional structural channel (702) is perpendicular to structural channels (700) and extends along part of the width of web (564). Structural channel (702) is also secured to the top surface of web (564*a*). Structural channels (700, 702) thus form a partial collar around post (504*a*), for engaging and supporting gate beam (560). Gate beam (560) is thus secured to post (504*a*) via structural channels (700, 702). In the present example, structural channels (700, 702) are secured to post (504*a*) and gate beam (560) via welding. However, it should be understood that structural channels (700, 702) may be secured to post (504*a*) and/or gate beam (560) using any other suitable devices, structures, features, or techniques. In some versions, the underside of gate beam (560) is exposed and simply rests on the upper rims of post guides (505, 507) when posts (504, 506) are retracted within post guides (505, 507). Various other suitable ways in which gate beam (560) may be secured to or otherwise engage with post (504*a*), including versions lacking structural channels (700, 702), will be apparent to those of ordinary skill in the art in view of the teachings herein.

FIGS. 30-31 show a collar assembly whereby posts (506) and inner posts (504*b*) support gate beam (560). The collar assembly in this example comprises a pair of structural angles (730) that are secured to posts (506, 504*b*) and that run parallel to the longitudinal axis defined by housing (510). In addition, a pair of structural angles (732) are secured to posts (506, 504*b*) and run transverse to the longitudinal axis defined by housing (510). Structural angles (730, 732) together provide a platform for engaging the top of web (564). In particular, web (564) has openings (not shown) that are configured to insertingly receive posts (506, 504*b*), such that web (564) may be slid down posts (506, 504*b*). Structural angles (730, 732) are then welded or otherwise secured to posts (506, 504*b*) and the top surface of web (564). As noted above, the underside of gate beam (560) is exposed and simply rests on the upper rims of post guides (505, 507) when posts (504, 506) are retracted within post guides (505, 507). In some versions, gate beam (560) is provided in separate pieces, with such pieces being broken at one or more posts (506, 504*b*). In other words, such pieces may be positioned between adjacent posts (506, 504*b*) and then be secured to structural angles (730, 732), such that gate beam (560) need not necessarily be slid down all posts (506, 504*b*) simultaneously. Various other suitable ways in which gate beam (560) may be secured to or otherwise engage with posts (506) and inner posts (504*b*) will be apparent to those of ordinary skill in the art in view of the teachings herein.

In the present example, structural angles (732) have clipped ends such that structural angles (732) and gate beam (560) together define gaps (692) as shown in FIG. 30. Such gaps (692) may facilitate rain water drainage along the length of web (564). Of course, as with other features described herein, gaps (692) are merely optional.

Figure 32:
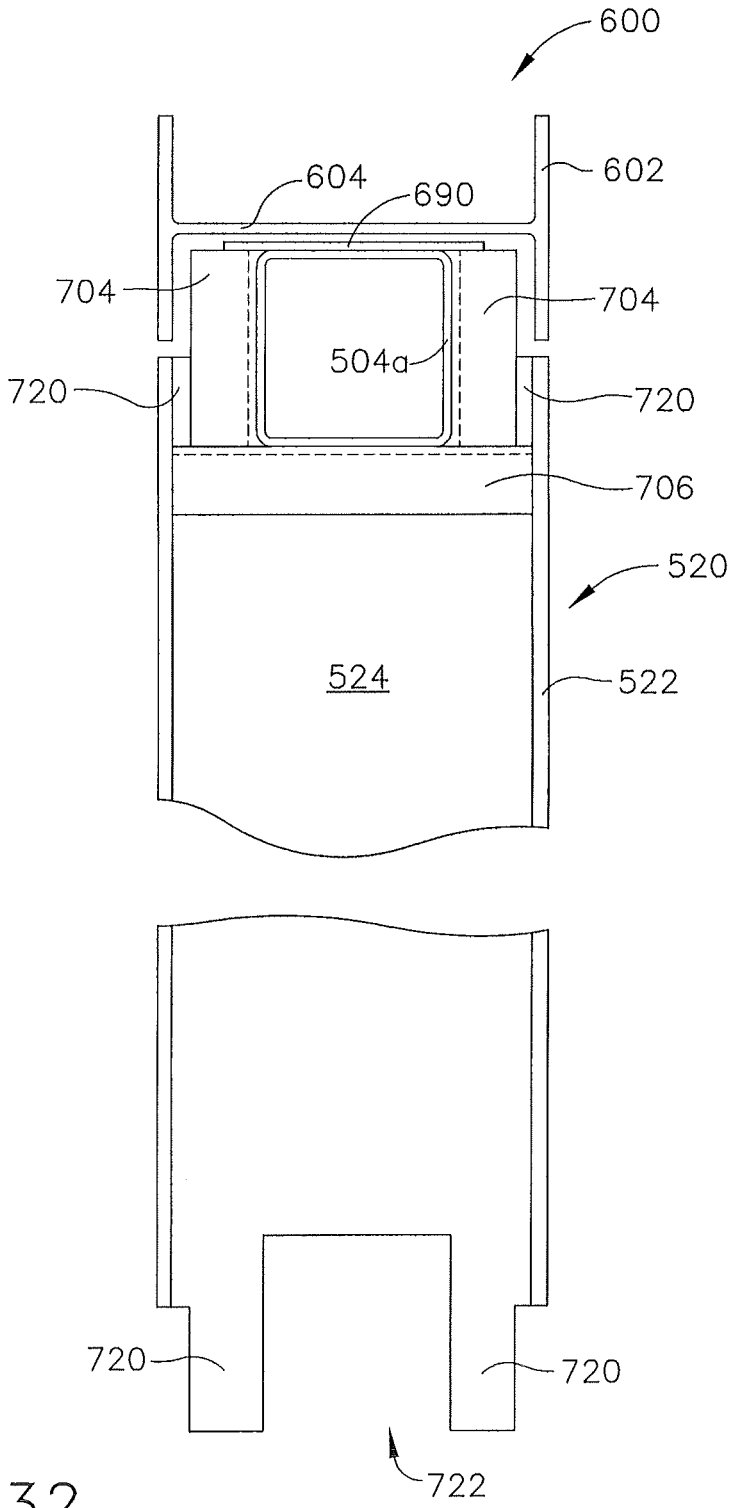
FIG. 32 is a partial top view of a second barrier member of the system of FIG. 21.
Figure 33:
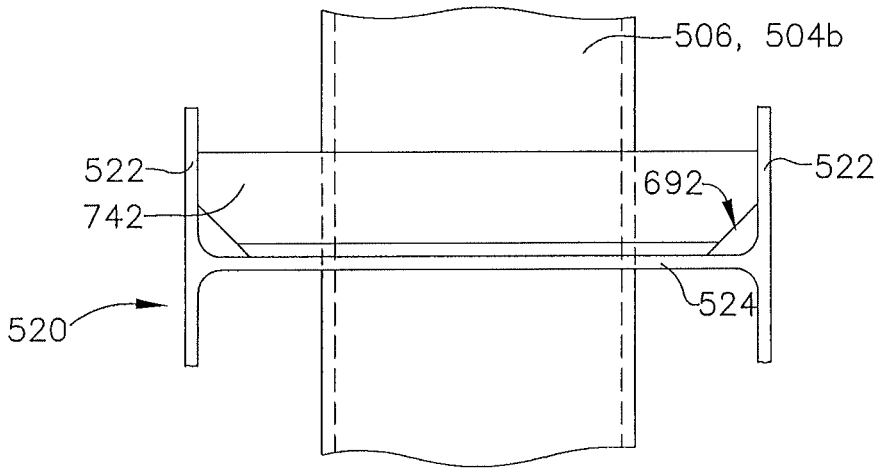
FIG. 33 is a side view of a support collar assembly for the second barrier member of FIG. 32.
Figure 34:
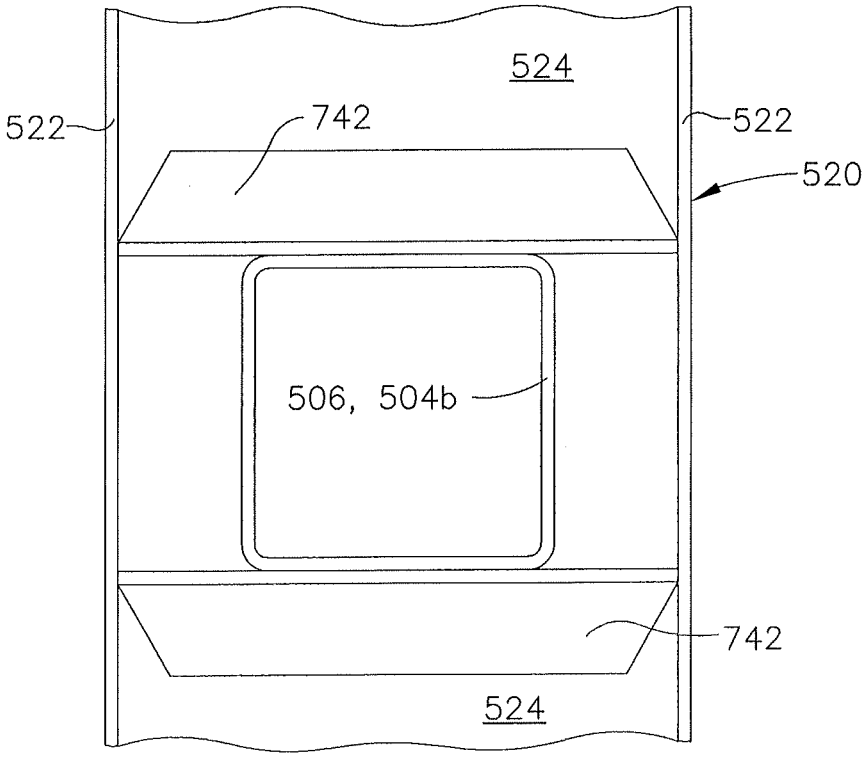
FIG. 34 is a top view of the support collar assembly of FIG. 33.

FIG. 32 shows structures for coupling gate beam (520) with outermost posts (504*a*); while FIGS. 33-34 show structures for coupling gate beam (520) with posts (506) and inner posts (504*b*). As shown in FIG. 32, the coupling of gate beam (520) with outermost post (504*a*) is substantially similar to the coupling of gate beam (560) with post (504*a*). In particular, a notch (722) is formed in web (524) of gate beam (520), permitting arms (720) of gate beam (520) to extend along sides of post (504*a*), with portions of arms (720) fitting between flanges (602) of static guide (600). In addition, structural angles (704) are secured to opposing sides of post (504), and are secured to the top surfaces of arms (720) of gate beam (520). Furthermore, an additional structural angle (706) is secured to post (504*a*). This additional structural angle (706) is perpendicular to structural angles (704) and extends along part of the length of web (524). Structural angle (706) is also secured to the top surface web (524). Additional structural angles (704, 706) may also be secured to the bottom surfaces of arms (720) and web (524), such that the engagement features on the bottom side of gate beam (520) are substantially identical to the engagement features on the top side of gate beam (520). Structural angles (704, 706) thus form a partial collar around post (504*a*), for engaging and supporting gate beam (520). Gate beam (520) is thus secured to post (504*a*) via structural angles (704, 706). In the present example, structural angles (704, 706) are secured to post (504*a*) and gate beam (520) via welding. However, it should be understood that structural angles (704, 706) may be secured to post (504) and/or gate beam (520) using any other suitable devices, structures, features, or techniques. In some versions, gate beam (520) simply rests on a collar provided by structural angles (704, 706), without necessarily being secured to structural angles (704, 706) via welding or otherwise. Various other suitable ways in which gate beam (520) may be secured to or otherwise engage with post (504), including versions lacking structural angles (704, 706), will be apparent to those of ordinary skill in the art in view of the teachings herein.

FIGS. 33-34 show a partial assembly whereby posts (506) and inner posts (504*b*) support gate beam (520). The partial collar assembly in this example comprises a pair of structural angles (742) that are secured to posts (506, 504*b*) and that run transverse to the longitudinal axis defined by housing (510). Structural angles (742) together provide a partial platform for engaging web (524). In particular, web (524) has openings (not shown) that are configured to insertingly receive posts (506, 504*b*), such that web (524) may be slid down posts (506, 504*b*). Structural angles (742) are then welded or otherwise secured to posts (506, 504*b*) and the top surface of web (524). Optionally, additional structural angles (742) may be secured to the bottom surface of web (524), such that the engagement features on the bottom side of gate beam (520) are substantially identical to the engagement features on the top side of gate beam (520). In some versions, gate beam (520) is provided in separate pieces, with such pieces being broken at one or more posts (506, 504*b*). In other words, such pieces may be positioned between adjacent posts (506, 504*b*) and then be secured to structural angles (742), such that gate beam (520) need not necessarily be slid down all posts (506, 504*b*) simultaneously. Various other suitable ways in which gate beam (520) may be secured to or otherwise engage with posts (506) and inner posts (504*b*) will be apparent to those of ordinary skill in the art in view of the teachings herein.

In the present example, structural angles (742) have clipped ends such that structural angles (742) and gate beam (520) together define gaps (692) as shown in FIG. 33. Such gaps (692) may facilitate rain water drainage along the length of web (524). Of course, as with other features described herein, gaps (692) are merely optional.

D. Exemplary Deployment and Retraction System

Figure 38:
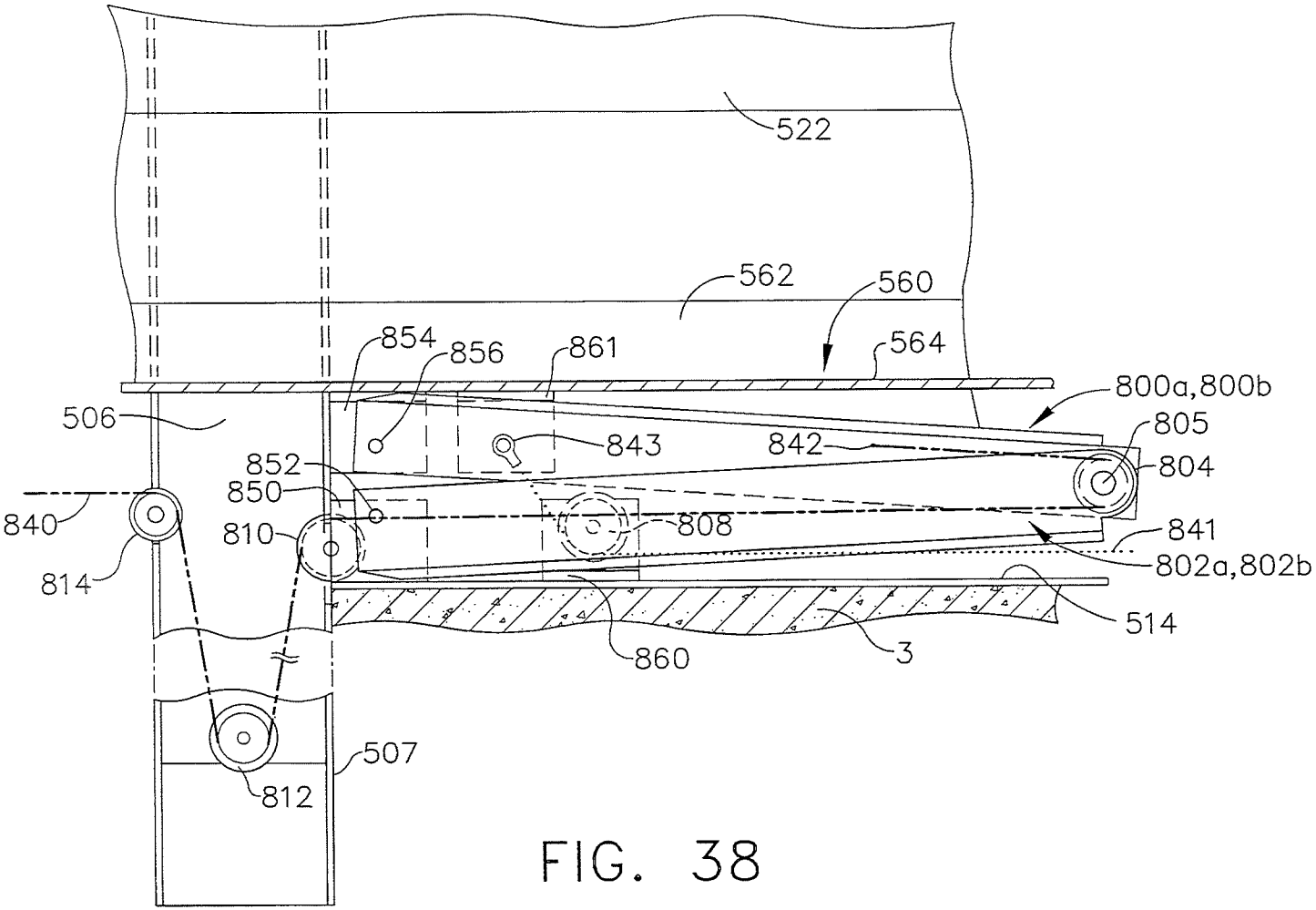
FIG. 38 is a side view of an exemplary support member assembly, with the support members in a folded configuration.
Figure 39:
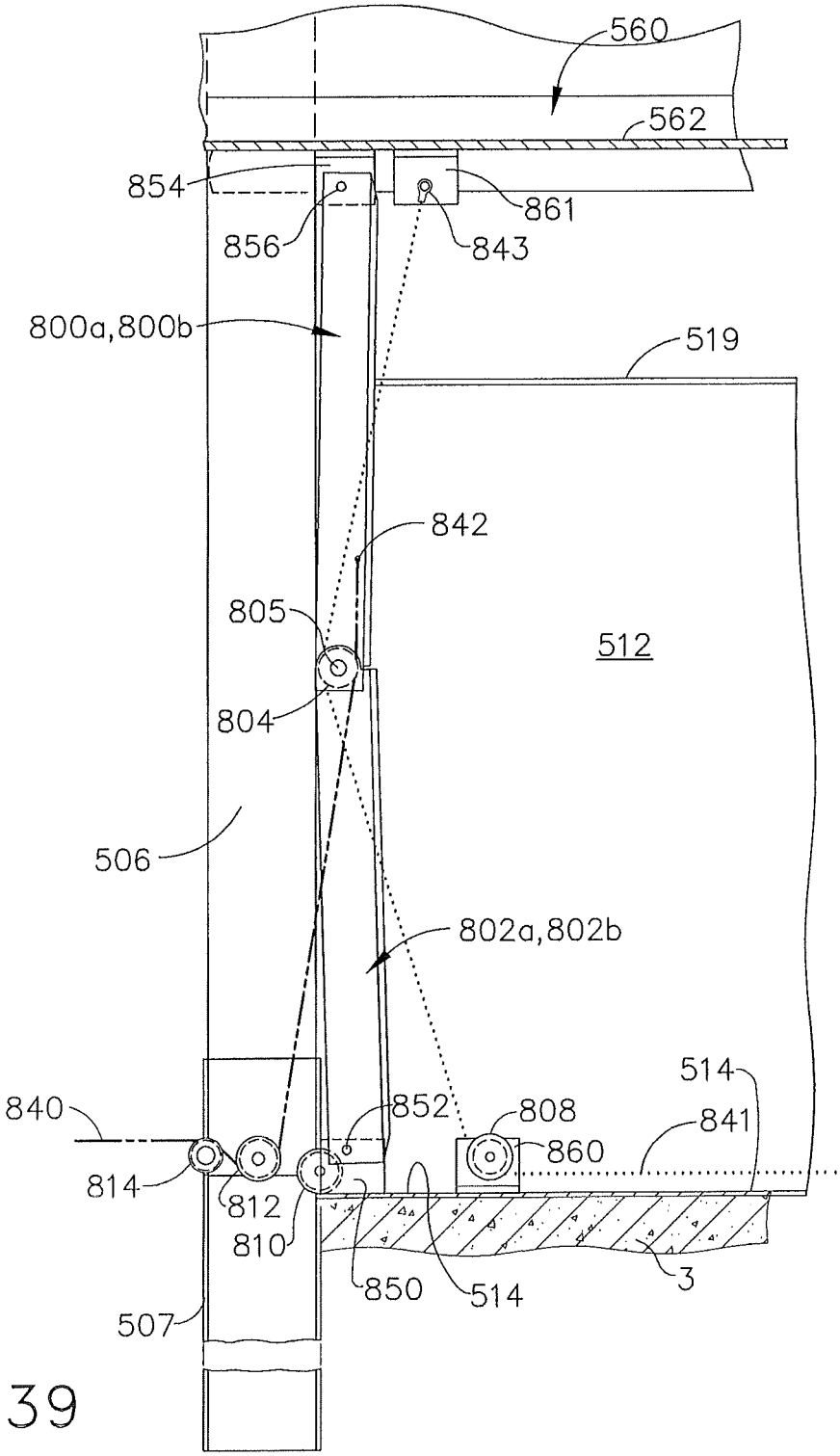
FIG. 39 is a side view of the support member assembly of FIG. 38, with the support members in an unfolded, hyper-extended configuration to support a deployed barrier.

In some respects, barrier system (500) of the present example is raised and lowered in a manner similar to the manner in which barrier system (10) described above is raised and lowered. As noted above, vertical posts (504, 506) are operable to reciprocate relative to housing (510), within their respective post guides (505, 507). As also noted above, vertical posts (506) of the present example comprise "I-beams"; while vertical posts (504) comprise square or rectangular tubes in the present example. FIGS. 38-39 show exemplary components that may be used to raise posts (504, 506) and horizontal members (508, 520, 560) to the deployed position;

and to lower posts (504, 506) and horizontal members (508, 520, 560) back to the retracted position. It should be noted that several components are omitted from FIGS. 38-39 for clarity, including reinforcement members (570, 580) about post guide (507) and structural angles (730, 732) about post (506). Various ways in which such omitted items may fit in barrier system (500) with the below described components for raising/lowering posts (504, 506) and horizontal members (508, 520, 560) will be apparent to those of ordinary skill in the art in view of the teachings herein.

Like barrier system (10) described above, barrier system (500) may include a winch (not shown). Such a winch may be secured to, within, or external to housing (510) (e.g., in the ground); and may receive power from a source in a local compartment or elsewhere. The winch in the present example is in communication with cables (540, 541), which are shown in FIGS. 38-39. In particular, deployment cable (540) extends from the top of the drum of the winch; while retraction cable (541) extends from the bottom of the drum of the winch. Cables (540, 541) and the winch are configured such that, when the winch is rotated in a first direction, cable (540) is pulled by the winch while cable (541) is released from the winch. Likewise, when the winch is rotated in a second direction, cable (541) is pulled by the winch while cable (540) is released from the winch. As will be described in greater detail below, these corresponding actions of cables (540, 541) may provide raising/deployment or lowering/retraction of posts (506), depending on the direction in which the winch rotates.

In some versions, cables (540, 541) are simply opposing ends of a single, unitary cable. In other versions, cables (540, 541) are two separate cables that are coupled with the same winch. In some other versions, cables (540, 541) are two separate cables that are each coupled with their own corresponding winch, such that two winches are provided. Of course, any other suitable number of cables (540, 541) and winches may be used; and cables (540, 541) and winches may have any other suitable relationships. Furthermore, any suitable alternative, substitute, or supplement for cables (540, 541) and/or winch may be used.

While FIGS. 38-39 show deployment and retraction components for just one post (506), it should be understood that the other post (506) may be deployed and retracted in a similar fashion. For instance, cables (540, 541) may each be coupled with one or more respective devises (or other components), and additional cables may be coupled with such devises (or other components) to provide simultaneous movement of several cables. Such additional cables may be fed around additional pulleys in a manner similar to that described above with respect to barrier system (10). Various ways in which the following teachings of deployment and retraction components may be applied to both posts (506) simultaneously will be apparent to those of ordinary skill in the art in view of the teachings herein.

Figure 40A:
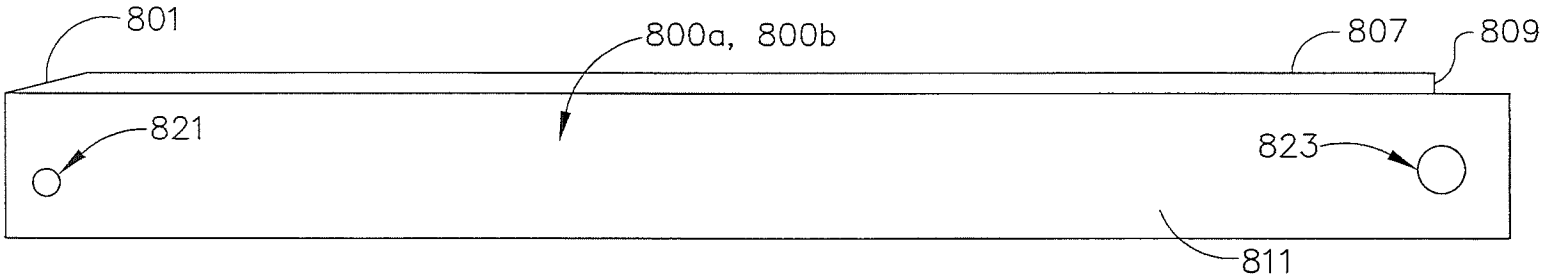
FIGS. 40A-40B are side views of the support members of the support member assembly of FIG. 38.
Figure 41:
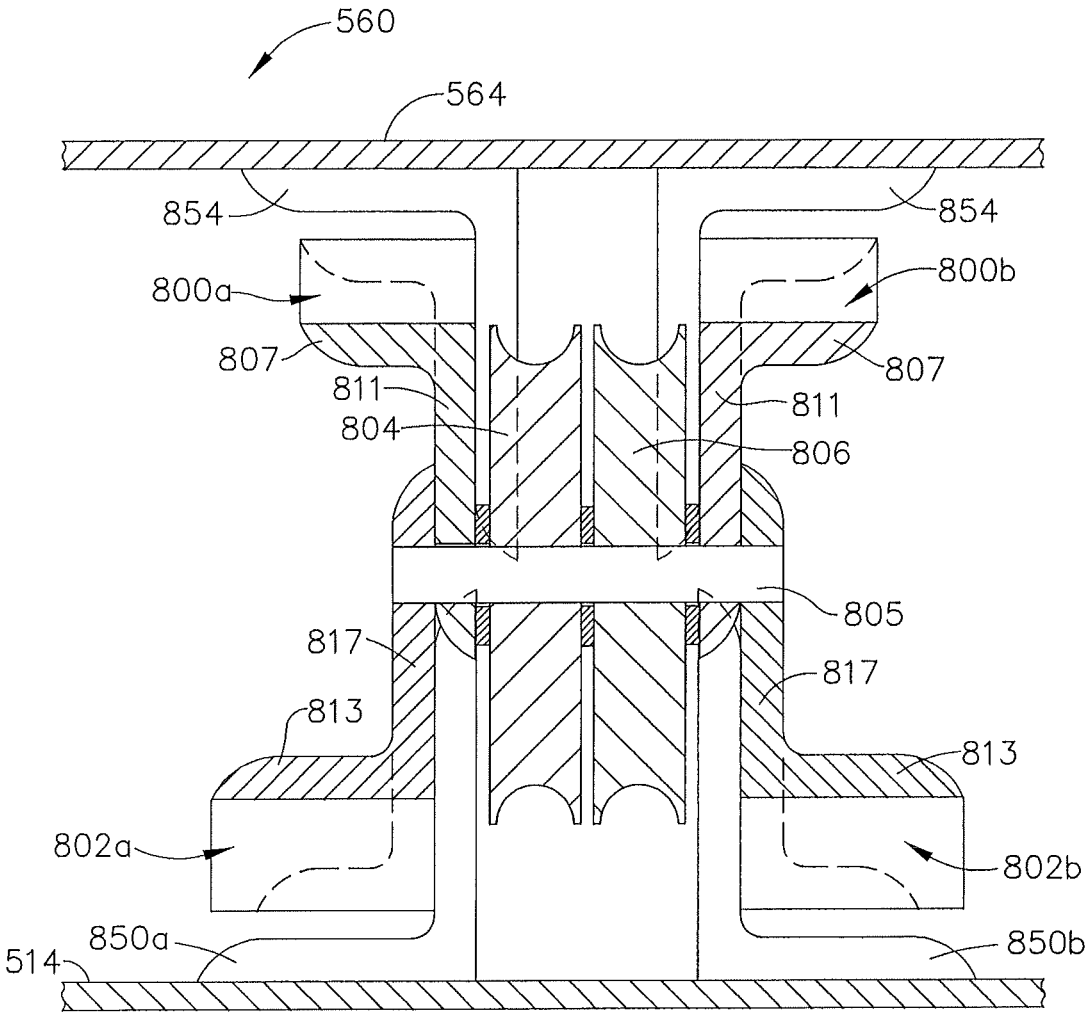
FIG. 41 is an end view of the support member assembly of FIG. 38.

As shown in FIGS. 38-39 and 41, barrier system (500) includes a first pair of scissor arms (800*a*, 800*b*) that is coupled with a second pair of scissor arms (802*a*, 802*b*). Scissor arms (800*a*, 800*b*, 802*a*, 802*b*) are used to assist in raising of posts (506, 504) and horizontal members (508, 520, 560), and to hold posts (506, 504) and horizontal members (508, 520, 560) in the raised/deployed position, as will be described in greater detail below. As shown in FIGS. 40A and 41, scissor arms (800*a*, 800*b*) are formed of structural angles, and each scissor arm (800*a*, 800*b*) comprises a vertically extending portion (811) and a transverse portion (807). Each scissor arm (800*a*, 800*b*) is pivotally coupled with gate beam (560) via a respective bracket (854). In particular, brackets (854) comprise structural angles welded to (or otherwise secured to) the underside of web (564) of gate beam (560). The vertically extending portion (811) of each scissor arm (800*a*, 800*b*) is pivotally coupled with its respective bracket (854) by a pin (856) inserted through an opening (821) formed in vertically extending portion (811). Pin (856) may take a variety of forms, including but not limited to a bolt, etc. Each scissor arm (800*a*, 800*b*) is rotatable about pin (856), relative to gate beam (560). In some versions, a single pin (856) is used to couple both scissor arms (800*a*, 800*b*) with both brackets (854). In some other versions, separate pins (856) are used to individually couple each scissor arm (800*a*, 800*b*) with its respective bracket (854).

Figure 40B:
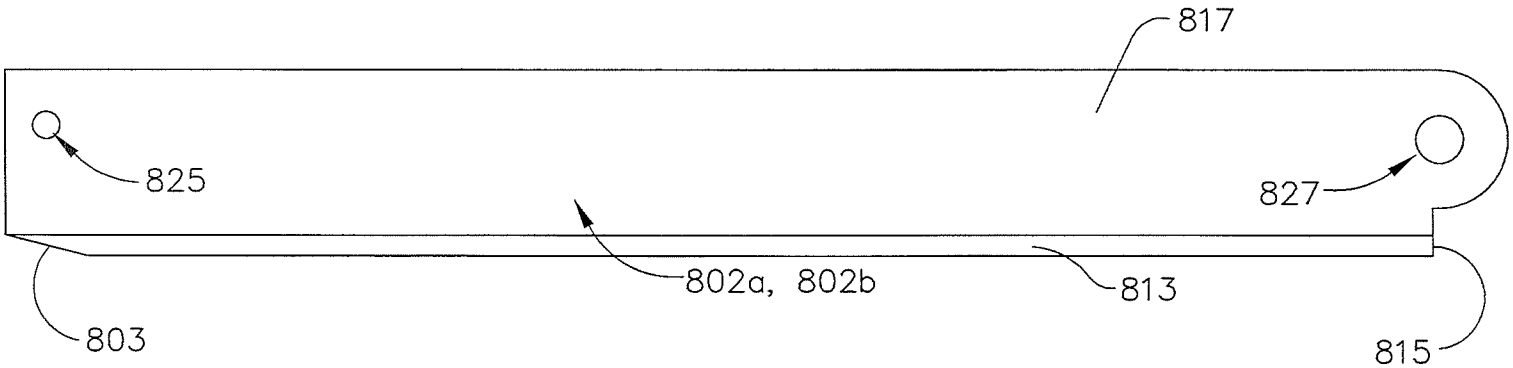

Similarly, as shown in FIGS. 40B and 41, scissor arms (802*a*, 802*b*) are formed of structural angles, and each scissor arm (802*a*, 802*b*) comprises a vertically extending portion (817) and a transverse portion (813). Each scissor arm (802*a*, 802*b*) is pivotally coupled with floor (514) of housing (510) via a respective bracket (850). In particular, brackets (850) comprise structural angles welded to (or otherwise secured to) floor (514) of housing (510). The vertically extending portion (817) of each scissor arm (802*a*, 802*b*) is pivotally coupled with its respective bracket (850) by a pin (852) inserted through an opening (825) formed in vertically extending portion (817). Pin (850) may take a variety of forms, including but not limited to a bolt, etc. Each scissor arm (802*a*, 802*b*) is rotatable about pin (850), relative to floor (514) of housing (510). In some versions, a single pin (852) is used to couple both scissor arms (802*a*, 802*b*) with both brackets (850). In some other versions, separate pins (852) are used to individually couple each scissor arm (802*a*, 802*b*) with its respective bracket (850).

In addition to the above noted pivotal couplings, scissor arms (800*a*, 800*b*) are also pivotally coupled with scissor arms (802*a*, 802*b*). In particular, and as best seen in FIG. 41, scissor arms (800*a*, 800*b*) are pivotally coupled with scissor arms (802*a*, 802*b*) by a pin (805). Pin (805) may take a variety of forms, including but not limited to a bolt, etc. With reference to FIGS. 40A and 40B, vertically extending portion (811) of each scissor arm (800*a*, 800*b*) includes an opening (823) configured to receive pin (805). Likewise, vertically extending portion (817) of each scissor arm (802*a*, 802*b*) includes an opening (827) configured to receive pin (805). Accordingly, each pair of scissor arms (800*a*, 800*b*, 802*a*, 802*b*) is rotatable about pin (805), relative to the other pair of scissor arms (802*a*, 802*b*, 800*a*, 800*b*). The above described pivotal couplings permit scissor arms (802*a*, 802*b*, 800*a*, 800*b*) to move between a folded configuration as shown in FIG. 38 and a hyper-extended configuration as shown in FIG. 39. Such movement will be described in greater detail below.

As shown in FIGS. 38-39, a pair of pulleys (810, 814) are positioned at the top of post guide (507). For instance, a respective bolt may pass through each pulley (810, 814) and secure each pulley (810, 814) to post guide (507). Each such bolt may provide an axis of rotation for its corresponding pulleys (810, 814). In particular, the axis of rotation for each pulley (810, 814) is a horizontal axis that extends laterally transversely to the longitudinal axis defined by housing (510) in the present example (e.g., pulleys (810, 814) each rotate about an axis that intersects both long sidewalls (512)). In addition, a pulley (812) is positioned at the bottom of post (506), and may be secured to post (506) by a bolt or any other suitable structure. Pulley (812) is similar to pulley (169) described above in the context of barrier system (10). Pulley (812) is also configured to rotate about a horizontal axis that extends laterally transversely to the longitudinal axis defined by housing (510) in the present example (e.g., pulley (812) rotates about an axis that intersects both long sidewalls (512)).

As also shown in FIGS. 38-39, another pulley (808) is secured to floor (514) of housing (510) by a bracket (860). Bracket (860) may comprise a structural angle or other structure welded to (or otherwise secured to) floor (514) of housing. For instance, a bolt may pass through pulley (808) and bracket (860) to secure each pulley (808) to bracket (860). Such a bolt may provide an axis of rotation for corresponding pulley (808), with such an axis being horizontal and extending laterally transversely to the longitudinal axis defined by housing (510) in the present example (e.g., pulley (808) rotates about an axis that intersects both long sidewalls (512)). Furthermore, as shown in FIGS. 38-39 and 41, a pair of pulleys (804, 806) are provided at the pivotal coupling between pair of scissor arms (800*a*, 800*b*) and pair of scissor arms (802*a*, 802*b*). In particular, pin (805) passes through pulleys (804, 806) and provides an axis of rotation for pulleys (804, 806). Such an axis of rotation is horizontal and extends laterally transversely to the longitudinal axis defined by housing (510) in the present example (e.g., pulleys (804, 806) each rotate about an axis that intersects both long sidewalls (512)).

In the present example, deployment cable (840) extends from the winch to reach pulley (814). Of course, deployment cable (840) may first encounter one or more additional pulleys after the winch, before reaching pulley (814). Deployment cable (840) goes over and around the top portion of pulley (814), and pulley (814) redirects deployment cable (840) downward to reach pulley (812). Pulley (812) then redirects deployment cable (840) upwardly to reach pulley (810). After passing over pulley (810), deployment cable (840) continues toward pulley (804). After wrapping around part of pulley (804), deployment cable (840) terminates at scissor arm (800*a*). In particular, the free end of deployment cable (840) is secured to scissor member (800*a*) at a coupling (842). Such a coupling (842) may be provided on the vertically extending portion (811) of scissor arm (800*a*) or the transverse portion (807) of scissor arm (800*a*). Various forms that coupling (842) may take will be apparent to those of ordinary skill in the art in view of the teachings herein.

It should be understood that, with post (506) starting at the vertically down position, retracted in post guide (507), scissor arms (800*a*, 800*b*, 802*a*, 802*b*) start in the folded position as shown in FIG. 38. When the winch pulls on deployment cable (840) (in a direction to the left in the view shown in FIGS. 38-39), the tension in deployment cable (840) initially moves post (506) upward by pushing upward on pulley (812). In addition, such pulling on deployment cable (840) urges the pivotal junction of scissor arms (800*a*, 800*b*) with scissor arms (802*a*, 802*b*) toward post (506). Such urging of the pivotal junction of scissor arms (800*a*, 800*b*) with scissor arms (802*a*, 802*b*) toward post (506) causes scissor arms (800*a*, 800*b*, 802*a*, 802*b*) to "unfold," which may in turn assist in the lifting of post (506), due to the shared connection of scissor arms (800*a*, 800*b*) and post (506) with gate beam (560). Post (506) will thus eventually reach the raised position shown in FIG. 39, in response to pulling on deployment cable (840) by the winch. Since posts (504, 506) and horizontal members (508, 520, 560) are all coupled together via welds and/or bolts, etc., it will be understood that posts (504, 506) and horizontal members (508, 520, 560) raise to the deployed position substantially unitarily, in response to pulling on deployment cable (840) by the winch. It should also be understood that, by using a pulley system and scissor arms (800*a*, 800*b*, 802*a*, 802*b*) as described herein, the load on the winch may be the lesser load provided by the mechanical advantage of each system. From the retracted position, the pulley system may have the better mechanical advantage; but as posts (504, 506) rise, scissor arms (800*a*, 800*b*, 802*a*, 802*b*) may gradually take over the load with a greater mechanical advantage. Theoretically, the winch load may approach zero as scissor arms (800*a*, 800*b*, 802*a*, 802*b*) approach vertical.

In addition, as also shown in FIG. 39, the configuration and positioning of brackets (850, 854) and scissor arms (800*a*, 800*b*, 802*a*, 802*b*) provide a "hyperextension" of scissor arms (800*a*, 800*b*, 802*a*, 802*b*) when post (506) reaches the raised/deployed position. In particular, pins (852, 856) are spaced away from post (506) in such a way that they allow pin (805) to go "over center." In other words, when scissor arms (800*a*, 800*b*, 802*a*, 802*b*) are moved to the hyper-extended position shown in FIG. 39, pins (852, 856) together define a substantially vertical axis, while pin (805) is located to the left of that axis after having passed through that axis. Scissor arms (800*a*, 800*b*, 802*a*, 802*b*) thus rotate past a purely vertical position until they rest against post (506), under the urging of cable (842). With scissor arms (800*a*, 800*b*, 802*a*, 802*b*) in such a hyper-extended position, resting against post (506), scissor arms (800*a*, 800*b*, 802*a*, 802*b*) are configured to hold post (506) in the raised/deployed position. In other words, scissor arms (800*a*, 800*b*, 802*a*, 802*b*) bear the weight of posts (504, 506) and horizontal members (508, 520, 560) to keep barrier system (500) in the deployed position. In addition to or in lieu of resting against post (506), scissor arms (800*a*, 800*b*) may rest on corresponding scissor arms (802*a*, 802*b*) at notches (809, 815) when scissor arms (800*a*, 800*b*, 802*a*, 802*b*) reach a hyper-extended position.

Figure 44:
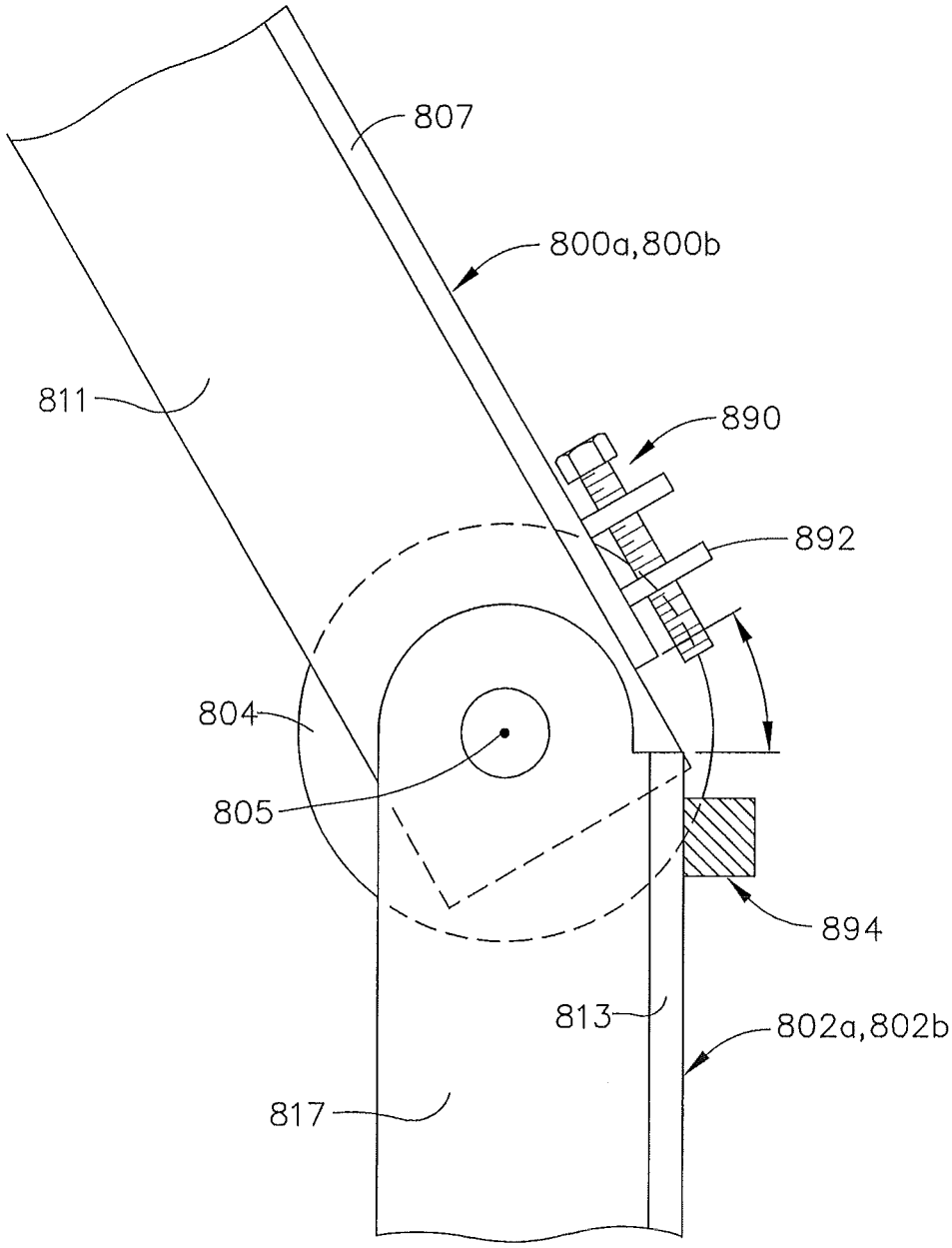
FIG. 44 is a partial side view of the support members of FIGS. 40A-40B, with exemplary hyper-extension restriction components.

To the extent that scissor arms (800*a*, 800*b*) rest on scissor arms (802*a*, 802*b*) when scissor arms (800*a*, 800*b*, 802*a*, 802*b*) reach a hyper-extended position, one or more features may be provided to allow adjustability of the degree to which scissor arms (800*a*, 800*b*, 802*a*, 802*b*) are hyper-extended. By way of example only, and as shown in FIG. 44, one or both of scissor arms (800*a*, 800*b*) may include a bolt (890) that is secured to scissor arm (800*a*, 800*b*) by a bracket (892). One or both of scissor arms (802*a*, 802*b*) may include an integral stop block (894). Bolt (890), bracket (892), and stop block (894) may be configured and arranged such that bolt (890) engages block (894) upon sufficient rotation of scissor arms (800*a*, 800*b*) relative to scissor arms (802*a*, 802*b*). Such engagement of bolt (890) with stop block (894) may thus restrict the degree to which scissor arms (800*a*, 800*b*, 802*a*, 802*b*) are hyper-extended. Bolt (890) may be rotatable relative to bracket (892) to adjust the length to which the lower end of bolt (890) extends from bracket (892), which may in turn adjust the degree to which bolt (890) and stop block (894) restrict hyper-extension of scissor arms (800*a*, 800*b*, 802*a*, 802*b*). Of course, these components are merely optional, and these components may be modified, substituted, supplemented, or omitted as desired.

By scissor arms (800*a*, 800*b*, 802*a*, 802*b*) assuming the weight bearing of posts (504, 506) and horizontal members (508, 520, 560) when scissor arms (800*a*, 800*b*, 802*a*, 802*b*) are in an unfolded configuration, scissor arms (800*a*, 800*b*, 802*a*, 802*b*) may substantially reduce or totally remove the dead load on cable (840) and the winch break when barrier system (500) is in the fully deployed position. Scissor arms (800*a*, 800*b*, 802*a*, 802*b*) may thus act as a "safety" support in the event of winch or cable failure when deployed. Also, during a crash (e.g., when a moving vehicle strikes barrier system (500)), scissor arms (800*a*, 800*b*, 802*a*, 802*b*) may be placed in tension during initial impact by a vehicle and may assist cable (840) and the winch brake with absorbing any initial upward load resulting from the vehicle impact. Similarly, extended scissor arms (800*a*, 800*b*, 802*a*, 802*b*) may provide column-like support that substantially resists downward forces exerted on posts (504, 506) and horizontal members (508, 520, 560) when a vehicle strikes a fully deployed barrier system (500). Scissor arms (800*a*, 800*b*, 802*a*, 802*b*) may thus assist with downward loads that would be encountered by cable (840) and the winch brake resulting from a vehicle impact.

As noted above, a retraction cable (841) also extends from the winch. As shown in FIGS. 38-39, retraction cable (841) passes around the underside of pulley (808). Of course, retraction cable (841) may first encounter one or more additional pulleys after the winch, before reaching pulley (808). Retraction cable (841) terminates at a coupling (843) on a bracket (861). Bracket (861) is secured to the underside of web (564) of gate member (560). Bracket (861) may comprise a structural angle or other structure welded to (or otherwise secured to) web (564) of gate member (560). Coupling (843) permits the end of retraction cable (841) to rotate relative to bracket (861). Various forms that coupling (843) may take (e.g., eyelet on a pin, etc.) will be apparent to those of ordinary skill in the art in view of the teachings herein.

As post (506) is being raised as described above, retraction cable (841) eventually engages pulley (806). In particular, and with reference to the view shown in FIG. 39, retraction cable (841) engages the left-hand side of pulley (806). Various suitable ways in which retraction cable (841) may be guided into engagement with pulley (806) will be apparent to those of ordinary skill in the art in view of the teachings herein. As deployment cable (840) is pulled to raise/deploy post (506), retraction cable (841) is provided with enough slack to permit scissor arms (800*a*, 800*b*, 802*a*, 802*b*) to reach the hyper-extended position shown in FIG. 39, despite engagement between retraction cable (841) and pulley (806).

To lower/retract post (506), the winch pulls on retraction cable (841) as slack is provided to deployment cable (840). In the initial stages of such retraction, the increased tension in retraction cable (841) urges pulley (806) to the right in the view shown in FIG. 39. Thus, the pivotal junction of scissor arms (800*a*, 800*b*) with scissor arms (802*a*, 802*b*) is urged away from post (506), such that the pivotal junction of scissor arms (800*a*, 800*b*) with scissor arms (802*a*, 802*b*) is moved past the vertical to allow scissor arms (800*a*, 800*b*, 802*a*, 802*b*) to return back to the folded position in FIG. 38. Though retraction cable (841) eventually disengages pulley (806) during such movement, pulled retraction cable (841) continues to pull downward on gate beam (562) via coupling (843) and bracket (861). Since posts (504, 506) and horizontal members (508, 520, 560) are all coupled together via welds and/or bolts, etc., it will be understood that posts (504, 506) and horizontal members (508, 520, 560) lower to the retracted position substantially unitarily, in response to pulling on retraction cable (841) by the winch.

As shown in FIG. 40A, each scissor arm (800*a*, 800*b*) includes a chamfer (801) formed in its transverse portion (807). As can be seen in FIGS. 38-39, such a chamfer (801) provides clearance for rotation of scissor arms (800*a*, 800*b*) about pin (856), avoiding interference or obstruction that might otherwise occur between transverse portion (807) and web (564) during such rotation. Similarly, as shown in FIG. 40B, each scissor arm (802*a*, 802*b*) includes a chamfer (803) formed in its transverse portion (817). As can be seen in FIGS. 38-39, such a chamfer (803) provides clearance for rotation of scissor arms (802*a*, 802*b*) about pin (852), avoiding interference or obstruction that might otherwise occur between transverse portion (813) and floor (514) of housing (510) during such rotation. In addition, as shown in FIGS. 40A-40B, transverse portions (807, 813) include respective notches (809, 815), which are configured to permit scissor arms (800*a*, 800*b*, 802*a*, 802*b*) to reach the hyper-extended configuration shown in FIG. 39, avoiding interference or obstruction that might otherwise occur between transverse portions (807, 813). As noted above, scissor arms (800*a*, 800*b*) may rest on corresponding scissor arms (802*a*, 802*b*) at notches (809, 815) when scissor arms (800*a*, 800*b*, 802*a*, 802*b*) reach a hyper-extended position. Of course, the above-described features and configurations of scissor arms (800*a*, 800*b*, 802*a*, 802*b*) are merely illustrative. Various other suitable ways in which scissor arms (800*a*, 800*b*, 802*a*, 802*b*) may be configured will be apparent to those of ordinary skill in the art in view of the teachings herein.

Figure 42:
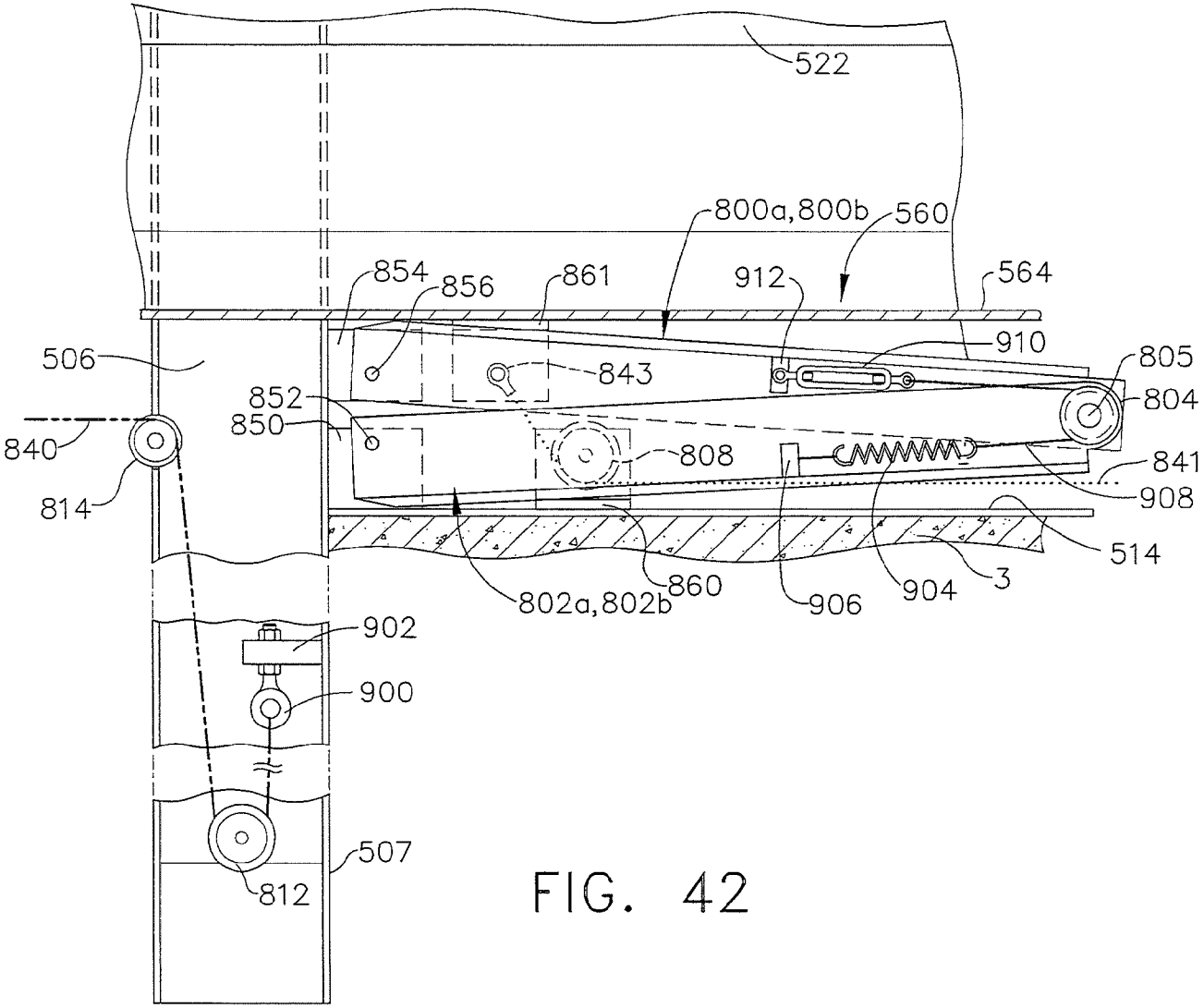
FIG. 42 is a side view of another exemplary support member assembly, with the support members in a folded configuration.
Figure 43:
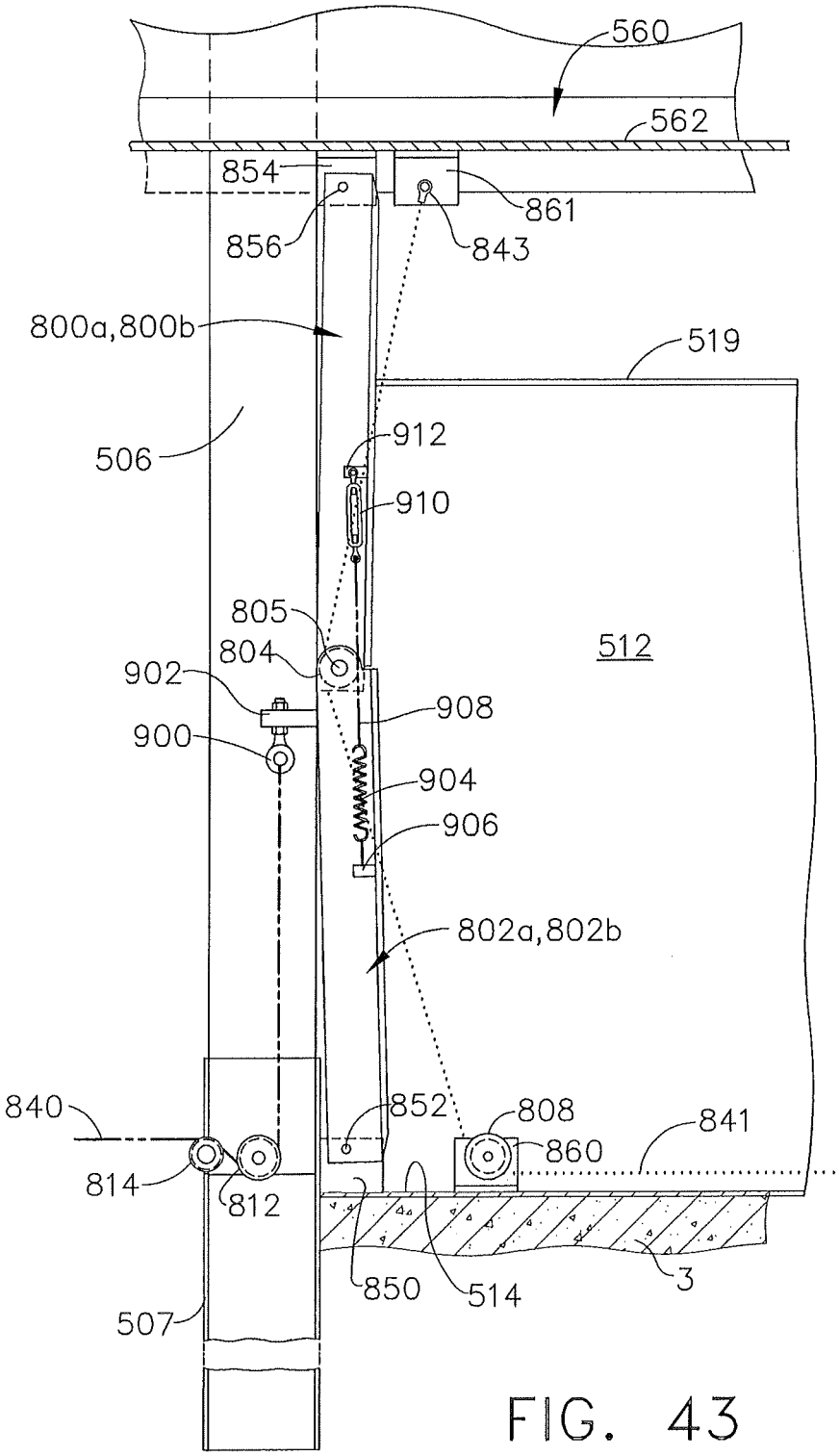
FIG. 43 is a side view of the support member assembly of FIG. 42, with the support members in an unfolded, hyper-extended configuration to support a deployed barrier.

FIGS. 42-43 show exemplary alternative components and features that may be used to assist in raising/deployment of post (506) and lowering/retraction of post (506). The components and features in this example are substantially the same as those described above with respect to FIGS. 38-41, unless otherwise indicated. For instance, this example also includes cables (840, 841), pulleys (808, 814, 812), coupling (843), and scissor arms (800*a*, 800*b*, 802*a*, 802*b*). However, this example includes an eye-bolt (900), tension spring (904), turnbuckle (910), cable (908), and brackets (902, 906, 912), as will be described in greater detail below.

Eye bolt (900) is secured to post (506) via bracket (902) in the present example. In particular, bracket (902) is welded to (or otherwise secured to) post (506), and eye bolt (900) is inserted through bracket (902). The end of deployment cable (840) is secured to eye bolt (900). Eye bolt (900) and bracket (902) of this example are thus analogous to eye bolt (180) and bracket (184) described above in the context of barrier system (10). In other words, post (506) is raised to the deployed position in a manner similar to post (101) described above in the context of barrier system (10). It will therefore be understood that post (506) is raised to the deployed position in this example by the winch pulling on deployment cable (840). Since posts (504, 506) and horizontal members (508, 520, 560) are all coupled together via welds and/or bolts, etc., it will also be understood that posts (504, 506) and horizontal members (508, 520, 560) raise to the deployed position substantially unitarily, in response to pulling on deployment cable (840) by the winch in this example.

When post (506) is raised to the deployed position, tension spring (904) and cable (908) are configured to urge scissor arms (800*a*, 800*b*, 802*a*, 802*b*) to the hyper-extended position shown in FIG. 43. In particular, one end of tension spring (904) is secured to scissor arm (802*a*) by a bracket (906). Such a bracket (906) may be welded to (or otherwise secured to) vertical portion (817) and/or transverse portion (813) of scissor arm (802*a*). Cable (908) is secured to the other end of tension spring (904). Cable (908) is also secured to turnbuckle (910). Turnbuckle (910) is secured to scissor arm (800*a*) by a bracket (912). Such a bracket (912) may be welded to (or otherwise secured to) vertical portion (811) and/or transverse portion (807) of scissor arm (800*a*). In the views of FIGS. 42-43, cable (908) is wrapped about the right-hand side of pulley (805). Tension spring (904) is biased to increase tension in cable (908). Thus, due to this bias and the relative positioning of brackets (906, 912) and pulley (805), tension spring (904) and cable (908) together bias pulley (805) to the left in the views of FIGS. 42-43. Turnbuckle (910) may be rotated to adjust the amount of bias provided by this assembly.

In view of the foregoing, it should be understood that as post (506) is raised by pulling on deployment cable (840), scissor arms (800*a*, 800*b*, 802*a*, 802*b*) eventually reach a substantially vertical position. However, due to the bias imposed on pulley (805) by tension spring (904) and cable (908), the pivotal junction of scissor arms (800*a*, 800*b*) with scissor arms (802*a*, 802*b*) is urged toward post (506). This urging causes hyperextension of scissor arms (800*a*, 800*b*, 802*a*, 802*b*), as described above. Scissor arms (800*a*, 800*b*, 802*a*, 802*b*) thus rotate past a purely vertical position until they rest against post (506), under the urging of cable (908) and tension spring (904). With scissor arms (800*a*, 800*b*, 802*a*, 802*b*) in such a hyper-extended position, resting against post (506), scissor arms (800*a*, 800*b*, 802*a*, 802*b*) are configured to hold post (506) in the raised/deployed position. In other words, scissor arms (800*a*, 800*b*, 802*a*, 802*b*) bear the weight of posts (504, 506) and horizontal members (508, 520, 560) to keep barrier system (500) in the deployed position. Of course, as noted above, scissor arms (800*a*, 800*b*) may rest on corresponding scissor arms (802*a*, 802*b*) at notches (809, 815) when scissor arms (800*a*, 800*b*, 802*a*, 802*b*) reach a hyper-extended position in addition to or in lieu of resting against post (506).

The lowering/retraction of post (506) in this example is substantially identical to the lowering/retraction of post (506) described above in the context of FIGS. 38-41. In particular, retraction cable (841) is routed along pulley (808) to reach coupling (843). As post (506) is raised, pulley (806) engages retraction cable (841). Retraction cable (841) is again provided with enough slack to allow tension spring (904) and cable (908) to push scissor arms (800*a*, 800*b*, 802*a*, 802*b*) to the hyper-extended position when post (506) has been sufficiently raised. When retraction cable (841) is pulled to lower/retract post (506), the increased tension in retraction cable (841) urges pulley (806) to the right in the view shown in FIG. 43. This urging is sufficient to overcome the resilient leftward bias provided by tension spring (904) and cable (908) on pulley (804). Thus, the pivotal junction of scissor arms (800*a*, 800*b*) with scissor arms (802*a*, 802*b*) is urged away from post (506), such that the pivotal junction of scissor arms (800*a*, 800*b*) with scissor arms (802*a*, 802*b*) is moved past the vertical to allow scissor arms (800*a*, 800*b*, 802*a*, 802*b*) to return back to the folded position in FIG. 42. Though retraction cable (841) eventually disengages pulley (806) during such movement, pulled retraction cable (841) continues to pull downward on gate beam (562) via coupling (843) and bracket (861). Since posts (504, 506) and horizontal members (508, 520, 560) are all coupled together via welds and/or bolts, etc., it will be understood that posts (504, 506) and horizontal members (508, 520, 560) lower to the retracted position substantially unitarily, in response to pulling on retraction cable (841) by the winch.

It should be understood that the foregoing examples of components and features that may be used to assist in raising/deployment of post (506), maintaining post (506) in the raised/deployed position, and lowering/retraction of post (506) are merely illustrative. Any such features and components may be varied, substituted, supplemented, or omitted as desired, as will be apparent to those of ordinary skill in the art in view of the teachings herein. With reference to FIG. 37, it should also be understood that the orientation of scissor arms (800*a*, 800*b*, 802*a*, 802*b*) and the directions of pulling on cables (840, 841) may be readily reversed for the other lifting post (506) in barrier system (500). In addition, those of ordinary skill in the art will appreciate that the deployment and retraction components and features described herein in the context of barrier system (500) may be readily substituted or supplemented with various deployment and retraction components and features described herein in the context of other barrier systems (10, 300, 400). Likewise, the deployment and retraction components and features described herein in the context of barrier systems (10, 300, 400) may be readily substituted or supplemented with various deployment and retraction components and features described herein in the context of barrier system (500). For instance, scissor arms (800*a*, 800*b*, 802*a*, 802*b*) and associated components, including modifications thereof, may be readily incorporated into barrier systems (10, 300, 400) if desired. Still other suitable ways in which various teachings provided in the context of one or more barrier systems (10, 300, 400, 500) described herein may be incorporated into any of the other barrier systems (10, 300, 400, 500) described herein will be apparent to those of ordinary skill in the art.

In some versions, one or more plates (not shown) may be provided in housing (510), to substantially cover at least some of the above described cables and/or pulleys, such as to protect such cables and/or pulleys from debris, etc. Of course, such plates are merely optional.

E. Exemplary Control

Control of barrier system (500) may be provided in a variety of ways. For instance, control may be provided locally or remotely, just as in the various options for control described above with respect to barrier systems (10, 300, 400). Similarly, barrier system (500) may include safety or warning features, etc., just like those features described above with respect to barrier systems (10, 300, 400). In fact, any teachings herein relating to barrier systems (10, 300, 400) (or other barrier systems described herein) may be readily applied to barrier system (500) as will be apparent to those of ordinary skill in the art. Barrier system (500) may be thus deployed and undeployed using any of the deployment/undeployment mechanisms and control systems described herein. Alternatively, any other suitable deployment/undeployment mechanisms and/or control systems may be used. Likewise, any teachings herein relating to barrier system (500) may be readily applied to barrier systems (10, 300, 400) (or other barrier systems described herein) as will be apparent to those of ordinary skill in the art. Various other suitable components, features, configurations, operabilities, and uses of barrier system (500) will also be apparent to those of ordinary skill in the art in view of the teachings herein. By way of example only, a substitute or supplement for gate beams (520, 560) may include guardrails, chains, cables, rods, bars, rails, ropes, netting, plates, or any other suitable structures, including combinations of such structures, and including any suitable material or combination of materials.

V. Exemplary Uses

It will be appreciated by those of ordinary skill in the art that each barrier system (10, 300, 400, 500) described herein may be used in a variety of ways. In one merely exemplary use, barrier system (10, 300, 400, 500) is positioned in a median of a multi-lane highway or interstate, between a pair of preexisting median barriers such as preexisting guardrails, cables, or concrete walls, etc. For instance, barrier system (10, 300, 400, 500) may be constructed into a new concrete barrier wall, positioned in a preexisting gap between preexisting barrier walls, or "cut into" a preexisting barrier wall, etc. Guide plates or other features may be mounted to the preexisting median barriers in order to guide or reinforce one or more portions of barrier system (10, 300, 400, 500) (e.g., guardrails (202), etc.). Concrete (3) of barrier system (10, 300, 400, 500) or any other component of barrier system (10, 300, 400, 500) may also be anchored with a preexisting concrete median wall. In this example, barrier system (10, 300, 400, 500) is oriented substantially parallel to the flow of traffic on a roadway, and is configured to restrict passage across a highway median rather than restricting passage across a lane of a roadway. It will be appreciated that having barrier system (10, 300, 400, 500) in such a location may be useful for emergency vehicles that need to cross the median of a highway or interstate, etc., who may otherwise need to travel substantial distances out of the way just to get to the other side of the highway. Furthermore, barrier system (10, 300, 400, 500) may be installed where gaps already exist between median barriers (e.g., where such gaps were created for use by patrol cruisers or emergency vehicles), and may be set in a deployed configuration by default to prevent unauthorized use of such gaps by non-state and non-emergency vehicles, such that obstructive portions of barrier system (10, 300, 400, 500) may be lowered when authorized vehicles need to cross the median.

Similar to the example above, barrier system (10, 300, 400, 500) may be positioned in the median of a highway that does not have guardrails or walls in the median. In particular, barrier system (10, 300, 400, 500) may be positioned in the median of a highway that uses cables and posts to prevent vehicles from crossing the median. For instance, some such medians may currently have openings in the cable and post lines to permit emergency vehicles to cross the median. Any version of barrier system (10, 300, 400, 500), particularly, barrier system (400), may be positioned in such paths to prevent non-emergency vehicles from crossing such paths while permitting emergency vehicles to lower the barrier (10, 300, 400, 500) to permit passage through the paths. As noted above with respect to barrier system (400), cables (402) may tie into the preexisting system of cables and posts in the median. For instance, the cables (402) of barrier system (400) may be coupled with whichever posts or cables are immediately adjacent to each end of barrier system (400). As yet another alternative, a barrier system (400) may be retrofitted to a preexisting cable median barrier system such that posts (420) are coupled directly with a span of the preexisting cables, and such that posts (420) and horizontal member (405) may be used to selectively raise and lower the preexisting cables. Still other ways in which barrier system (400) (or other types of barrier systems (10, 300, 500)) may be used in conjunction with a preexisting system of posts and cables in a highway median will be apparent to those of ordinary skill in the art in view of the teachings herein.

In another merely exemplary use, barrier system (10, 300, 400, 500) is provided in a roadway (not shown). Barrier system (10, 300, 400, 500) may have a length such that it extends across the width of the roadway to any suitable length (e.g., across one or more traffic lanes in the roadway, across the entire width of the roadway, etc.). To permit normal passage of traffic across the roadway, barrier system (10, 300, 400, 500) may be kept in a retracted configuration. When the provision of a barrier is desired, the winch (or other type of component) may be activated to transition barrier system (10, 300, 400, 500) to a deployed configuration. Such a deployed barrier system (10, 300, 400, 500) may provide a barrier substantially preventing passage of vehicles approaching barrier system (10, 300, 400, 500) from either direction. If a vehicle strikes one or more obstructive portions of barrier system (10, 300, 400, 500), such barrier system (10, 300, 400, 500) may quickly bring such a vehicle to a stop. Alternatively, if a vehicle does not strike barrier system (10, 300, 400, 500), and if a barrier is no longer desired, a winch (or other type of component) may be activated again to transition barrier system (10, 300, 400, 500) back to the retracted configuration to once again permit passage of vehicular traffic.

While barrier system (10, 300, 400, 500) has been described as being capable of spanning across an entire width of a roadway, it will be appreciated that barrier system (10, 300, 400, 500) may span across any other suitable length. For instance, a barrier system (10, 300, 400, 500) may span across only one lane of traffic. Alternatively, barrier system (10, 300, 400, 500) may be configured to span across distances that far exceed the width of a roadway. For instance, a barrier system (10, 300, 400, 500) may be constructed to span across the entire width of the face of a building, park, or other location, or may be constructed to span around the entire perimeter of such a location.

In another exemplary use, barrier system (10, 300, 400, 500) is installed behind a pre-existing gate (not shown) that it is used to selectively restrict access to a road, driveway, or the like. Barrier system (10, 300, 400, 500) may therefore provide reinforcement or a "back up" for existing barriers (e.g., where existing barriers are less able to prevent passage of a moving vehicle intent on passing through the barrier). Barrier system (10, 300, 400, 500) may thus be used to provide security for non-authorized vehicle entry. As another merely exemplary use, barrier system (10, 300, 400, 500) may be used by the military to provide checkpoints, by police to provide blockades, or by other persons or entities for a variety of purposes.

It should also be understood that barrier system (10, 300, 400, 500) may be constructed such that it spans around corners, such as at right angles, along a curve, or otherwise (e.g., to conform to property lines or desired security perimeter, etc.). For instance, one or more cables (402) or chains (302) could easily be extended around a corner using a pulley or other component. Similarly, any suitable number of cables may be coupled with a deployment cable or a retraction cable via a clevis or other component, and such additional cables may be extended around a corner using a pulley or other component. Thus, even if several deployment posts (101, 320, 420, 506) are used at different positions about one or more corners, such deployment posts (101, 320, 420, 506) may all be simultaneously deployed using a single winch in some implementations. For instance, a single barrier system (10, 300, 400, 500) may be arranged in a rectangle or square surrounding the perimeter of an entire building, and a single winch may be used to simultaneously raise and/or simultaneously lower posts (101, 320, 420, 506) on all four sides of the building perimeter. Such posts (101, 320, 420, 506) could be positioned at each side of each corner and/or elsewhere.

It will also be appreciated that, in many situations, length may be added to a barrier system (10, 300, 400, 500) simply by lengthening guardrails (202), chains (302), cables (402), gate beams (520, 560), etc., and possibly adding additional posts (100, 101, 320, 420, 504, 506). For instance, a barrier system (300) with chains (302) and/or a barrier system (400) with cables (402) may be used to protect areas that span 200 feet or more (e.g., as opposed to just one traffic lane spanning 12 feet). Furthermore, in many situations, all posts (100, 101, 320, 420, 504, 506) may still be deployed by a single drive mechanism (e.g., winch (17)). To the extent that increasing the length of barrier system (10, 300, 400, 500) requires the addition of more posts (100, 101, 320, 420, 504, 506) additional cables may be easily coupled with cables described herein, and additional pulleys may be provided, as desired.

It should be understood that any barrier system (10, 300, 400, 500) described herein may include an audio and/or visual warning system that may be activated when barrier system (10, 300, 400, 500) is transitioning from an extended position to a retracted position; and or when barrier system (10, 300, 400, 500) is transitioning from a retracted position to an extended position. For instance, such a warning system may include a horn/klaxon, bell, or other type of alarm and/or a flashing light, etc. Such a warning system may thus provide a warning to traffic that barrier system (10, 300, 400, 500) is changing its position.

Of course, barrier system (10, 300, 400, 500) may be used in a variety of other contexts and for a variety of other purposes. Various other contexts and purposes in which barrier system (10, 300, 400, 500) may be used, as well as various other techniques for using barrier system (10, 300, 400, 500), will be apparent to those of ordinary skill in the art in view of the teachings herein.

VI. Exemplary Alternatives

Some merely illustrative alternative versions of barrier system (10, 300, 400, 500) use a pair of rolling cars (not shown) to provide deployment and retraction of posts (100, 101, 320, 420, 504, 506). Examples of such rolling car actuation are described in greater detail in U.S. Provisional Patent Application Ser. No. 60/799,439, entitled "Vehicle Barrier Deployment System," filed May 10, 2006, the disclosure of which is incorporated by reference herein. In fact, it should be understood that any barrier system (10, 300, 400, 500) described herein may be modified in accordance with any of the teachings in U.S. Provisional Patent Application Ser. No. 60/799,439, entitled "Vehicle Barrier Deployment System," filed May 10, 2006, the disclosure of which is incorporated by reference herein. Any barrier system (10, 300, 400, 500) described herein may also be modified in accordance with any of the teachings in U.S. Pub. No. 2007/0264080, entitled "Vehicle Barrier Deployment System," published Nov. 15, 2007, the disclosure of which is incorporated by reference herein. Various suitable ways in which the teachings of U.S. Provisional Patent Application Ser. No. 60/799,439 and/or U.S. Pub. No. 2007/0264080 may be incorporated with the teachings herein (and vice versa) will be apparent to those of ordinary skill in the art.

In will be understood in view of the above that a deployed barrier system (10, 300, 400, 500) may provide a bi-directional barrier. Furthermore, barrier system (10, 300, 400, 500) is operable to provide such a barrier with a single drive mechanism (e.g., winch (17)). In some versions as described above, the drive mechanism that is used to deploy a barrier is mechanical or electromechanical, such as winch (17) or some other mechanical/electromechanical device. It will be appreciated that, where a mechanical or electromechanical drive mechanism is used, barrier system (10, 300, 400, 500) may be substantially free of any hydraulic or pneumatic devices. In other words, a drive mechanism need not rely on hydraulics or pneumatics to operate, which may be preferable in certain situations. In other situations, hydraulics or pneumatics may be preferred, and a hydraulic or pneumatic device may be incorporated into a barrier system (10, 300, 400, 500), either for a drive mechanism or otherwise.

Barrier system (10, 300, 400, 500) has been described herein as deploying obstructive components in a manner that does not require a sweeping motion that is transverse to a longitudinal plane defined by barrier system (10, 300, 400, 500). Instead, obstructive components of (10, 300, 400, 500) (e.g., guardrail (202), chains (302), cables (402), gate beams (520, 560), etc.) simply move up and down along the longitudinal plane defined by barrier system (10, 300, 400, 500) during deployment and retraction. It will be appreciated that the absence of transverse sweeping by such components for deployment of such components may permit barrier system (10, 300, 400, 500) to occupy a relatively short portion of a lane of a roadway. Those of ordinary skill in the art will recognize that the narrow profile achieved by relying on deployment motion that is along a longitudinal plane of barrier system (10, 300, 400, 500) (and therefore transverse to roadway—vertically transverse and/or horizontally transverse as opposed to parallel) may ease installation of barrier system (10, 300, 400, 500) or provide other benefits. Alternatively, a barrier system (10, 300, 400, 500) may be modified to have a deployment motion that spans across any other suitable plane, including those transverse to a longitudinal plane defined by barrier system (10, 300, 400, 500) or those that are parallel with the roadway.

In any version of barrier system (10, 300, 400, 500) described herein that uses pulleys and cables, it should be understood that one or more of the pulleys (and/or an additional pulley incorporated into a cable/pulley system as described herein) may comprise a tension pulley. For instance, such a tension pulley may be spring loaded, and may be added to any cable section to maintain a positive tension on the winch drum for substantially uniform winding.

Any version of barrier system (10, 300, 400, 500) may include a heavy canvas, rubber sheeting or strips, sheet metal, and/or any other suitable structures or material(s) to substantially cover and protect the interior of housing (4, 310, 410, 510) from debris and/or snow, etc. when barrier system (10, 300, 400, 500) is in the fully deployed position. Such a protective covering may even be provided in versions where cover plates (5, 502) already provide some degree of protection to the interior of housing (4, 510). Such a protective covering may be secured to one or more portions of housing (4, 310, 410, 510) and/or to any other suitable components of barrier system (10, 300, 400, 500).

It should also be understood that any version of barrier system (10, 300, 400, 500) may be configured to substantially prevent or at least reduce the likelihood of "wheel snagging" occurring when a vehicle strikes barrier system (10, 300, 400, 500). For instance, components of barrier system (10, 300, 400, 500) may be sized, spaced, and otherwise arranged (relative to each other and relative to surrounding structures such as the ground) to substantially prevent or at least reduce the likelihood of "wheel snagging." Various ways in which barrier system (10, 300, 400, 500) may be configured to substantially prevent or at least reduce the likelihood of "wheel snagging" will be apparent to those of ordinary skill in the art in view of the teachings herein. It should also be understood that posts (100, 101, 320, 420, 504, 506) (or portions thereof) may be configured to "break away" from other components of barrier system (10, 300, 400, 500) upon sufficient impact by a vehicle, such as to prevent or reduce snagging.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims, and is understood not to be limited to the details of structure and operation shown and described in the specification and drawings.

I claim:

1. A vehicle barrier system, comprising:

(a) a housing;

(b) a pair of vertically oriented static guides, wherein at least an upper portion of each static guide is positioned above the housing;

(c) a movable barrier assembly, wherein the barrier assembly is configured to move between a raised position and a lowered position relative to the housing, wherein the barrier assembly comprises:

(i) a plurality of posts, wherein the plurality of posts comprise a first post and a second post, and (ii) a plurality of gate beams, wherein the plurality of gate beams are secured to the plurality of posts; and (d) an actuation assembly in communication with the barrier assembly, wherein the actuation assembly is operable to selectively move the barrier assembly between the raised position and the lowered position, wherein the actuation assembly comprises a powered rotary drive member, wherein the powered rotary drive member is operable in a first direction to pull the barrier assembly from the lowered position to the raised position, wherein the powered rotary drive member is operable in a second direction to pull the barrier assembly from the raised position to the lowered position;

wherein the housing is configured to receive the barrier assembly when the barrier assembly is in the lowered position;

wherein the gate beams are configured to fit between the upper portions of the static guides when the barrier assembly is in the raised position.

2. The system of claim 1, wherein the gate beams comprises structural steel beams.

3. The system of claim 1, wherein the gate beams comprise an upper gate beam and a lower gate beam, wherein the upper gate beam has a first cross-sectional width taken along a first plane, wherein the lower gate beam has a second cross-sectional width taken along the first plane, wherein the second cross-sectional width is greater than the first cross-sectional width.

4. The system of claim 1, further comprising at least one cover plate pivotably secured relative to the housing, wherein the cover plate is configured to selectively cover the barrier assembly when the barrier assembly is in the lowered position, wherein the barrier assembly is configured to drive the at least one cover plate open as the barrier assembly transitions from the lowered position to the raised position.

5. The system of claim 4, wherein the barrier assembly further comprises a cover plate deflection feature configured to deflect the at least one cover plate as the barrier assembly transitions from the raised position to the lowered position.

6. The system of claim 4, wherein the at least one cover plate comprises a pair of cover plates, wherein a lower gate beam of the plurality of gate beams is configured to hold the cover plates at opposing oblique angle when the barrier assembly is in the raised position.

7. The system of claim 1, wherein the first and second posts are positioned adjacent to the vertically oriented static guides.

8. The system of claim 1, wherein the barrier assembly further comprises collar assemblies coupling the gate beams with the posts.

9. The system of claim 1, wherein each gate beam comprises a single beam spanning across the plurality of posts.

10. The system of claim 9, wherein each single beam defines a plurality of openings configured to receive the posts.

11. The system of claim 1, wherein the housing includes outwardly extending upper flanges, wherein the upper portion of each static guide is positioned above the upper flanges, wherein a lower portion of each static guide is positioned below the upper flanges.

12. The system of claim 1, further comprising a pair of concrete barriers, wherein the concrete barriers are positioned outside and adjacent to the static guides.

13. The system of claim 12, wherein the concrete barriers comprise Jersey barriers having slanted lower portions.

14. The system of claim 13, wherein the static guides include foot portions with profiles configured to complement the slanted lower portions of the Jersey barriers.

15. The system of claim 1, further comprising a plurality of substantially vertical post guides, wherein the post guides are secured to the housing, wherein each post is translatable within a corresponding post guide of the plurality of post guides.

16. The system of claim 1, wherein the static guides each define vertical channels, wherein at least part of the first post is configured to fit in the vertical channel of one of the static guides, wherein at least part of the second post is configured to fit in the vertical channel of another one of the static guides.

17. The system of claim 1, wherein the powered rotary drive member comprises a winch, wherein the actuation assembly further comprises cables and pulleys, wherein the cables are coupled with the winch and with the barrier assembly.

18. A vehicle barrier system, comprising:

(a) a housing;

(b) a pair of vertically oriented static guides, wherein at least an upper portion of each static guide is positioned above the housing;

(c) a pair of concrete barriers positioned outside the upper portions of the static guides, wherein the concrete barriers have a cross-sectional profile, wherein the static guides have a cross-sectional profile complementing the cross-sectional profile of the concrete barriers;

(d) a movable barrier assembly, wherein the barrier assembly is configured to move between a raised position and a lowered position relative to the housing;

(e) an actuation assembly, wherein the actuation assembly comprises a powered rotary drive member, wherein the powered rotary drive member is operable in a first direction to pull the barrier assembly from the lowered position to the raised position, wherein the powered rotary drive member is operable in a second direction to pull the barrier assembly from the raised position to the lowered position; and (f) a pair of cover plates pivotally coupled relative to the housing, wherein the cover plates and the barrier assembly together define a cross-sectional profile complementing the cross-sectional profile of the concrete barriers.

19. A vehicle barrier system, comprising:

(a) a housing;

(b) a pair of vertically oriented static guides, wherein at least an upper portion of each static guide is positioned above the housing;

(c) a pair of Jersey barriers positioned outside the upper portions of the static guides, wherein each Jersey barrier has an upper portion and a flared foot portion, wherein the Jersey barriers have a cross-sectional profile, wherein the static guides have a cross-sectional profile complementing the cross-sectional profile of the Jersey barriers;

(d) a movable barrier assembly, wherein the barrier assembly is configured to move between a lowered position where the barrier assembly is positioned in the housing and a raised position where the barrier assembly is positioned between the upper portions of the static guides, wherein the barrier assembly has a cross-sectional profile complementing the cross-sectional profile of at least the upper portions of the Jersey barriers; and (e) an actuation assembly, wherein the actuation assembly comprises a powered rotary drive member, wherein the powered rotary drive member is operable in a first direction to pull the barrier assembly from the lowered position to the raised position, wherein the powered rotary drive member is operable in a second direction to pull the barrier assembly from the raised position to the lowered position.

* * * * *